US007645126B2

(12) United States Patent
Sekiguchi et al.

(10) Patent No.: US 7,645,126 B2
(45) Date of Patent: Jan. 12, 2010

(54) VACUUM PUMP AND SEMICONDUCTOR MANUFACTURING APPARATUS

(75) Inventors: Shinichi Sekiguchi, Tokyo (JP); Matsutaro Miyamoto, Tokyo (JP)

(73) Assignee: Ebara Corporation, Tokyo (JP)

( * ) Notice: Subject to any disclaimer, the term of this patent is extended or adjusted under 35 U.S.C. 154(b) by 581 days.

(21) Appl. No.: 10/887,234

(22) Filed: Jul. 9, 2004

(65) Prior Publication Data

US 2005/0025640 A1 Feb. 3, 2005

(30) Foreign Application Priority Data

Jul. 10, 2003 (JP) ..... 2003-195407
Jun. 10, 2004 (JP) ..... 2004-173085

(51) Int. Cl.
*F04B 17/00* (2006.01)
*F01D 5/14* (2006.01)

(52) U.S. Cl. ..... 417/423.4; 417/423.5; 416/223 A; 416/223 R

(58) Field of Classification Search ..... 415/90; 417/423.4, 423.5, 423.12; 416/223 A, 223 R
See application file for complete search history.

(56) References Cited

U.S. PATENT DOCUMENTS 3,668,393 A 6/1972 Von Rauch
4,579,508 A 4/1986 Tsumaki et al.
4,668,160 A 5/1987 Mase et al.
RE33,129 E * 12/1989 Mase et al. ..... 415/90
5,219,269 A * 6/1993 Ikegami et al. ..... 415/55.1
6,340,291 B1 * 1/2002 Reckert ..... 416/185
6,375,413 B1 4/2002 Stones (Continued)

FOREIGN PATENT DOCUMENTS

JP 61-247893 11/1986

(Continued)

OTHER PUBLICATIONS

European Patent Office Partial Search Report mailed Oct. 15, 2009, issued in corresponding European Application No. 04016346.

*Primary Examiner*—Devon C Kramer
*Assistant Examiner*—Leonard J Weinstein
(74) *Attorney, Agent, or Firm*—Westerman, Hattori, Daniels & Adrian, LLP

(57) ABSTRACT

To provide a vacuum pump capable of evacuating in pressure ranges from an atmospheric pressure to a high vacuum, capable of rotating at a high speed to be downsized and improved in pumping performance, and capable of producing a completely oil-free vacuum.

A vacuum pump for exhausting a gas comprises: a main shaft 5 rotatably supported by a bearing 22; a motor 23 for driving the main shaft 5 for rotation; a first exhaust section 10 having a first rotary vane 13 attached to the main shaft 5, a first fixed vane 14 fixed in a first casing 12, and an intake port 11; and a second exhaust section 30 having a second rotary vane 33 attached to the main shaft 5, a second fixed vane 34 fixed in a second casing 32, and an exhaust port 31. The intake port 11 is located in the vicinity of an end of the main shaft 5, and the first exhaust section 10, the bearing 22 and the second exhaust section 30 are arranged in this order axially along the main shaft 5.

9 Claims, 32 Drawing Sheets

U.S. PATENT DOCUMENTS

| | | | | |
|---|---|---|---|---|
| 6,409,468 | B1 * | 6/2002 | Kawasaki | 415/71 |
| 6,409,477 | B1 | 6/2002 | Blecker et al. | |
| 6,422,829 | B1 * | 7/2002 | Schutz | 417/203 |
| 6,474,940 | B1 * | 11/2002 | Yamauchi et al. | 415/90 |
| 6,478,539 | B1 * | 11/2002 | Trutschel | 415/223 |
| 2002/0028132 | A1 * | 3/2002 | Ikegami et al. | 415/90 |
| 2002/0122729 | A1 * | 9/2002 | Yamashita et al. | 417/199.1 |
| 2003/0175132 | A1 * | 9/2003 | Ishikawa | 417/353 |

FOREIGN PATENT DOCUMENTS

| | | |
|---|---|---|
| JP | 2-19694 | 1/1990 |
| JP | 2001-27195 | 1/2001 |
| JP | 2001-182685 | 7/2001 |

* cited by examiner

*FIG. 10*

| Pump element | Parameter | Measure to reduce size of exhaust flow passage | Reference drawing |
|---|---|---|---|
| Turbine vane | Number of blades (Distance between blades) | large (small) | FIG. 11 |
| | Height of blade (Distance between blades) | low (small) | |
| Centrifugal drag vane | Number of blades (Width of groove) | large (small) | FIG. 12 |
| | Groove depth | shallow | |
| Vortex flow vane | Number of blades (Distance between blades) | large (small) | FIG. 13 |
| | Height of blade | low | |

VACUUM PUMP AND SEMICONDUCTOR MANUFACTURING APPARATUS

BACKGROUND OF THE INVENTION

1. Field of the Invention

The present invention relates to a vacuum pump, and more particularly to a vacuum pump capable of effective evacuation in pressure ranges from an atmospheric pressure to a high vacuum.

2. Description of the Related Art

FIG. 31 is a schematic diagram of a semiconductor manufacturing apparatus with a conventional vacuum pump.

As shown in FIG. 31, a semiconductor manufacturing apparatus 101 has a plurality of process chambers 102, a transfer chamber 103 and a cassette chamber 104. A wafer (substrate) to be processed is placed in the cassette chamber 104, transferred by way of the transfer chamber 103 to the process chamber 102, where it is subject to a predetermined process (such as PVD, CVD, and etching). A plurality of process chambers 102 are commonly provided in order to perform a plurality of processes or to increase the number of wafers to be processed in the single semiconductor manufacturing apparatus 101.

It is necessary to create a high vacuum state in the process chamber 102 before processing, and to exhaust a process gas continuously from the process chamber 102 during processing. To this end, a turbo molecular pump 105 is widely used as a vacuum pump for vacuum evacuation of the process chamber 102. While the turbo molecular pump 105 is operable in moderate and high vacuum ranges at the order of $10^1$ Pa or below, it cannot operate independently under atmospheric pressure. Therefore, a backing pump 106 for preliminary evacuation is connected to the exhaust port of the turbo molecular pump 105 through piping 107. The backing pump 106 is configured to evacuate a gas at a pressure from atmospheric pressure to the order of $10^1$ Pa.

A semiconductor manufacturing apparatus with the above configuration requires two types of vacuum pumps, namely the turbo molecular pump 105 and the backing pump 106, for each process chamber 102, as pumps for exhausting a gas therefrom. Therefore, there has been a problem of an increased space for installation, an increased number of components, a high cost, and so on. In recent years, the volume of gas used in semiconductor processing has tended to increase, which in turn has caused the vacuum pumps to be upsized, and the piping 107 to be upsized in diameter as well. Thus, the above problem becomes conspicuous.

There is mainly used a positive displacement pump, such as a roots pump, a screw pump, and an oil rotary pump, as the backing pump 106. This type of pump is configured that a rotor rotating at a relatively low speed reduces the volume of an exhaust flow passage in an exhaust chamber (casing) gradually to transfer a gas. Therefore, in order to increase the volume of gas transferred, the volume and the mass of the rotor need be increased, which unavoidably accompanies upsizing of the backing pump.

As measures for the above problem, there is a method in which the rotor is rotated at a high speed, in order to increase the volume of gas transferred without upsizing the backing pump. However, a roots pump and a screw pump have two main shafts, to each of which a rotor is fixed, and require a mechanism to constrain the rotation phases of the two main shafts (such as timing gear), and thus are not suitable for high-speed rotation. An oil rotary pump has an asymmetric rotor with respect to the rotation axis, and thus is not suitable for high-speed rotation, either. Thus, it is extremely difficult to downsize a backing pump with increasing the volume of gas transferred by causing the backing pump to rotate at a high speed.

In the above backing pumps, an oil such as lubricant is used in a bearing or a sealed portion, which hinders creation of a completely oil-free vacuum. This causes the quality and yield of products manufactured by the semiconductor manufacturing apparatus to be reduced.

In view of the above problems, Japanese Patent, JP-B-03-007039 discloses a vacuum pump capable of efficient vacuum evacuation from an atmospheric pressure to a high vacuum solely. The vacuum pump disclosed in the above Japanese Patent includes a centrifugal compression pump step having a plurality of impellers, and a circumferential flow compression pump step. However, the impellers are all attached to a tip of the main shaft, and therefore the rotor is a cantilever rotor with the tip of a large mass distribution. This deteriorates the vibration characteristics of the rotor and makes it difficult for the rotor to rotate at a high speed, causing a problem that the pump cannot be downsized. Furthermore, since a lubricant or the like is used in the bearing section, it was not possible to create a completely oil-free vacuum.

A vacuum pump disclosed in Japanese Patent, JP-B-07-086357 aims to adapt the rotor for high-speed rotation with the use of a magnetic bearing. However, since the magnetic bearing is located in the vicinity of an intake port, the magnetic bearing produces a resistance to exhaust gas, causing a problem that the exhaust performance of the vacuum pump was impaired. In particular, when the pressure on the intake port side is in the molecular flow range, the exhaust conductance reduces significantly, that is, the resistance to exhaust gas increases, causing a problem that the effective exhaust rate reduces conspicuously. Since a liquid coolant is introduced into a space connected to the exhaust flow passage of the pump, there also was a problem that the liquid coolant may contaminate the vacuum environment.

In the meantime, a turbo vacuum pump including a centrifugal drag pump element is occasionally used for vacuum evacuation of a process chamber of a semiconductor manufacturing apparatus. This type of turbo vacuum pump is described with reference to the drawings. FIG. 32 is a sectional view of a conventional turbo vacuum pump. FIG. 33(*a*) is a plan view of a centrifugal drag vane shown in FIG. 32, and FIG. 33(*b*) is a sectional view of the centrifugal drag vane shown in FIG. 32. FIG. 34(*a*) is a plan view of a fixed vane shown in FIG. 32, and FIG. 34(*b*) is a sectional view of the fixed vane shown in FIG. 32.

As shown in FIG. 32, the turbo vacuum pump comprises centrifugal drag vanes 133 constituting plural stages, a plurality of fixed vanes 134 disposed to face each of the stages of the centrifugal drag vanes 133, and a casing 108 having an intake port 111 and an exhaust port 131. The centrifugal drag vanes 133 are fixed to a main shaft 195, and are driven to rotate by a motor 123 through the main shaft 195. The main shaft 195 is supported in a non-contact manner by an upper radial magnetic bearing 122, a lower radial magnetic bearing 144, and an axial magnetic bearing 143. An upper touchdown bearing 126 and a lower touchdown bearing 147 are disposed above the upper radial magnetic bearing 122 and below the lower radial magnetic bearing 144, respectively.

As shown in FIG. 33(*a*) and FIG. 33(*b*), each of the centrifugal drag vanes 133 has a plurality of spiral blades 135 extending rearward with respect to the rotation direction, and a disk-shaped base 109 to which the spiral blades 135 are fixed. On the other hand, as shown in FIG. 34(*a*) and FIG. 34(*b*), the fixed vane 134 has a plurality of spiral guides 166 extending rearward with respect to the rotation direction of the centrifugal drag vanes 133, and an annular plane portion 167 to which the spiral guides 166 are fixed. The arrows G shown in FIG. 33(*a*) and FIG. 34(*a*) indicate the flow of a gas.

When the centrifugal drag vanes 133 are rotated in the direction of the arrow Q, a gas is drawn into the casing 108 from the intake port 111, and is compressed as it is transferred toward the radially outer side through action of a centrifugal force. The gas having been transferred to the radially outer side, then flows into a space defined by the spiral guides 166, the plane portion 167, and the backside of the base 109, and the gas is compressed as it is transferred toward the radially inner side through drag action due to viscosity of the gas. In this manner, the gas is transferred at each stage to be compressed to a desired pressure, and discharged through the exhaust port 131.

In the conventional turbo vacuum pump, however, since the number of stages of the vanes was simply increased to improve the exhaust performance, the exhaust efficiency remained low. Therefore, a problem was raised that the exhaust rate reduced and that the compression ratio remained low, which as a result caused upsizing of the entire turbo vacuum pump and an increase in manufacturing costs.

The present invention has been made in view of the foregoing, and it is therefore an object of the present invention to provide a vacuum pump capable of evacuating in pressure ranges from an atmospheric pressure to a high vacuum, capable of rotating at a high speed to be downsized and improved in pumping performance, and capable of producing a completely oil-free vacuum.

SUMMARY OF THE INVENTION

In order to solve the foregoing problem, one aspect of the present invention provides a vacuum pump for exhausting a gas, comprising a main shaft rotatably supported by a first bearing, a motor for rotating the main shaft, a first exhaust section having a first rotary vane attached to the main shaft, a first fixed vane fixed in a first casing, and an intake port, and a second exhaust section having a second rotary vane attached to the main shaft, a second fixed vane fixed in a second casing, and an exhaust port, in which the intake port is located in the vicinity of an end of the main shaft, and in which the first exhaust section, the first bearing and the second exhaust section are axially arranged in this order along the main shaft.

Since the first exhaust section, the first bearing, and the second exhaust section are serially arranged in this order from the suction side, as described above, the axial mass distribution of the entire pump rotor (the first rotary vane, the second rotary vane, and the main shaft) can be uniformed. Owing to this, it is possible to eliminate a state that the pump rotor is supported by the first bearing, in an extremely cantilevered fashion, or so called an overhanging state, thereby constituting a pump rotor suitable for high-speed rotation. That is, fine vibration characteristics of the pump rotor allows the pump rotor to rotate at a high speed. In particular, the use of a magnetic bearing as the first bearing has the following advantages. A magnetic bearing has a support rigidity significantly lower compared to a rolling bearing such as ball bearing, and is therefore likely to be affected by mass imbalance of the pump rotor and the vibration characteristics of the pump rotor (natural frequency of the pump rotor) during its high-speed rotation, which often makes stable rotation difficult. According to the present invention, the fine vibration characteristics of the pump rotor contribute to resolve the above problems.

Without an object that may obstruct the flow of the gas between the intake port and the first rotary vane of the first exhaust section, a vacuum pump with high exhaust performance can be obtained. In particular, the vacuum pump according to the present invention may be suitably used in the molecular flow range. That is, while an obstruction would cause significant reduction in conductance (increase in the resistance to exhaust gas) in the molecular flow range, where the pressure on the intake port side is low, the vacuum pump according to the present invention has no obstruction that may hinder the flow of the gas on the upstream side of the first exhaust section, thereby obtaining fine exhaust performance.

Another aspect of the present invention provides a vacuum pump for exhausting a gas, comprising a main shaft rotatably supported by a bearing, a motor for rotating the main shaft, a rotary vane attached to the main shaft, and a ring-shaped member located axially adjacent to the rotary vane, in which a linear expansion coefficient of a unit including the rotary vane and the ring-shaped member is generally the same as that of the main shaft.

Another aspect of the present invention provides a vacuum pump for exhausting a gas, comprising a main shaft rotatably supported by a bearing, a motor for rotating the main shaft, a rotary vane attached to the main shaft, and a ring-shaped member located axially adjacent to the rotary vane, in which the rotary vane has a cylindrical portion fitted with the main shaft, the ring-shaped member is fitted with an outer surface of the cylindrical portion, the outer surface of the cylindrical portion and an inner surface of the ring-shaped member are each formed with a notch extending axially, and a positioning member is inserted into a hole defined by the notches opposing each other.

Another aspect of the present invention provides a vacuum pump for exhausting a gas, comprising a main shaft rotatably supported by a bearing, a motor for rotating the main shaft, and a rotary vane attached to the main shaft, in which the rotary vane has a cylindrical portion fitted with the main shaft and has a blade portion fixed to an outer surface of the cylindrical portion, and in which an axial length of the cylindrical portion is larger than that of the blade portion.

In one preferred aspect of the present invention, the blade portion has a spiral blade extending rearward with respect to a rotation direction, and a disk-shaped base to which the spiral blade is fixed, and, on the outer surface of the cylindrical portion, a length from an upper surface of the base to an upper end of the cylindrical portion and a length from a lower surface of the base to a lower end of the cylindrical portion are each not less than 0.5 times of a thickness of the base.

In one preferred aspect of the present invention, the blade portion has a disk-shaped base fixed to an outer surface of the cylindrical portion, and a plurality of radial blades fixed to an outer surface of the base, and, on the outer surface of the cylindrical portion, a length from an upper surface of the base to an upper end of the cylindrical portion and a length from a lower surface of the base to a lower end of the cylindrical portion are each not less than 0.5 times of a thickness of the base.

In one preferred aspect of the present invention, the blade portion has a spiral blade extending rearward with respect to a rotation direction, and a disk-shaped base to which the spiral blade is fixed, and, an axial length of the spiral blade is continuously reduced in a radially outward direction.

In one preferred aspect of the present invention, the blade portion has a spiral blade extending rearward with respect to a rotation direction, and a disk-shaped base to which the spiral blade is fixed, and, an axial length of the base is continuously reduced in a radially outward direction.

In one preferred aspect of the present invention, the blade portion has a spiral blade extending rearward with respect to a rotation direction, and a disk-shaped base to which the spiral blade is fixed, and, a connection portion of the spiral blade and the base is formed with a fillet.

In this case, preferably the cross section of the fillet is formed to be larger on a rearward side of a tip of the spiral blade with respect to the rotation direction.

Another aspect of the present invention provides a vacuum pump for exhausting a gas, comprising a main shaft rotatably supported by a bearing, a motor for rotating the main shaft, and first and second rotary vanes attached to the main shaft, in which the first rotary vane has a cylindrical portion fitted with the main shaft and has a blade portion fixed to an outer surface of the cylindrical portion, an axial length of the cylindrical portion is larger than that of the blade portion, and the blade portion has a blade extending rearward with respect to a rotation direction, in which the second rotary vane has a cylindrical portion fitted with the main shaft and has a disk portion fixed to an outer surface of the cylindrical portion, and an axial length of the cylindrical portion is larger than that of the disk portion, and in which the first rotary vane is located on an intake side while the second rotary vane is located on an exhaust side, and the second rotary vane has a diameter larger than that of the first rotary vane.

Another aspect of the present invention provides a vacuum pump for exhausting a gas, comprising a multiple stage of centrifugal drag vanes where each centrifugal drag vane has a plurality of spiral blades, and a multiple stage of fixed vanes where each fixed vane has a plurality of spiral guides, in which a height of the spiral blades of one of the centrifugal drag vanes on an upstream side is equal to or larger than a height of the spiral blades of another of the centrifugal drag vanes on a downstream side, and in which a height of the spiral guides of one of the fixed vanes on an upstream side is equal to or larger than a height of the spiral guides of another of the fixed vanes on a downstream side.

In one preferred aspect of the present invention, an angle between one of the spiral blades of the centrifugal drag vanes and a tangent to a virtual circle disposed coaxially with the centrifugal drag vanes is set such that the angle on an upstream side of the spiral blades of the centrifugal drag vanes is equal to or larger than that on a downstream side of the spiral blades of the centrifugal drag vanes.

In one preferred aspect of the present invention, a height of the spiral blades is gradually reduced in a radially outward direction.

In one preferred aspect of the present invention, a ratio of an entrance height to an exit height of the spiral blades of the centrifugal drag vanes is set such that the ratio on an upstream side of the spiral blades of the centrifugal drag vanes is equal to or smaller than that on a downstream side of the spiral blades of the centrifugal drag vanes.

Still another aspect of the present invention provides a semiconductor manufacturing apparatus comprising any one of the above vacuum pumps, and a process chamber for processing a substrate, in which the vacuum pump and the process chamber are connected directly or indirectly.

The present invention can provide a compact vacuum pump with high exhaust performance capable of evacuating in pressure ranges from atmospheric pressure to a high vacuum. The invention can also provide a vacuum pump with high reliability and durability capable of operating stably for an extended period of time even in the case of exhausting a corrosive gas.

BRIEF DESCRIPTION OF THE DRAWINGS

FIG. 2(*b*) is a sectional view of the centrifugal drag vane shown in FIG. 2(*a*).

FIG. 2(*c*) is a sectional view taken along the line II-II shown in FIG. 2(*a*).

FIG. 6(*b*) is a front view of the vortex flow vane shown in FIG. 5.

FIG. 10 is a table for describing the relations between the cross section of an exhaust flow passage and a variety of parameters.

FIG. 11(*b*) is a reference drawing showing an example of the turbine vanes described in the table of FIG. 10.

FIG. 11(*c*) is a reference drawing showing an example of the turbine vanes described in the table of FIG. 10.

FIG. 12(*b*) is a reference drawing showing an example of the centrifugal drag vane described in the table of FIG. 10.

FIG. 13(*b*) is a reference drawing showing an example of the vortex flow vanes described in the table of FIG. 10.

FIG. 25(*b*) is a sectional view taken along the line XXV-XXV of FIG. 23.

FIG. 33(*b*) is a sectional view of the centrifugal drag vane shown in FIG. 32.

FIG. 34(*b*) is a sectional view of the fixed vane shown in FIG. 32.

DETAILED DESCRIPTION OF THE REFERRED EMBODIMENTS

Figure 1:
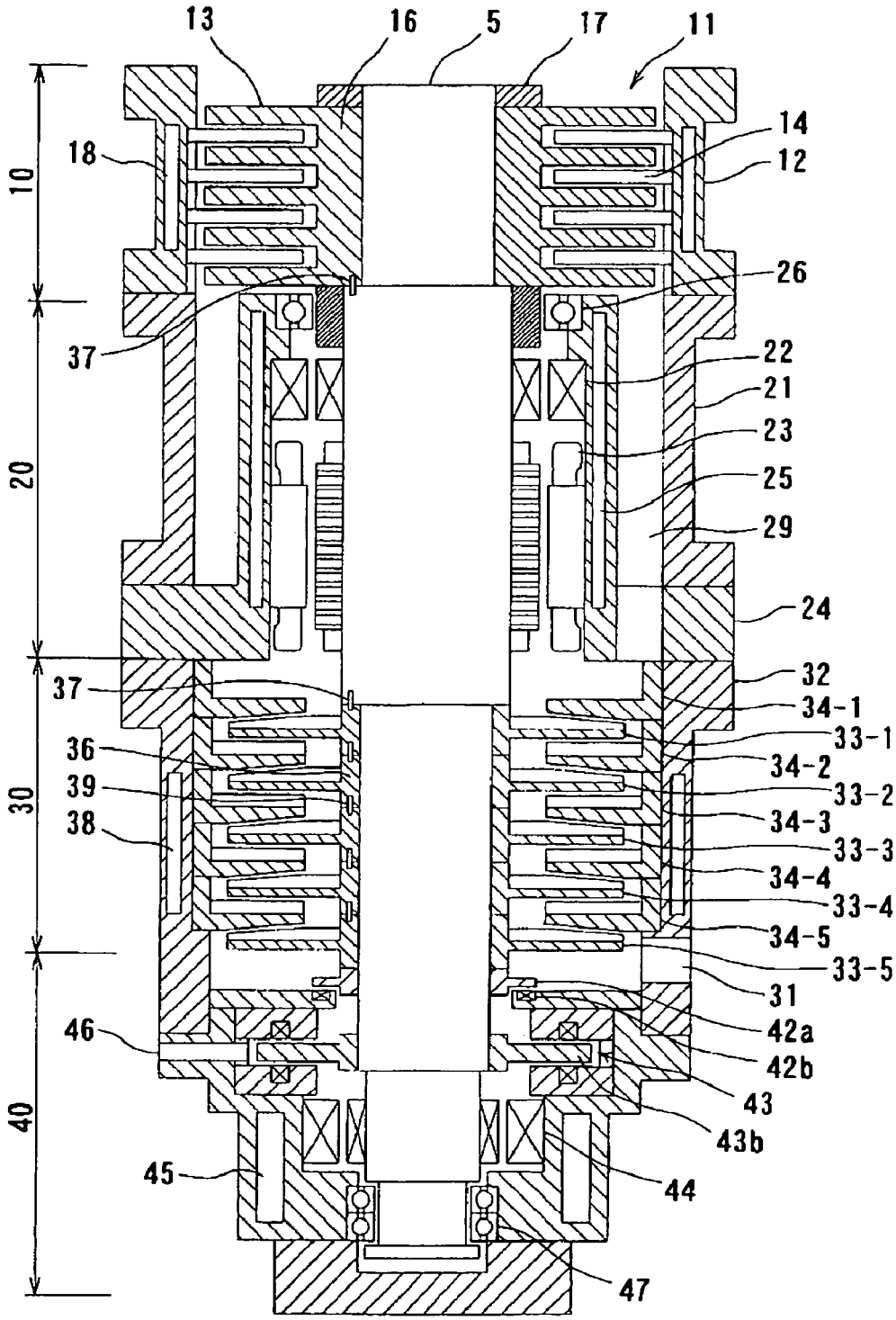
FIG. 1 is a sectional view of a vacuum pump according to a first embodiment of the present invention.
Figure 2A:
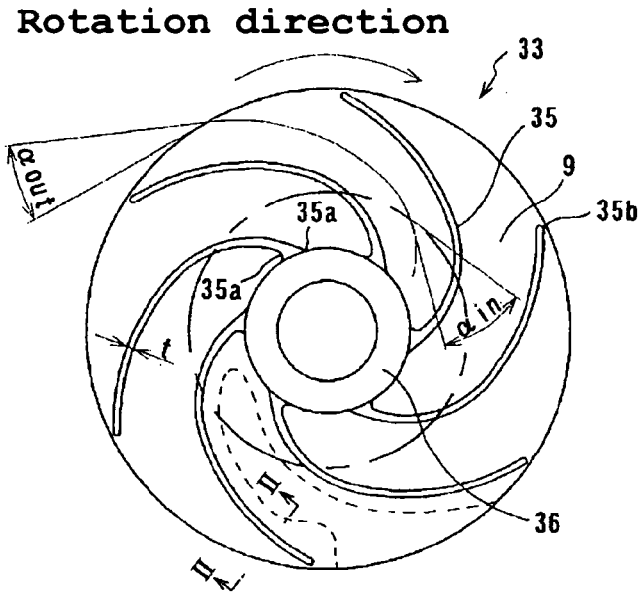
FIG. 2(*a*) is a plan view of a centrifugal drag vane shown in FIG. 1.
Figure 2B:
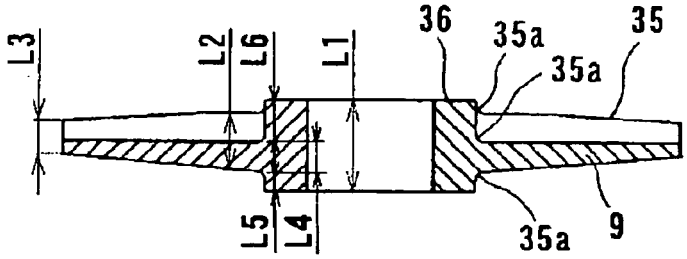
Figure 2C:
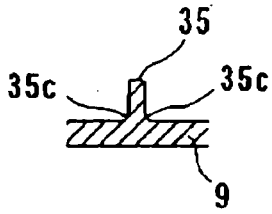

Some embodiments of the present invention are described below with reference to the drawings. FIG. 1 is a sectional view of a vacuum pump according to a first embodiment of the present invention. The upper and lower directions used in the following description with respect to the vacuum pump and a part thereof means the upper and lower directions, respectively, shown in FIG. 1 and similar or corresponding drawings. FIG. 2(*a*) is a plan view of a centrifugal drag vane shown in FIG. 1, FIG. 2(*b*) is a sectional view of the centrifugal drag vane shown in FIG. 2(*a*), and FIG. 2(*c*) is a sectional view taken along the line II-II shown in FIG. 2(*a*).

As shown in FIG. 1, the vacuum pump comprises a turbo molecular pump element 10 as a first exhaust section, an upper housing unit 20 housing an upper radial magnetic bearing 22 as a first bearing, a centrifugal drag pump element 30 as a second exhaust section, and a lower housing unit 40 housing a lower radial magnetic bearing 44 as a second bearing and an axial magnetic bearing 43 as a third bearing. The vacuum pump also comprises a main shaft 5 rotatably supported by the upper radial magnetic bearing 22, the lower radial magnetic bearing 44, and the axial magnetic bearing 43. The main shaft 5 extends through the entire vacuum pump, and one end of the main shaft 5 is located in the vicinity of an intake port 11. The turbo molecular pump element 10, the upper housing unit 20, the centrifugal drag pump element 30, and the lower housing unit 40 are serially arranged in this order from an end on the suction side of the main shaft 5 therealong.

In general, a vacuum pump capable of evacuating from an atmospheric pressure to a high vacuum is composed of several pump elements. This is due to the fact that it is extremely difficult to evacuate efficiently with a single pump element from an atmospheric pressure to a high vacuum. The vacuum pump of the present embodiment is composed of two pump elements operable in different pressure ranges. That is, the turbo molecular pump element 10 capable of evacuating efficiently in a high vacuum range and the centrifugal drag pump element 30 demonstrating fine exhaust performance in a low vacuum range are used as the first exhaust section and the second exhaust section, respectively.

The turbo molecular pump element (turbo molecular pump section) 10 includes an upper casing (first casing) 12 having an intake port 11, and plural stages of turbine vanes (first rotary vanes) 13 located in the upper casing 12. The turbine vanes 13 are located in the vicinity of the intake port 11, and are fixed to the outer periphery of the main shaft 5. A plurality of fixed vanes (first fixed vanes) 14 are fixed to the inner periphery of the upper casing 12, and are each interposed between the stages of the turbine vanes 13. The turbine vanes 13 and the fixed vanes 14 are axial-flow vanes having plural fins arranged along the circumferential direction, and the fins of the turbine vanes 13 and the fixed vanes 14 are inclined generally in the opposite directions to each other.

The centrifugal drag pump element (centrifugal drag pump section) 30 includes a lower casing (second casing) 32 having an exhaust port 31, a plurality of centrifugal drag vanes (second rotary vanes) 33-1 to -5 located in the lower casing 32, and a plurality of fixed vanes (second fixed vanes) 34-1 to -5 fixed to the inner periphery of the lower casing 32. The centrifugal drag vanes 33-1 to -5 are fixed to the outer periphery of the main shaft 5, and the fixed vanes 34-1 to -5 and the centrifugal drag vanes 33-1 to -5 are arranged alternately. As shown in FIG. 2(*a*) and FIG. 2(*b*), the centrifugal drag vanes 33-1 to -5 (hereinafter referred to as centrifugal drag vane 33, as appropriate) have spiral blades 35 extending rearward with respect to the rotation direction, and a disk-shaped base 9 to which the spiral blades 35 are fixed. The spiral blades 35 and the base 9 constitute a blade portion. The surfaces of each of the centrifugal drag vanes 33, on which the spiral blades 35 are formed, faces the surface of the fixed vanes 34-1 to -5 (hereinafter referred to as fixed vane 34, as appropriate) at intervals of several tens to several hundreds of micrometers. A gas is exhausted through the interaction of the centrifugal drag vanes 33 and the fixed vanes 34, that is, centrifugal action applied to the gas and drag action due to viscosity of the gas.

In view of reducing the internal stress arising from the rotation to avoid stress concentration and of improving the exhaust performance, the centrifugal drag vanes 33 attached to the main shaft have a shape as follows.

(1) The inner periphery of the centrifugal drag vanes 33 is formed with a cylindrical portion (boss) 36, which has a small diameter to fit with the main shaft 5. The axial length L1 of the cylindrical portion 36 is larger than the axial length L2 of the blade portion (the spiral blades 35 and the base 9) (see FIG. 2(*b*)).

(2) The spiral blades 35 are integrally connected to the outer surface of the cylindrical portion 36. The connection portions of the cylindrical portion 36 and the spiral blades 35 are formed with a fillet 35*a* (see FIG. 2(*a*) and FIG. 2(*b*)). On the outer surface of the cylindrical portion 36, the length L5 from the lower surface of the base 9 to the lower end of the cylindrical portion 36 and the length L6 from the upper surface of the base 9 to the upper end of the cylindrical portion 36 are set not less than 0.5 times of the thickness (axial length) L4 of the base 9.

(3) The axial length of the spiral blade 35 becomes successively smaller toward the radially outer side. The axial length of the disk-shaped base 9 to which the spiral blades 35 are fixed becomes successively smaller toward the radially outer side. Thus, the axial length L3 of the blade portion on the radially outer side is smaller than the length L2 thereof on the inner side (see FIG. 2(*b*)).

(4) The thickness t of the spiral blade 35 is configured to become successively smaller toward the radially outer side (see FIG. 2(*a*)). It is desirable that the thickness t is as small as possible, preferably in the range of 0.5 to 2 mm at the tip of the spiral blade 35.

(5) A curved surface portion 35*b* is formed at the tip of the spiral blade 35 (see FIG. 2(*a*)). The tip of the spiral blade 35 is located slightly on the radially inner side of the peripheral edge of the base 9. This allows the curved surface portion 35*b* to be formed throughout the tip of the spiral blade 35.

(6) The connection portions of the spiral blades 35 and the base 9 are formed with a fillet 35*c* having an arcuate section (see FIG. 2(*c*)). The broken line of FIG. 2(*a*) indicates a boundary between the fillets 35*c* and the base 9. The size of the arc of the fillet 35*c* need not be uniform, and may be changed depending on the locations. For example, it is preferable that the arc (section) of the fillet 35*c* is larger on the rearward side of the tip of the spiral blade 35 with respect to the rotation direction, as shown in FIG. 2(*a*).

(7) An angle α between the spiral blade 35 and a circle tangent is set smaller toward the radially outer side (see FIG. 2(*a*)). Specifically, it is preferable that a in is between 20° and 50° on the radially inner side of the spiral blade 35 and that a out is between 5° and 30° on the radially outer side thereof. A circle tangent herein refers to a tangent to a circle arranged coaxially with the centrifugal drag vane 33.

(8) A curve formed by the spiral blade 35 is defined by a spiral curve (such as an Archimedean spiral represented with polar coordinates as $r=a\theta$, or a logarithmic spiral represented as $r=a^{\theta}$), an involute curve, or a variation of these curves (see FIG. 2(*a*)).

The above features (1), (2), (3), (4), (5) and (6) allow stress reduction and avoiding stress concentration in the centrifugal drag vanes (rotary vanes) 33. The above features (3), (6), (7) and (8) contribute to improving the exhaust performance. In the present embodiment, the spiral blades 35 are formed on the centrifugal drag vanes (rotary vanes) 33 and the fixed vanes 34. However, the centrifugal drag vanes may have flat surfaces and spiral blades may be formed on surfaces of the fixed vanes facing the surfaces of the centrifugal drag vanes.

Figure 3:
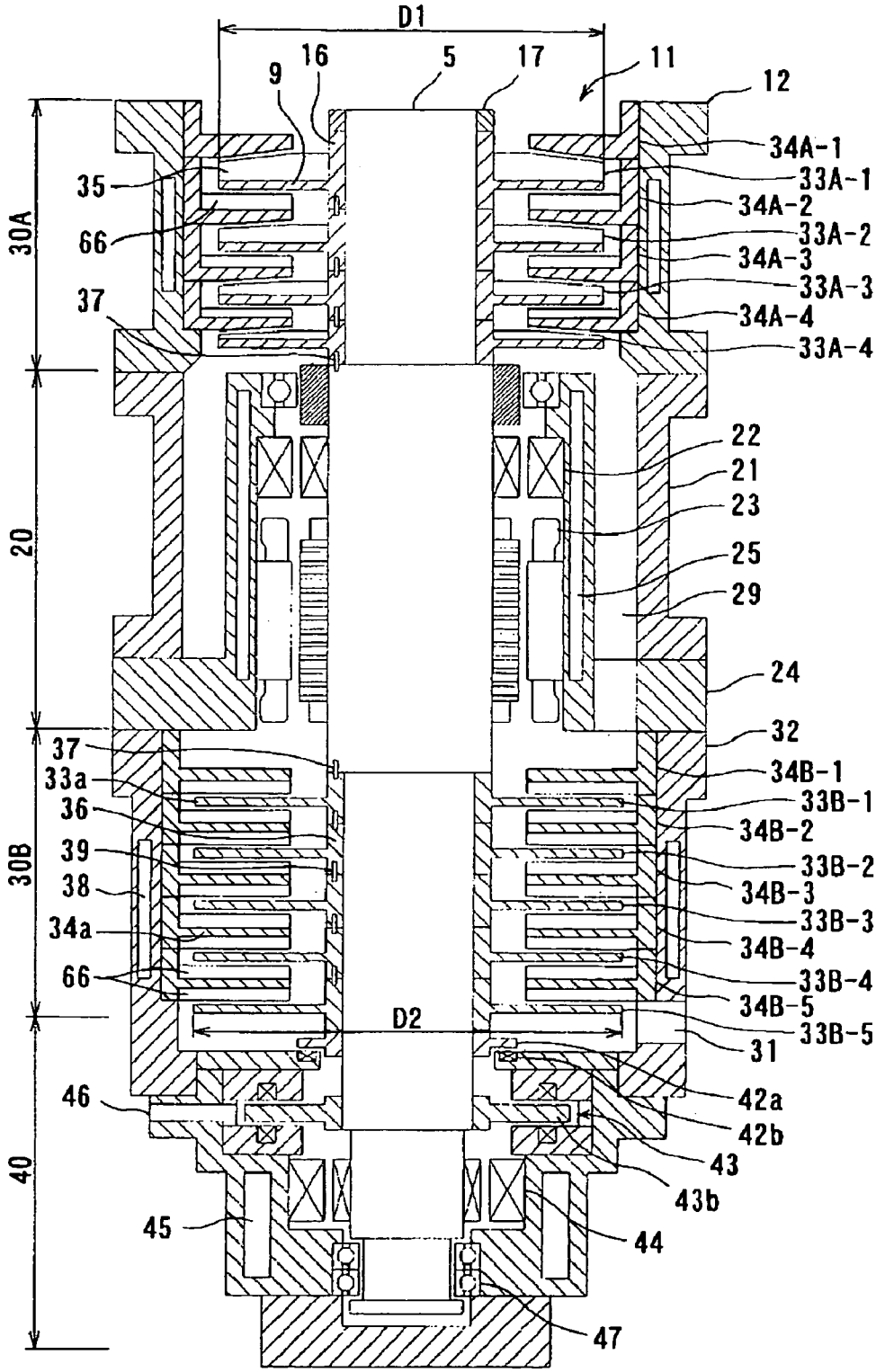
FIG. 3 is a sectional view of another configuration example of the vacuum pump according to the first embodiment of the present invention.

FIG. 3 is a sectional view of another configuration example of the vacuum pump according to the first embodiment of the present invention. In the vacuum pump shown in FIG. 3, a first exhaust section 30A and a second exhaust section 30B are both constituted of a centrifugal drag pump element. The first exhaust section 30A includes centrifugal drag vanes (first rotary vanes) 33A-1 to -4 each having spiral blades 35, and fixed vanes 34A-1 to -4 each having spiral guides 66. The inner periphery of the centrifugal drag vanes 33A-1 to -4 is formed with a cylindrical portion 16 fitted with the main shaft 5. The second exhaust section 30B includes centrifugal drag vanes (second rotary vanes) 33B-1 to -5 with no spiral blades, and fixed vanes 34B-1 to -5 each having spiral guides 66 formed on both sides of a fixed disk 34*a*. The centrifugal drag vanes 33B-1 to -5 include a cylindrical portion 36 fitted with the main shaft 5, and a disk portion 33*a* formed integrally with the outer surface of the cylindrical portion 36. The diameter D2 of the centrifugal drag vanes 33B-1 to -5 is not less than the diameter D1 of the centrifugal drag vanes 33A-1 to -4 (D1≦D2).

The vacuum pump shown in FIG. 3 has an optimal configuration for a centrifugal drag pump element including multiple stages of rotary vanes and fixed vanes. That is, in the centrifugal drag pump element, evacuation is made through centrifugal action applied to the gas and drag action due to viscosity of the gas, as described previously. Forming grooves (dents formed between the spiral blades) on the rotary vanes allows effective use of the centrifugal action, and thus improves the exhaust performance compared to forming grooves on the fixed vanes. In particular, in moderate and high vacuum ranges in the order of $10^1$ Pa or less, where drag action due to viscosity of the gas is not significantly effective, it is important to form spiral blades, or grooves, on rotary vanes. On the other hand, in a low vacuum range in the order of $10^2$ Pa or more, where drag action due to viscosity of the gas is dominant, forming grooves on fixed vanes does not cause reduction in exhaust performance.

In FIG. 3, the disk-shaped centrifugal drag vanes 33B-1 to -5 with no spiral blades are subject to a lower stress due to centrifugal action, compared to the centrifugal drag vanes 33A-1 to -4 having spiral blades. Therefore, the centrifugal drag vanes 33B-1 to -5 with a larger diameter can rotate at the same rotational speed as the centrifugal drag vanes 33A-1 to -4. Thus, the second exhaust section 30B can have a longer exhaust flow passage compared to the first exhaust section 30A. In the second exhaust section 30B, the area increases, where the relative speed of the centrifugal drag vanes 33B-1 to -5 to that of the fixed vanes 34B-1 to -5 is large, thereby improving the exhaust performance.

For the above reasons, in the first exhaust section 30A located on the suction side, the centrifugal drag vanes 33A-1 to -4 having spiral blades are used to compress the gas effectively in the pressure range from below $10^1$ Pa to $10^2$ Pa. In the second exhaust section 30B located on the exhaust side, the disk-shaped centrifugal drag vanes 33B-1 to -5 with a larger diameter are used to compress the gas in the pressure range of not less than $10^2$ Pa. With this configuration, a vacuum pump with a high exhaust efficiency can be obtained.

Referring now to FIG. 1, attaching the two pump elements composed of the turbine vanes 13 and the centrifugal drag vanes 33 to the main shaft 5 makes the axial length of the pump rotor (rotary section composed of the turbine vanes 13, the centrifugal drag vanes 33 and the main shaft 5) longer, and makes it difficult for the pump rotor to rotate at a high speed. In view of this, the vacuum pump of the present embodiment is provided with the upper radial magnetic bearing 22 and a motor 23 interposed between the turbine vanes 13 and the centrifugal drag vanes 33, and with the axial magnetic bearing 43 and the lower radial magnetic bearing 44 located on the axial end side (downstream side) of the centrifugal drag vane 33-5 as the last stage, in order to improve the vibration characteristics of the main shaft 5 and constitute a pump rotor suitable for high-speed rotation. The main shaft 5 is configured to have a largest diameter at the portion where the upper radial magnetic bearing 22 and the motor 23 are located.

With the above configuration, the center of gravity of the pump rotor in axial direction is located near the motor 23 where the diameter of the main shaft 5 is largest, and the upper and lower radial magnetic bearings 22 and 44 are disposed on both sides of the center of gravity, thereby constituting an inboard pump rotor, which has fine vibration characteristics. Since the main shaft 5 is configured to have a largest diameter at the position of the center of gravity and have a smaller diameter toward its axial ends, the distribution of flexural rigidity of the main shaft 5 becomes appropriate and the natural frequency in bending of the pump rotor can be increased, allowing the pump rotor to rotate at a high speed.

Since the upper radial magnetic bearing 22 supporting the overhanging turbine vanes 13 is mounted to the main shaft 5 at the portion where the diameter is largest, the area of the pole face of the electromagnet can be larger, increasing the bearing stiffness as well as producing a large damping force. Thus, an excitation force acting on the pump rotor due to the overhanging portion (turbine vanes 13) can be effectively suppressed by the upper radial magnetic bearing 22. Since the motor 23 is mounted to the main shaft 5 at the portion where the diameter is largest in the same manner as the upper radial magnetic bearing 22, the area of the polar face of the rotor of the motor (motor rotor) fixed to the main shaft 5 can be larger, shortening the axial length of the motor 23 without reducing the output of the motor 23. As a result, the entire axial length of the main shaft 5 can be shortened, and the natural frequency in bending of the pump rotor can be set higher.

Figure 4:
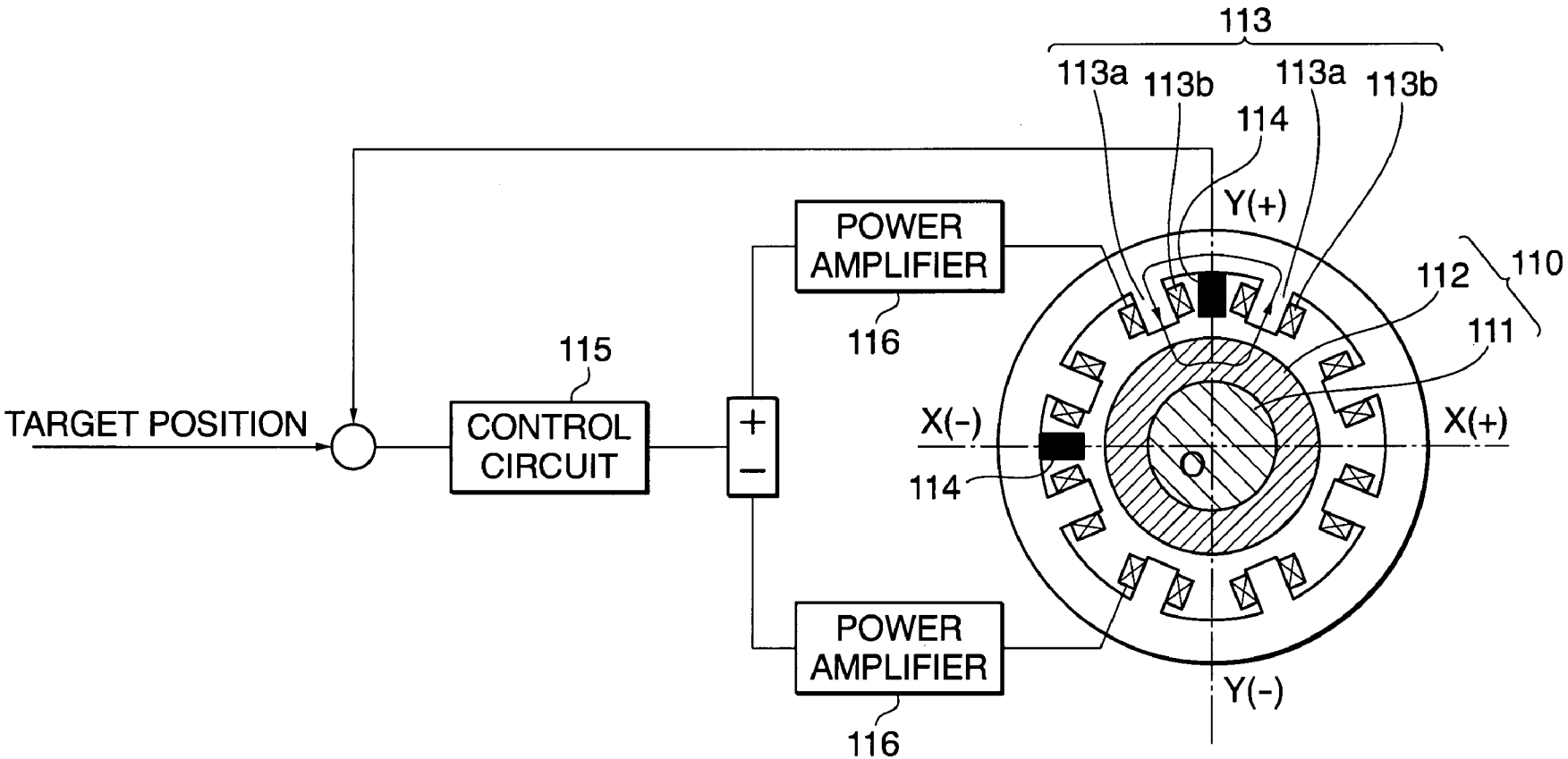
FIG. 4 is a schematic diagram showing a general configuration of a radial magnetic bearing.

The configuration and action of a magnetic bearing is now briefly described. FIG. 4 is a schematic diagram showing a configuration of a radial magnetic bearing. A rotor 110 as a rotating body is composed of a rotating shaft 111 and a magnetic body 112 attached to the outer periphery of the rotating shaft 111. Electromagnets 113 and position sensors 114 are disposed around the outer periphery of the magnetic body 112 with predetermined gaps. A single electromagnet 113 is composed of a pair of two adjacent projections 113*a* of the core and coils 113*b* attached to the respective projections 113*a*. As shown in FIG. 4, the four electromagnets 113 are arranged circumferentially at intervals of approximately 90 degrees. The position sensors 114 are each positioned in an X direction and a Y direction from the sectional center of the rotor 110. The position sensors 114 detect the radial positions of the rotor 110, a control circuit 115 generates control signals based on the deviation between the detected positions and the target position, and a power amplifier 116 supplies an electric current according to the control signals to the coils 113*b* of the electromagnets 113. Thus, electromagnetic forces generated by the opposing electromagnets 113 are controlled by push-pull operation, acting the electromagnetic forces on the rotor 110. The rotor 110 is rotatably supported through the electromagnetic forces in a predetermined position in a non-contact manner.

While the foregoing example describes the configuration of a radial magnetic bearing, the configuration of an axial magnetic bearing is as follows. The rotor is provided with a disk, and the stator is provided with two electromagnets to interpose the disk between the electromagnets. Additionally, The stator is provided with an axial displacement sensor for detecting the axial displacement of the disk. The operation of the axial magnetic bearing is generally the same as that of the radial magnetic bearing. With the foregoing magnetic bearings, the rotation loss can be minimized, which allows the rotor to rotate at a high speed, and a lubricant such as oil can be dispensed with, which attains an oil-free and maintenance-free configuration. Thus, magnetic bearings are suitable for a vacuum pump.

In FIG. 1, if any of the upper and lower radial magnetic bearings 22 and 44 and the axial magnetic bearing 43 happens to be unable to operate normally for a reason, the pump rotor is supported by an upper touchdown bearing 26 and a lower touchdown bearing 47, which prevent contact between the stator side elements such as the fixed vanes 14 and 34 and the pump rotor. The upper touchdown bearing 26 is located immediately above the upper radial magnetic bearing 22 while the lower touchdown bearing 47 is located at the lower end of the main shaft 5, so that the bearing span (distance between the upper touchdown bearing 26 and the lower touchdown bearing 47) is long. This allows the tilt angle of the pump rotor at the touchdown to be reduced, preventing the rotating turbine vanes 13 and the centrifugal drag vanes 33 from coming in contact with the fixed vanes 14 and 34. Thus, the gaps between the turbine vanes 13 and the fixed vanes 14 and those between the centrifugal drag vanes 33 and the fixed-vanes 34 can be set small.

Both of the turbine vanes 13 and the centrifugal drag vanes 33, which rotate at a high speed together with the main shaft 5, are configured to be fixed to the outer periphery of the main shaft 5, and the inner peripheries of the turbine vanes 13 and the centrifugal drag vanes 33 fixed to the main shaft 5 are formed with cylindrical portions (bosses) 16 and 36, having a small diameter, respectively. This allows centrifugal stresses produced by the weight of the turbine vanes 13 and the centrifugal drag vanes 33 during high-speed rotation to be effectively reduced by the cylindrical portions 16 and 36, thereby constituting a turbine vanes 13 and centrifugal drag vanes 33 suitable for high-speed rotation.

The cylindrical portions 16 and 36 of the turbine vanes 13 and the centrifugal drag vanes 33, respectively, are each provided with a pin (positioning member) 37 in their axial contact surfaces with the main shaft 5. This prevents radial imbalance of the pump rotor when mounting/removing the turbine vanes 13 and the centrifugal drag vanes 33 to/from the main shaft 5. That is, it is possible to prevent changes in the balance of the pump rotor by fixing the relative positions of each of the turbine vanes 13, the centrifugal drag vanes 33 and the rotation shaft 5 in the rotation direction by means of the pins 37.

The centrifugal drag pump element 30 is configured such that the centrifugal drag vanes 33-1 to -5 and the fixed vanes 34-1 to -5 are placed alternately in order when mounting the centrifugal drag vanes 33-1 to -5 to the main shaft 5. Thus, pins (positioning members) 39 are provided between any adjacent centrifugal drag vanes 33-1 to -5 for phasing, to prevent imbalance of the pump rotor in disassembling and assembling the pump. Thus, the relative positions of the centrifugal drag vanes 33-1 to -5 in the rotation direction are kept constant at all times, preventing imbalance of the pump rotor.

In order to minimize the amount of imbalance of the pump rotor, it is desirable to provide two or more pins 37 and 39 symmetrically or at regular intervals around the main shaft 5. Incidentally, with the above configuration, each of the fixed vanes 34-1 to -5 interposed between the centrifugal drag vanes 33-1 to -5 can be assembled as a unit without being divided into plural parts. With the present embodiment, it is possible to avoid the problem that the gas leaks out through the dividing surface of the fixed vanes, which may occur if the fixed vanes are divided into plural parts, thereby obtaining a vacuum pump with a high exhaust efficiency.

Balance correction work for the vacuum pump of the present embodiment is next described.

The pump rotor of the present embodiment rotates at a high speed, and thus balance correction work for the pump rotor is essential. The balance correction work is first performed with a balancer or the like while members to be fixed to the main shaft 5 such as the turbine vanes 13 and the centrifugal drag vanes 33-1 to -5 are all assembled to the main shaft 5. Then, the pump rotor is once disassembled, the centrifugal drag vanes 33-1 to -5 and the fixed vanes 34-1 to -5 are alternately placed around the main shaft 5, and the entire vacuum pump is assembled. At this time, as described previously, the centrifugal drag vanes 33-1 to -5 are phased by means of the pins 39, which secures reproducibility of the balance. Finally, more accurate balance correction is performed while the pump rotor is rotating at a high speed with the vacuum pump fully assembled, if necessary.

Balance correction work for a pump assembled is performed by cutting the outer peripheries of a balance ring 17 and an axial disk 43*b* provided on the axial ends of the main shaft 5. This is because cutting the turbine vanes 13 and the centrifugal drag vanes 33-1 to -5 would be difficult. For example, the turbine vanes 13 are normally made of a high-strength aluminum alloy, to the surface of which an anti-corrosion treatment (various coating treatments such as Ni plating) is applied for the purpose of adding corrosion resistance to the process gas and the like. Therefore, cutting the turbine vanes 13 means removing the coating film at the same time, which leads to impairing the corrosion resistance. Since the centrifugal drag vanes 33-1 to -5 are placed alternately with the fixed vanes 34-1 to -5, the centrifugal drag vanes 33-1 to -5 are difficult to be cut with the vacuum pump assembled, while cutting itself is difficult in the case that the centrifugal drag vanes 33-1 to -5 are made of ceramics.

For the above reasons, it is preferable that the outer peripheries of the balance ring 17 and the axial disk 43*b* are the portions to be cut for balance correction. The balance ring 17 can be cut by making of an anti-corrosion material. The axial disk 43*b* is made of a ferromagnetic material (such as soft magnetic iron or permalloy) and is thus inferior in corrosion resistance. However, the axial disk 43*b* can be cut for the reasons that the axial disk 43*b* is not exposed to the exhaust gas, that the axial disk 43*b* is in such a position as to be protected from a gas such as process gas owing to purge gas introduction, which is described later, and the like. The cutting work of the axial disk 43*b* is performed by inserting a drill or the like into an observation hole 46 formed around the outer periphery of the axial disk 43*b*.

The operation of the pump of the present embodiment is next described with reference to FIG. 1.

In the vicinity of the uppermost stage of the turbine vanes 13 is provided with the intake port 11, which has generally the same diameter as the outer diameter of the turbine vanes 13 and through which a gas to be exhausted is suctioned. Then, in the turbo molecular pump element (first exhaust section) 10, the turbine vanes 13 rotate at a high speed such that the peripheral speed of the outer periphery of the turbine vanes 13 is about 400 m/s (about 75 thousand revolutions per minute ($min^{-1}$) in the case of a turbine vanes 13 with a diameter of 100 mm, for example), to compress the gas effectively in a high vacuum range (molecular flow range). To be specific, the gas is compressed from the order of $10^{-7}$ to $10^{0}$ Pa, to the order of $10^{1}$ Pa in terms of the intake port pressure.

The gas compressed in the turbo molecular pump element (first exhaust section) 10 passes through a flow passage 29 formed between the outer peripheral surface of an upper housing 24 and the inner peripheral surface of a cylindrical casing 21, and is introduced into the centrifugal drag pump element (second exhaust section) 30. The flow passage 29 is located adjacent to the outer periphery of the last stage of the turbine vanes 13, extending axially toward the downstream side. In the turbo molecular pump element 10, the gas is compressed and exhausted mostly in the outer portion of the turbine vanes 13, and thus the gas can be introduced from the outer periphery of the turbine vanes 13 into the centrifugal drag pump element 30 through the flow passage 29 without disturbing the gas flow, thereby increasing the conductance (reducing the resistance to exhaust gas).

The gas introduced into the centrifugal drag pump element 30 is compressed to around atmospheric pressure (in the order of $10^{5}$ Pa) through the interaction of the plural centrifugal drag vanes 33-1 to -5 and fixed vanes 34. The centrifugal drag vanes 33 are fixed to the outer peripheral surface of the main shaft 5 to rotate at a high speed in the same manner as the turbine vanes 13. The gas introduced into the centrifugal drag pump element 30 is first compressed as it is transferred from the inner side of the centrifugal drag vane 33-1 to the outer side thereof. The gas transferred to the outer side returns to the inner side along the fixed vane 34-2, and is compressed again at the centrifugal drag vane 33-2 as the next stage. In this manner, the gas is compressed as it is transferred repetitiously from the inner side to the outer side, and then from the outer side to the inner side, through the centrifugal drag vanes 33-1 to -5 constituted as plural stages, thereby attaining an extremely high compression ratio.

In the pump of the present embodiment, the gas generates heat of compression and heat of agitation as the gas is successively compressed, when the motor 23 drives the main shaft 5 to rotate, which in turn causes the turbine vanes 13 and the centrifugal drag vanes 33-1 to -5 fixed to the outer periphery of the main shaft 5 to rotate. Since the amount of generated heat is larger as the compression ratio is higher, the turbo molecular pump element 10, which operates in a high vacuum range, and the centrifugal drag pump element 30 experience a considerable rise in temperature. The motor 23, which generates a rotation force, also generates heat due to the loss. In addition, in the upper radial magnetic bearing 22, the axial magnetic bearing 43 and the lower radial magnetic bearing 44 (hereinafter referred to as magnetic bearing 22, 43 and 44, as appropriate), a temperature rise on the rotor side due to the eddy-current loss and a temperature rise on the stator side due to the increase in the electric current to the coils at the time of imbalance of the pump rotor may occur.

When the main shaft 5 is not supported by the magnetic bearings 22, 43 and 44, the pump rotor is supported by the upper touchdown bearing 26 and the lower touchdown bearing 47 (hereinafter referred to as touchdown bearing 26 and 47, as appropriate). If the pump rotor rotating at a high speed is supported by the touchdown bearings 26 and 47, heat is generated by friction between the pump rotor and the inner rings of the touchdown bearings 26 and 47, or between the inner or outer rings and the rolling elements. When the touchdown bearings 26 and 47 are at an extremely high temperature, reducing spaces inside the touchdown bearings 26 and 47 may cause deterioration of or damage to the touchdown bearings 26 and 47. Therefore, cooling jackets 18 and 38 are provided to the outer periphery of the turbo molecular pump element 10 (upper casing 12) and the outer periphery of the centrifugal drag pump element 30 (lower casing 32), respectively, in order to cool the above-described heated portions for the prevention of an excessive temperature rise. Likewise, the outer peripheral side of the upper touchdown bearing 26, the upper radial magnetic bearing 22 and the motor 23 (upper housing 24) is provided with a cooling jacket 25, while the outer side of the axial magnetic bearing 43, the lower radial magnetic bearing 44 and the lower touchdown bearing 47 is provided with a cooling jacket 45.

The reason for cooling the magnetic bearings 22, 43 and 44 and the motor 23 is as follows. On the stator side of the motor 23 and the magnetic bearings 22, 43 and 44 are provided with coils made up of copper wires, which are generally resined for the purpose of protecting the coils from a corrosive process gas as well as of enhancing insulation and heat transferability of the coils. Since the coils and the resin are low in heat resistance, they need be cooled to be kept at an appropriate temperature.

In the centrifugal drag pump element 30, the heat generated at the centrifugal drag vanes 33 and the fixed vanes 34 is cooled by means of the cooling jacket 38 formed in the lower casing 32. However, the temperature of the pump rotor (including the centrifugal drag vanes 33 and the main shaft 5) remains higher compared to the temperature of the pump stator (including the lower casing 32 and the fixed vanes 34). This causes larger thermal expansion of the pump rotor, compared to the pump stator, and thus causes the gaps between the centrifugal drag vanes 33 and the fixed vanes 34 to change during operation. Therefore, not only the pumping performance is unstable, also the centrifugal drag vanes 33 and the fixed vanes 34 may even come in contact with each other in the worst case. As a measure for such problems, the above-described gaps may be set larger to prevent the centrifugal drag vanes 33 and the fixed vanes 34 from coming in contact with each other. This will reduce the pumping performance, which is unfavorable.

In view of the above, the present embodiment adopts a configuration as follows. A sensor target 42*a* and an axial displacement sensor 42*b* are provided immediately below the centrifugal drag vane 33-5 as the last stage. The axial displacement sensor 42*b* detects the amount of axial displacement of the pump rotor, and the axial position of the pump rotor is kept to be constant based on the detected amount of displacement by means of the axial magnetic bearing 43 through feedback control or the like. This allows the measurement point of the axial displacement sensor 42*b* to be established as an axial reference position of the pump rotor even when the pump rotor is subject to thermal expansion. Thus, since the main shaft 5 and the centrifugal drag vanes 33 expand axially with this measurement point as the starting point, the amount of axial displacement of the centrifugal drag vanes 33 can be suppressed to a subtle degree and the axial gaps between the centrifugal drag vanes 33 and the fixed vanes 34 can be maintained generally constant during operation. This contributes to improving the pumping performance as well as stabilizing the operation of the vacuum pump. In addition, the above-mentioned gaps can be set smaller (in the order of several micrometers to several hundreds of micrometers), thereby obtaining a vacuum pump with an improved exhaust efficiency. An improved exhaust efficiency yields increased pumping performance for each stage of the centrifugal drag pump element 30, which allows the number of stages of the centrifugal drag vanes 33 to be reduced. Reducing the number of stages of the centrifugal drag vanes 33 allows the axial length of the main shaft 5 to be shortened, and thus allows the vacuum pump to operate at a high speed and to be compact easily.

Preferably, a material with a low linear expansion coefficient (material with a linear expansion coefficient of about 0.5 to $5\times10^{-6}$/K) is used for the main shaft 5 and the centrifugal drag vanes 33. The use of a material with a low linear expansion coefficient allows the amounts of elongation of the main shaft 5 and the centrifugal drag vanes 33 due to thermal expansion to be suppressed. Examples of such a material include Invar and Ni-resist cast iron as an Fe—Ni alloy and ceramics (such as SiC and SiN). Ceramics, which are excellent in heat resistance and lightweight, and has high specific strength, are highly suitable as a material for the centrifugal drag vanes 33. In producing ceramic centrifugal drag vanes 33, the profile (vane shape) of each stage of the centrifugal drag vanes 33 is preferably uniform as long as tolerated in terms of performance. This allows mass production of the centrifugal drag vanes 33 by sintering, and cost reduction.

A material with a low linear expansion coefficient may be used not only for the pump rotor but also for the pump stator. With this configuration, changes in dimension of the members due to changes in temperature can be minimized in the case that the flow passage need be kept at a high temperature for the prevention of deposition of products contained in the process gas in the flow passage. Additionally, the axial gaps between the turbine vanes 13 and the fixed vanes 14 of the turbo molecular pump element 10 can be minimized, thereby improving the exhaust performance.

Figure 5:
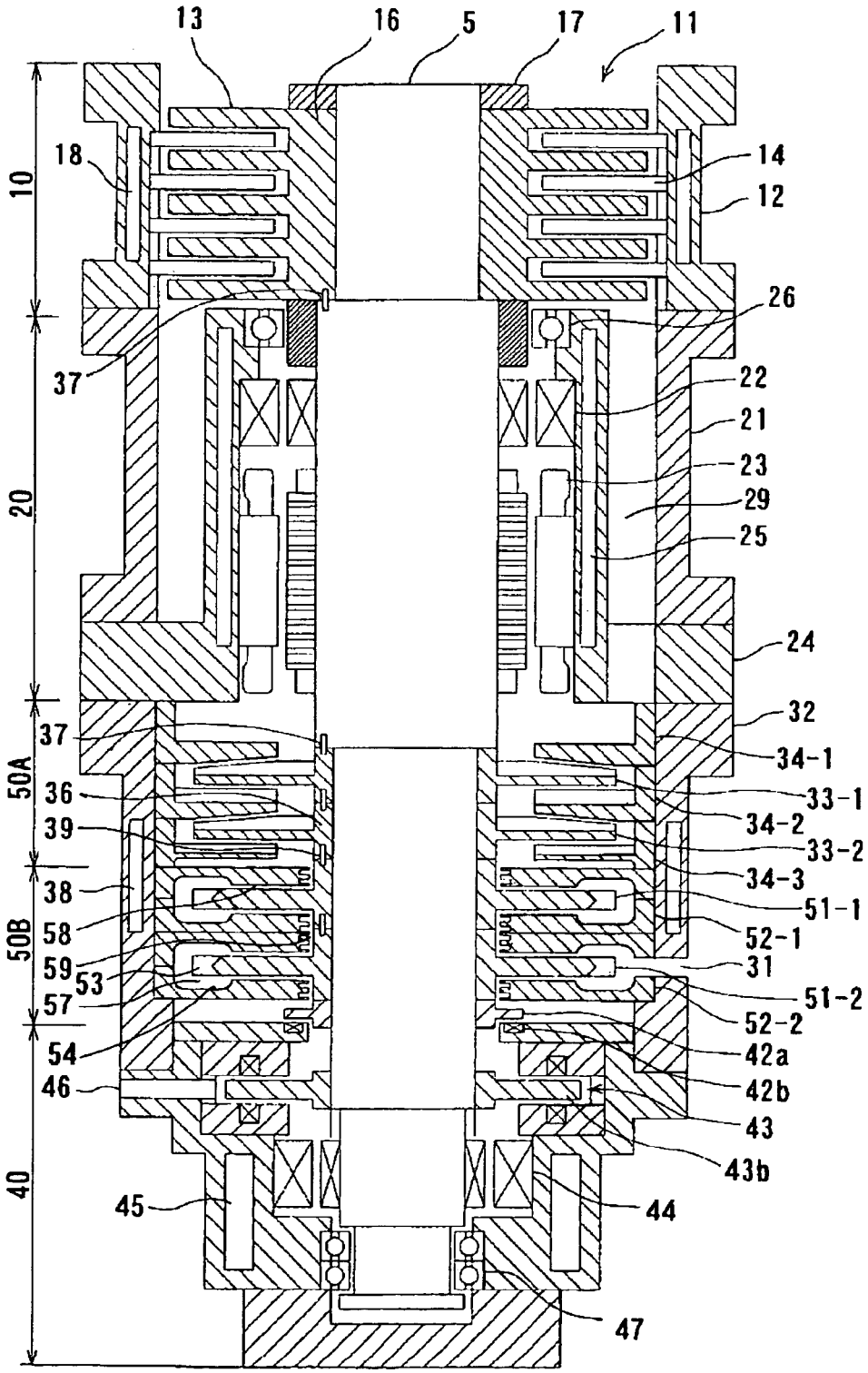
FIG. 5 is a sectional view of a vacuum pump according to a second embodiment of the present invention.

A vacuum pump according to a second embodiment of the present invention is next described with reference to FIG. 5. FIG. 5 is a sectional view of a vacuum pump according to the second embodiment of the present invention. The difference between the second embodiment and the first embodiment shown in FIG. 1 lies in the configuration of the second exhaust section of the vacuum pump. The configuration and operation of the second embodiment are not particularly described as they are the same as those of the foregoing first embodiment, and the overlapped description is omitted. The configuration of the second exhaust section of the present embodiment is described below.

As shown in FIG. 5, the second exhaust section of the present embodiment is constituted of a centrifugal drag pump element 50A and a vortex flow pump element (vortex flow pump section) 50B arranged serially, for the purpose of obtaining a higher compression ratio. That is, centrifugal drag vanes 33-1 to -2 constituting two stages and vortex flow vanes (rotary vanes) 51-1 to -2 (hereinafter referred to as vortex flow vanes 51, as appropriate) constituting two stages are arranged serially along and fixed to the main shaft 5. In the centrifugal drag pump element 50A, fixed vanes 34-1 to -2 and the centrifugal drag vanes 33-1 to -2 are arranged alternately. In the same manner, in the vortex flow pump element 50B, vortex chamber spacers 52-1 to -2 (hereinafter referred to as vortex chamber spacer 52, as appropriate) and the vortex flow vanes 51-1 to -2 are arranged alternately.

Figure 6A:
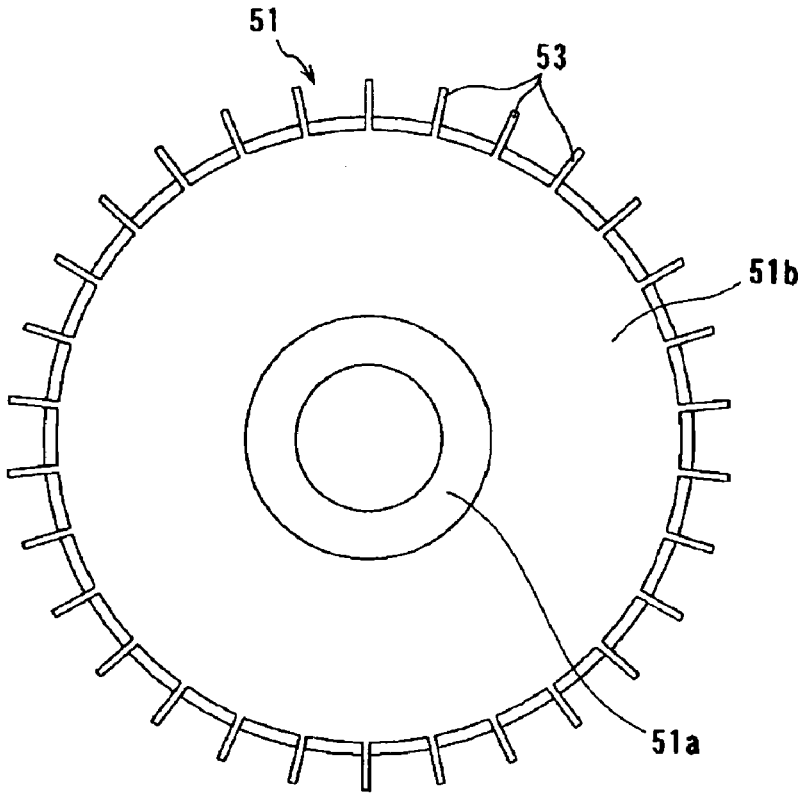
FIG. 6(*a*) is a plan view of a vortex flow vane shown in FIG. 5.
Figure 6B:
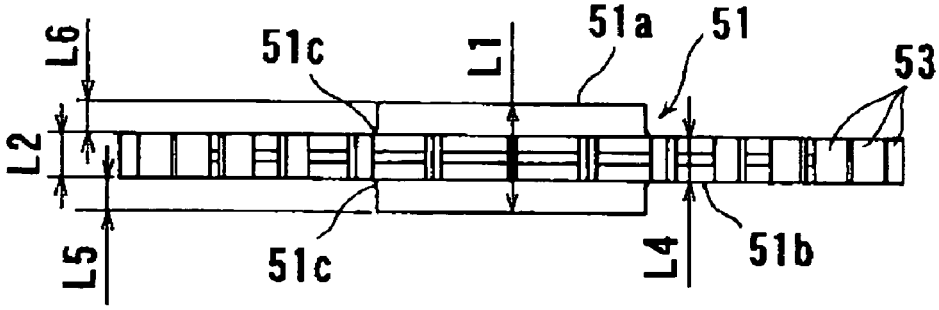
Figure 7:
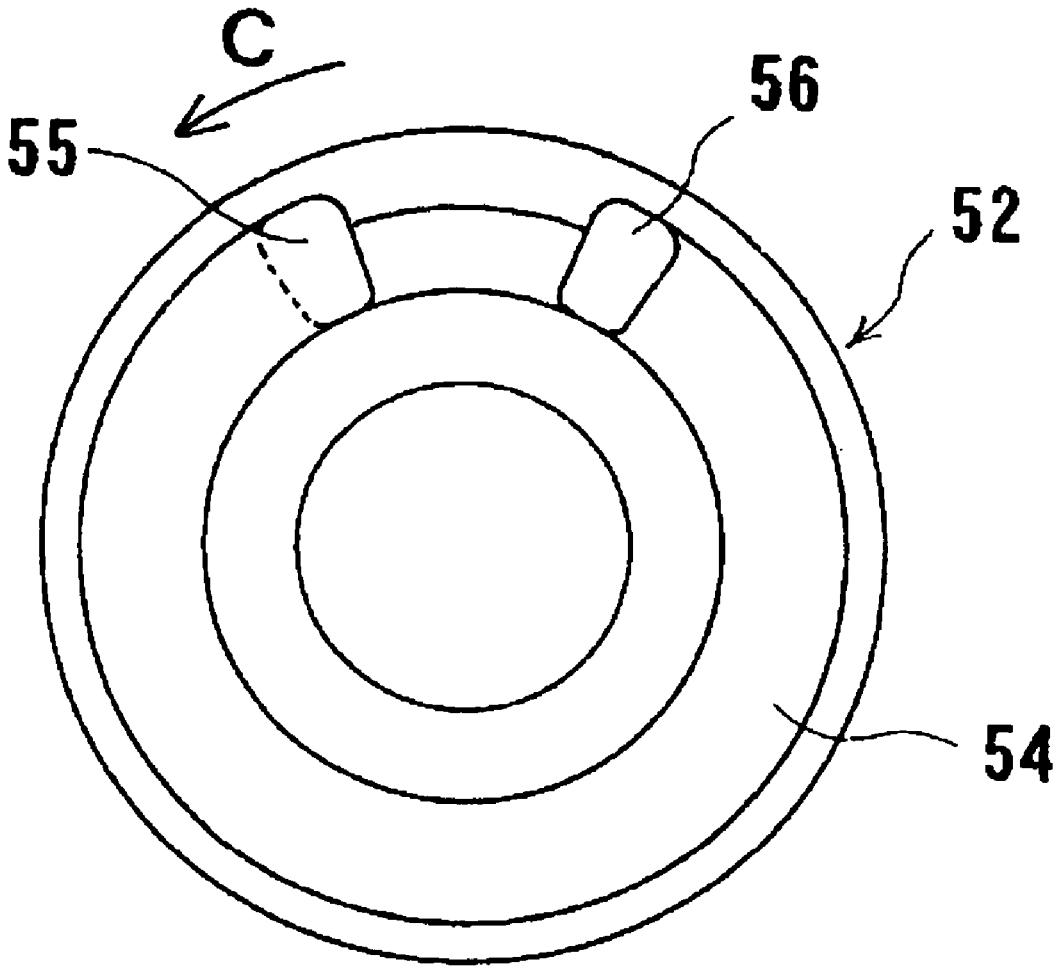
FIG. 7 is a plan view of a vortex chamber spacer shown in FIG. 5.
Figure 8:
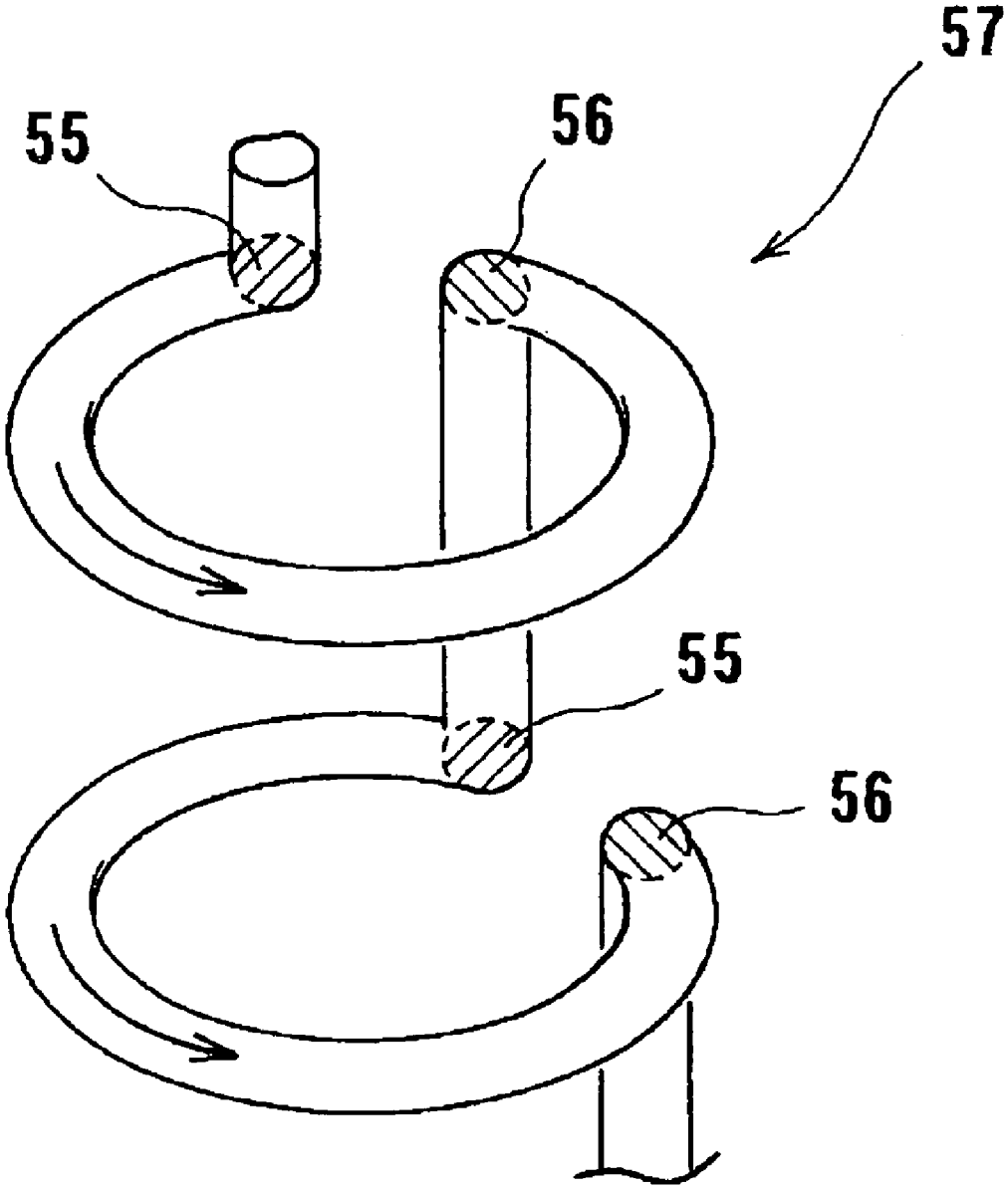
FIG. 8 is a diagrammatic view of an exhaust flow passage shown in FIG. 5.

FIG. 6(*a*) is a plan view of the vortex flow vane shown in FIG. 5, and FIG. 6(*b*) is a front view of the vortex flow vane shown in FIG. 5. FIG. 7 is a plan view of the vortex chamber spacer shown in FIG. 5. FIG. 8 is a diagrammatic view of an exhaust flow passage shown in FIG. 5. As shown in FIG. 6(*a*) and FIG. 6(*b*), the outer periphery of the vortex flow vanes 51 is formed with a plurality of radial blades 53 extending radially. In more detail, the vortex flow vanes 51 have a cylindrical portion (boss) 51*a* with a small diameter and fitted with the main shaft 5, and a blade portion (disk-shaped base 51*b* and radial blades 53). The axial length L1 of the cylindrical portion 51*a* is larger than the axial length L2 of the blade portion (base 51*b* and radial blades 53). On the outer peripheral surface of the cylindrical portion 51*a*, the length L5 from the lower surface of the base 51*b* to the lower end of the cylindrical portion 51*a* and the length L6 from the upper surface of the base 51*b* to the upper end of the cylindrical portion 51*a* are set not less than 0.5 times the thickness (axial length) L4 of the base 51*b*. This allows the stress arising from the rotation to be reduced in the vortex flow vanes 51. The connection portions of the cylindrical portion 51*a* and the base 51*b* are formed with a fillet 51*c*. As shown in FIG. 7, the vortex chamber spacer (fixed vane) 52 has a flow passage groove (vortex chamber) 54 extending circumferentially, which is provided with a gas inlet port 55 at one end and a gas outlet port 56 at another end. The arrow C in FIG. 7 designates the rotation direction of the vortex flow vanes 51 (not shown FIG. 7). As shown in FIG. 5, an exhaust flow passage 57 is formed between the radial blade 53 and the flow passage groove 54.

When the vortex flow vanes 51 rotate, a gas, which has flown in from the gas inlet port 55 flows in a vortical manner, is compressed as it is transferred toward the gas outlet port 56, and is discharged from the gas outlet port 56. Since the vortex flow pump element 50B of the present embodiment has a multi-stage configuration with the vortex flow vanes 51-1 to -2 constituting two stages arranged serially, the gas inlet port 55 and the gas outlet port 56 are connected between the stages (see FIG. 8), and the gas outlet port 56 of the vortex chamber spacer 52-2 as the last stage communicates with the exhaust port 31. The vortex flow vanes 51 of the present embodiment are configured to generate vortex flows on both sides thereof, that is, shaped as a double-sided vane. However, it is also possible to adopt a single-sided vane generating a vortex flow only on one side, or to adopt a vortex flow vane shaped so as to generate vortex flows on the outer and inner sides thereof.

In the vortex flow pump element 50B, the exhaust flow passage 57 is formed in a spiral manner as shown in FIG. 8, and has a minute axial gap 58 and a minute radial gap 59 between the vortex flow vanes 51 and the vortex chamber spacer 52 (see FIG. 5). Preferably, the gaps 58 and 59 are as small as possible for the prevention of a backflow of the gas.

From this point of view, a sensor target 42*a* and an axial displacement sensor 42*b* are provided immediately below the centrifugal drag vane 51-2 as the last stage. This allows the measurement point of the axial displacement sensor 42*b* to be established as an axial reference position of the pump rotor. Therefore, when the pump rotor is subject to thermal expansion, the main shaft 5 and the centrifugal drag vanes 51 expand axially with this measurement point as the starting point. Thus, the amount of axial displacement of the vortex flow vanes 51 can be suppressed through the axial magnetic bearing 43 to a subtle degree. As a result, the axial gap 58 between the vortex flow vanes 51 and the vortex chamber spacer 52 can be maintained generally constant during operation. Therefore, the pumping performance can be improved as well as stabilized. The gap 58 can be set as small as possible (in the order of several micrometers to several hundreds of micrometers) at the design stage, thereby obtaining a vacuum pump with an improved exhaust efficiency.

Preferably, a material with a low linear expansion coefficient (with a linear expansion coefficient of about 0.5 to $5\times10^{-6}$/K) is used for the main shaft 5 and the vortex flow vanes 51. This allows the amounts of elongation of the main shaft 5 and the vortex flow vanes 51 due to thermal expansion to be further suppressed. Examples of such a material include Invar and Ni-resist cast iron as an Fe—Ni alloy and ceramics (such as SiC and SiN). In particular, ceramics, which are excellent in heat resistance and lightweight, and has high specific strength, are highly suitable as a material for the vortex flow vanes 51. In order to seal the minute radial gap 59, a labyrinth seal mechanism is provided on the inner surface of the vortex chamber spacer 52 for the prevention of a backflow of the gas. With this configuration, the sealing performance between the stages of the vortex flow vanes 51 can be improved, and, as a result, a vortex flow pump element with a high compression ratio can be obtained.

A material with a low linear expansion coefficient can be used not only for the pump rotor but also for the pump stator including the vortex chamber spacers. For example, changes in dimension of the vortex chamber spacers 52 (exhaust flow passage 57) due to changes in temperature can be reduced in the case that the exhaust flow passage 57 need be kept at a high temperature for the prevention of deposition of products in the exhaust flow passage 57. Additionally, the axial gaps between the pump rotor side and the pump stator side of the first exhaust section (turbo molecular pump element 10) can be minimized, thereby improving the exhaust performance.

Figure 9:
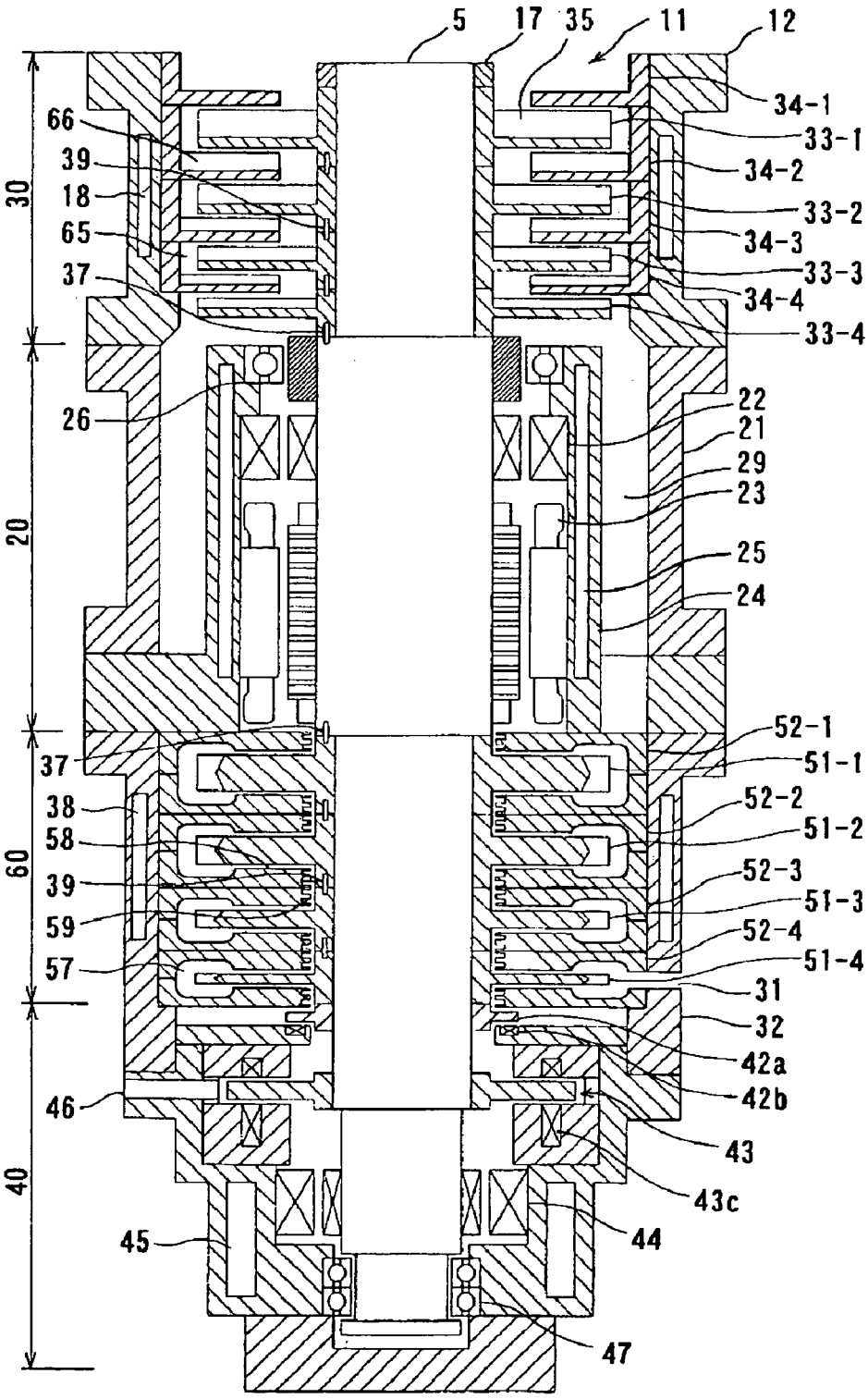
FIG. 9 is a sectional view of a vacuum pump according to a third embodiment of the present invention.

FIG. 9 is a sectional view of a vacuum pump according to a third embodiment of the present invention. The major difference of the present embodiment from the first embodiment is that a centrifugal drag pump element is provided as the first exhaust section while a vortex flow pump element is provided as the second exhaust section. The identical components to those in FIG. 1 or FIG. 5 are given the same reference numerals and symbols, and the overlapped description is omitted.

The vacuum pump of the present embodiment comprises a centrifugal drag pump element 30 as the first exhaust section, and a vortex flow pump element 60 as the second exhaust section. With this configuration, a vacuum pump operable effectively from atmospheric pressure to a moderate vacuum range (in the order of $10^{-1}$ Pa) can be obtained. The centrifugal drag pump element 30 has a four-stage configuration with centrifugal drag vanes 33-1 to -4 and fixed vanes 34-1 to -4. The heights of spiral blades 35 of the centrifugal drag vanes 33 and the heights of spiral guides 66 of the fixed vanes 34 become sequentially smaller from the upstream side toward the downstream side. The vortex flow pump element 60 has a four-stage configuration with vortex flow vanes 51-1 to -4 and vortex chamber spacers 52-1 to -4. The thicknesses of the vortex flow vanes 51-1 to -4 and the vortex chamber spacers 52-1 to -4 become sequentially smaller from the upstream side toward the downstream side. Owing to this, in the centrifugal drag pump element 30 and the vortex flow pump element 60, exhaust flow passages 65 and 57, respectively, are configured to have a sequentially smaller section from the upstream side (intake side) toward the downstream side (exhaust side), and a gas can be exhausted and compressed efficiently.

As shown in FIG. 9, the axial magnetic bearing 43 is configured such that the lower electromagnet 43*c* is large for a large downward electromagnetic force. This is because the pump rotor is subject to an upward force calculated by the area of the rotary vane multiplied by the difference in pressure between at the intake port and at the exhaust port (about 800N in the case of a rotary vane with a diameter of 100 mm, for example) when the pressure at the exhaust port 31 is almost atmospheric pressure during the operation of the pump. In this case, it is preferable that the cooling jacket 45 is located as close to the electromagnet 43*c* as possible, since a large electric current passes through the electromagnet 43*c* during the operation of the vacuum pump.

Figure 11A:
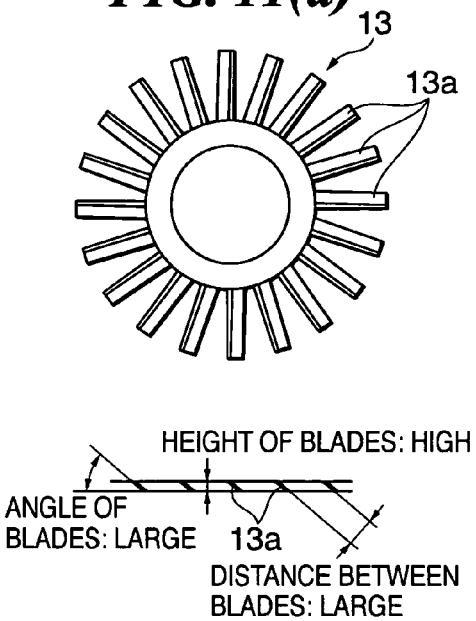
FIG. 11(*a*) is a reference drawing showing an example of the turbine vanes described in the table of FIG. 10.
Figure 11B:
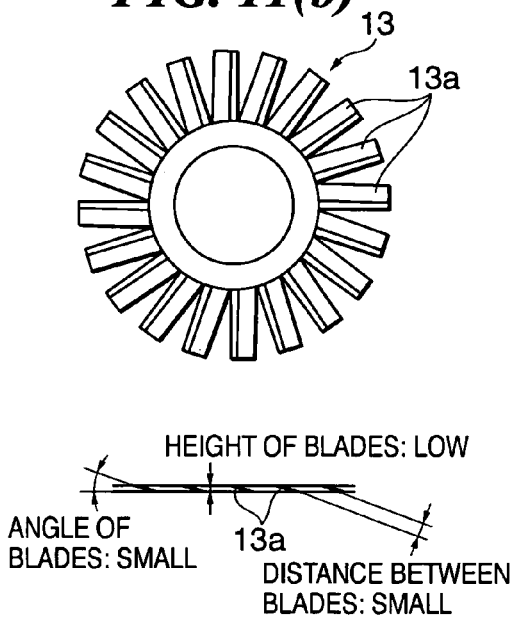
Figure 11C:
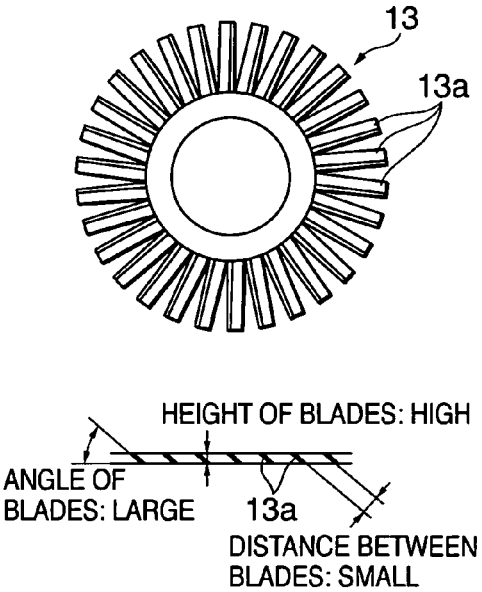
Figure 12A:
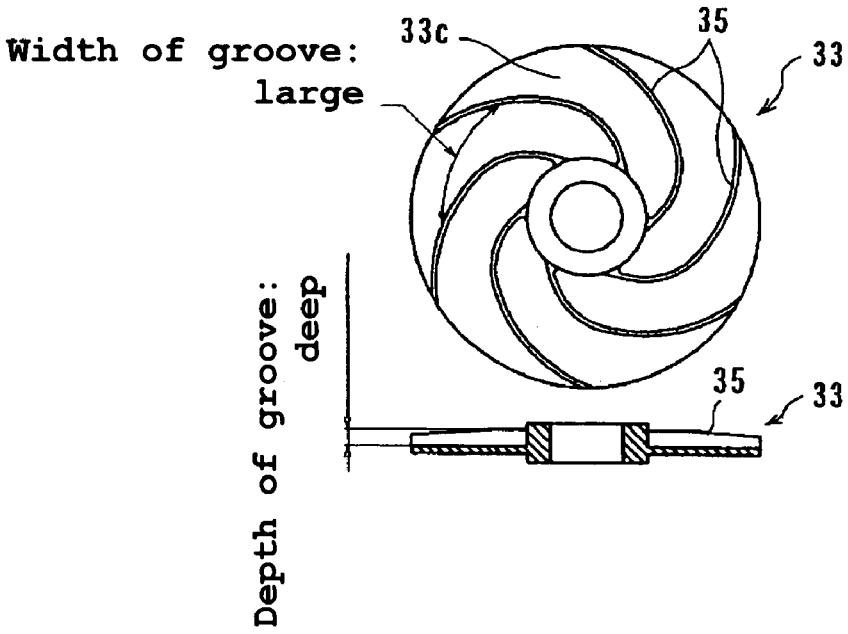
FIG. 12(*a*) is a reference drawing showing an example of the centrifugal drag vane described in the table of FIG. 10.
Figure 12B:
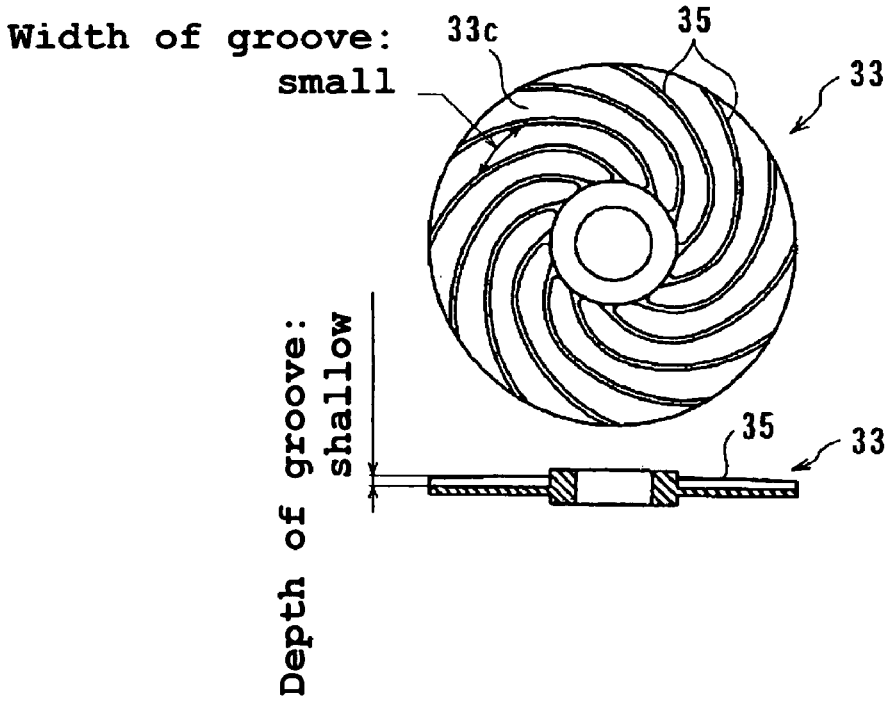
Figure 13A:
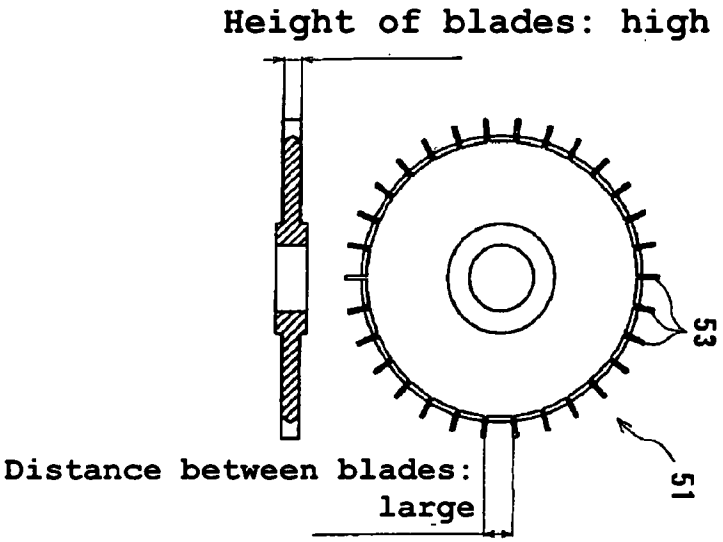
FIG. 13(*a*) is a reference drawing showing an example of the vortex flow vanes described in the table of FIG. 10.
Figure 13B:
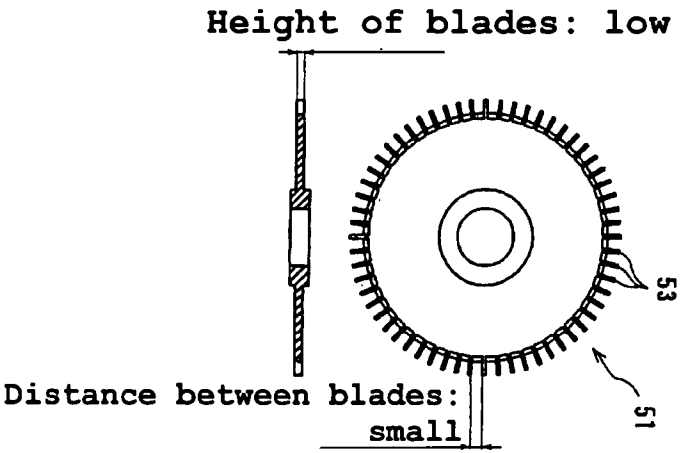

The cross section of an exhaust flow passage can be increased/decreased in a variety of manners depending on the type of a pump element. FIG. 10 is a table for describing the relations between the cross section of an exhaust flow passage and a variety of parameters. FIG. 11(*a*) through FIG. 11(*c*) are reference drawings showing an example of the turbine vanes described in the table of FIG. 10. FIG. 12(*a*) and FIG. 12(*b*) are reference drawings showing an example of the centrifugal drag vane described in the table of FIG. 10. FIG. 13(*a*) and FIG. 13(*b*) are reference drawings showing an example of the vortex flow vanes described in the table of FIG. 10.

In relation to the turbine vanes 13 (see FIG. 11(*a*) through FIG. 11(*c*)), parameters for increasing/decreasing the cross section of an exhaust flow passage include the number and the height of blades 13*a*. As shown in FIG. 11(*b*) and FIG. 11(*c*), as the height of the blades 13*a* decreases and/or the number of the blades 13*a* increases, the dimension of a space between the blades 13*a* becomes smaller and thus the cross section of the exhaust flow passage can be decreased. As shown in FIG. 11(*a*) and FIG. 11(*b*), reducing the height of the blades 13*a* results in decreasing the angle of the blades 13*a*.

In relation to the centrifugal drag vane 33 (see FIG. 12(*a*) and FIG. 12(*b*)), parameters for increasing/decreasing the cross section of an exhaust flow passage include the number and the depth of grooves 33*c* (spiral blades 35). The grooves 33*c* refer to dents formed between spiral blades 35. As the number of the grooves 33*c* (spiral blades 35) increases (the width of the grooves reduces) and/or the depth of the grooves 33*c* decreases (the height of the spiral blades 35 reduces), the cross section of the exhaust flow passage can be decreased.

In relation to the vortex flow vanes 51 (see FIG. 13(*a*) and FIG. 13(*b*)), parameters for increasing/decreasing the cross section of an exhaust flow passage include the number and the height of radial blades 53. As the number of the radial blades 53 increases and/or the height of the radial blades 53 decreases, the dimension of a space between the radial blades 53 becomes smaller and thus the cross section of the exhaust flow passage can be decreased. As described above, in a vacuum pump adopting any type of rotary vanes, it is possible to compress and exhaust a gas efficiently, in an optimal operating pressure range of the rotary vanes, by decreasing the cross section of an exhaust flow passage from high vacuum side toward low vacuum side. These configurations for rotary vanes may be used in any embodiment.

Figure 14:
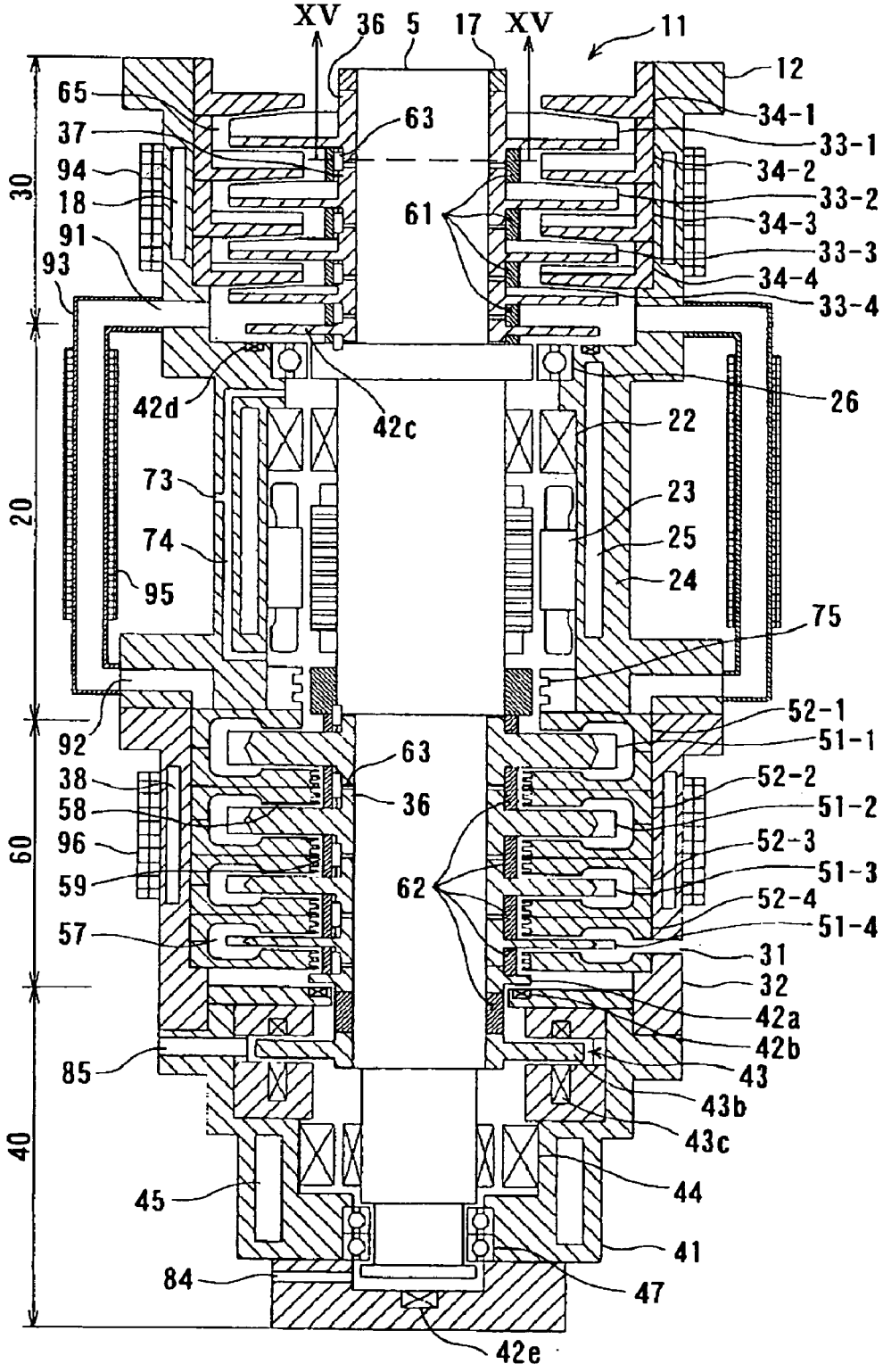
FIG. 14 is a sectional view of a vacuum pump according to a fourth embodiment of the present invention.
Figure 15:
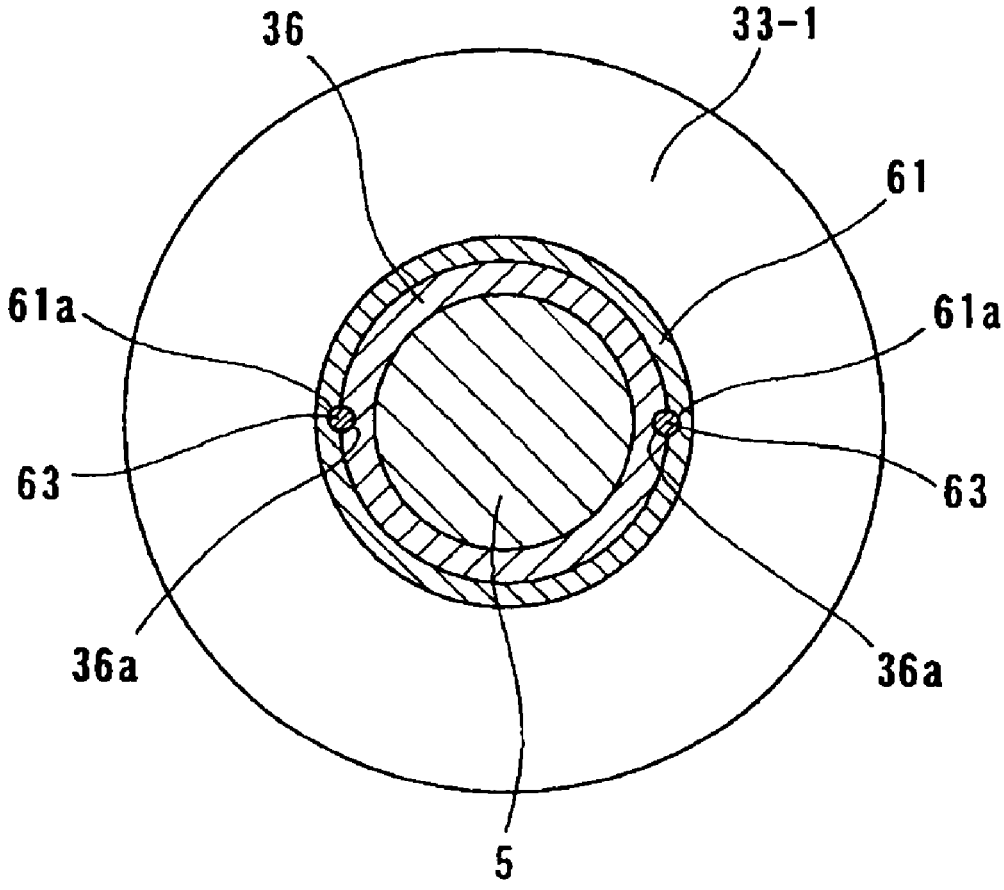
FIG. 15 is a sectional view taken along the line XV-XV of FIG. 14.

FIG. 14 is a sectional view of a vacuum pump according to a fourth embodiment of the present invention. FIG. 15 is a sectional view taken along the line XV-XV of FIG. 14. The vacuum pump according to the present embodiment is suitably used to exhaust a process gas containing products. The configuration and operation of the present embodiment are not particularly described as they are similar to those of the foregoing third embodiment, and the overlapped description is omitted.

In the vacuum pump shown in FIG. 14, an intermediate exhaust port 91 is provided in the vicinity of the centrifugal drag vane 33-4 as the last stage of the centrifugal drag pump element (first exhaust section) 30, while an intermediate intake port 92 is provided in the vicinity of the vortex flow vane 51-1 as the first stage of the vortex flow pump element (second exhaust section) 60. The intermediate exhaust port 91 and the intermediate intake port 92 are connected by an exhaust pipe 93. A gas exhausted from the first exhaust section 30 passes through the exhaust pipe 93 to the vortex flow pump element 60. Heaters 94, 95 and 96 for heating flow passages of the gas are attached to the outer periphery of the upper casing 12 of the centrifugal drag pump element 30, the outer periphery of the exhaust pipe 93, and the outer periphery of the lower casing 32 of the vortex flow pump element 60, respectively.

The vacuum pump of the present embodiment with the above configuration can start operating with the flow passages of the gas sufficiently heated in advance by the respective heaters 94, 95 and 96. After starting operation, the centrifugal drag pump element 30 and the vortex flow pump element 60 generate heat by heat of compression and heat of agitation of the gas to be exhausted. Therefore, the amount of heat produced by the heaters 94, 95 and 96 are adjusted by means of unillustrated temperature detection means each provided in the vicinity of the centrifugal drag pump element 30 and the vortex flow pump element 60, thereby controlling such that the flow passages of the gas can be maintained at a predetermined temperature.

When the action of gas compression in the centrifugal drag pump element 30 and the vortex flow pump element 60 is large, the amount of heat produced by the heat of compression and heat of agitation of the gas becomes too large to maintain the predetermined temperature only by adjusting the amounts of heat produced by the heaters 94 and 96. In this case, adjusting the flow rate and the temperature of a cooling medium for the cooling jackets 18 and 38 allows the temperatures of the exhaust flow passages 65 and 57 to be maintained at the predetermined temperature. With the above configuration, the temperatures of the exhaust flow passages 65 and 57 of the vacuum pump are raised to the predetermined temperature at all times during operation, preventing deposition of products contained in the gas in the exhaust flow passages 65 and 57. Thus, it is possible to prevent obstruction of rotation of the pump rotor by disposition of products as well as deterioration of the pumping performance due to reduction of the cross sections of the exhaust flow passages 65 and 57, and to provide a vacuum pump capable of maintaining a stable performance for an extended period of time. Preferably, the temperature of the flow passages is raised to 100° C. or over, depending on a variety of conditions such as the type, the volume and the pressure of gas used in the semiconductor manufacturing process.

A sensor target 42*c* fixed to the main shaft 5 and an axial displacement sensor 42*d* for measuring the axial displacement of the sensor target 42*c* are provided in the vicinity of the centrifugal drag vane 33-4 as the last stage. A sensor target 42*a* fixed to the main shaft 5 and an axial displacement sensor 42*b* for measuring the axial displacement of the sensor target 42*a* are provided in the vicinity of the vortex flow vane 51-4 as the last stage. An axial displacement sensor 42*e* for measuring the axial displacement of the main shaft 5 is provided in the vicinity of the downstream end of the main shaft 5.

The axial displacement sensor 42*b* located immediately downstream of the vortex flow vane 51-4 as the last stage measures the axial reference position of the pump rotor composed of the main shaft 5, the centrifugal drag vanes 33, the vortex flow vanes 51, etc. The axial position of the pump rotor is kept constant based on the measurement value of the axial displacement sensor 42*b* by means of the axial magnetic bearing 43 through feedback control or the like. The other two axial displacement sensors 42*d* and 42*e* measure the gaps between the pump rotor and the pump stator composed of the fixed vanes 34 and 52, etc., in their respective positions, and these measurement points can be used as information necessary for the control and protective actions for the vacuum pump.

For example, owing to changes in temperature of the portions during the operation of the vacuum pump, the pump rotor and the pump stator are subject to thermal expansion or contraction in the axial direction from the measurement point of the axial displacement sensor 42*b* as the starting point. The measurement point is used for controlling the floating position of the pump rotor. Therefore, the gaps change between the pump rotor and the pump stator in the centrifugal drag pump element 30 and the vortex flow pump element 60. The axial gap changes as well between the main shaft 5 and the lower touchdown bearing 47 for regulating the axial movement of the pump rotor. As a result, not only the pumping performance is unstable, but also the pump rotor, and the pump stator and the touchdown bearing may come in contact and the pump may be inoperable in the worst case.

As a measure of the above problem, in addition to the axial displacement sensor 42*b* used for controlling the floating position of the pump rotor, axial displacement sensors 42*d* and 42*e* are provided in different axial positions from that of the axial displacement sensor 42*b*. The axial displacement sensors 42*d* and 42*e* monitor in their respective positions the amount of displacement of the pump rotor and the pump stator from the reference position, and, when the amount of displacement goes out of a predetermined adequate value range, perform a protective action such as stopping the operation, thereby securing safety operation. The temperature of the pump stator is detected by temperature detection means (not shown) such as thermistor or thermocouple, while output signals of the axial displacement sensors 42*d* and 42*e* are monitored by a temperature monitoring device (not shown). This allows the temperature of the pump rotor to be detected based on the changes in axial length of the pump rotor and the pump stator.

Ring-shaped members 61 are interposed between and located adjacent to the centrifugal drag vanes 33-1 to -4. These ring-shaped members 61 fix the axial positions of the centrifugal drag vanes 33-1 to -4. The ring-shaped members 61 are mounted to buffer the difference between the amounts of axial elongation of the main shaft 5 and the centrifugal drag vanes 33-1 to -4 due to the difference in material (difference in thermal expansion coefficient), as well as to adjust the axial positions of the centrifugal drag vanes 33-1 to -4. That is, in the case that the main shaft 5 is made of martensitic stainless steel (with a linear expansion coefficient of $10\times10^{-6}$/K), for example, and that the centrifugal drag vanes 33-1 to -4 are made of silicon nitride ceramics ($Si_3N_4$, with a linear expansion coefficient of $3\times10^{-6}$/K), when the centrifugal drag vanes 33-1 to -4 are positioned with respect to the main shaft 5 in a stacked manner, the amount of elongation of the main shaft 5 is larger than those of the centrifugal drag vanes 33-1 to -4 due to a temperature rise during operation. Therefore, the initial fastening (positioning) state changes and the axial positions of the centrifugal drag vanes 33-1 to -4 may change.

In order to prevent such a problem, the ring-shaped members 61 are made of a different material from that of the main shaft 5 (austenitic stainless steel, $15\times10^{-6}$/K, for example) so that the amount of elongation of the main shaft 5 and that of a first unit (centrifugal drag vanes 33-1 to -4, ring-shaped members 61, and sensor target 42*c*) attached to the main shaft 5 are adjusted to be almost equal. This eliminates changes in the fastening (positioning) state of the first unit attached to the main shaft 5. This also prevents generation of a thermal stress in the first unit. Ring-shaped members 62 with similar effect are interposed between the vortex flow vanes 51-1 to -4. A second unit is composed of the vortex flow vanes 51-1 to -4, the ring-shaped members 62, the sensor target 42*a*, and the axial disk 43*b*. The linear expansion coefficient of the main shaft 5 is generally the same as that of the second unit attached to the main shaft 5. In this regard, the linear expansion coefficient of a unit is calculated as an elongation of the unit divided by the length of the unit and a difference in a temperature of the unit, and that of the shaft is calculated as an elongation of the shaft divided by the length of the shaft and a difference in a temperature of the shaft. While a configuration example, in which the axial positions of rotary vanes are adjusted, is described in relation to the present embodiment, the radial positions of rotary vanes can also be adjusted by interposing ring-shaped members between the main shaft and the rotary vanes.

The foregoing technique of positioning the centrifugal drag vanes 33 with respect to the main shaft 5 may be applied to positioning the ring-shaped members 61 with respect to the main shaft 5. That is, the ring-shaped member 61 has a diameter smaller than the centrifugal drag vane 33, and thus is subject to a smaller stress during rotation. On the other hand, the centrifugal drag vanes 33 have a large diameter, and thus, even in the case that a cylindrical portion (boss) 36 is provided for reducing the stress acting on the centrifugal drag vane 33, the cylindrical portion 36 is inevitably subject to a larger stress when the centrifugal drag vanes 33 rotate at a high-speed. Therefore, as shown in FIG. 15, the outer surface of the cylindrical portion 36 is formed with notches (grooves) 36*a* having a semicircular section and extending axially, while the inner surface of the ring-shaped member 61 is formed with notches (grooves) 61*a* having a semicircular section and extending axially. A pin (positioning member) 63 is inserted into a pinhole formed by the two notches. This allows the stress acting on the cylindrical portion 36 to be reduced compared to when the pinhole is formed in the cylindrical portion 36. In this case, a rise in stress due to the notches is not a problem because the stress in the ring-shaped member 61 is small essentially. With this configuration, phasing and high-speed rotation of the centrifugal drag vanes 33-1 to -4 can be compatibly achieved. It should be obvious that the above configuration is not limited to an application in the centrifugal drag vanes 33 but may be applied to other types of rotary vanes such as the turbine vanes 13 and the vortex flow vanes 51.

The exhaust pipe 93, which is located in the outer periphery of the vacuum pump, is easy to be mounted/removed. Thus, the exhaust pipe 93 can be easily maintained by replacing the exhaust pipe 93, for example. The exhaust pipe 93 may be cooled, instead of being heated, to cause products contained in the gas to be deposited actively in the exhaust pipe 93, and may be replaced for every predetermined period of time. In this manner, the exhaust pipe 93 can function as a trap device for products. In this case, since products contained in the gas are trapped in the exhaust pipe 93, it is possible to prevent the products from depositing in the vortex flow pump element 60 as well as to prevent the gas containing products from being discharged from the exhaust port 31.

During the operation of the vacuum pump, heat generated from the motor 23 and the magnetic bearings 22, 43 and 44 is absorbed by the cooling jackets 25 and 45. With the configuration according to the present embodiment, the exhaust pipe 93 is provided as the flow passage between the centrifugal drag pump element 30 and the vortex flow pump element 60, and the outer periphery of the upper housing 24 housing the motor 23 and the radial magnetic bearing 22 is not used as part of the flow passage. Thus, the motor 23 and the upper radial magnetic bearing 22 can be cooled without thermally affecting the flow passage. Since the lower radial magnetic bearing 44 and the axial magnetic bearing 43 are located in positions away from the flow passage, that is, downstream of the vortex flow pump element 60, the lower radial magnetic bearing 44 and the axial magnetic bearing 43 can also be cooled without thermally affecting the flow passage. Therefore, the cooling efficiency of the motor 23 and the magnetic bearings 22, 43 and 44 can be improved, thereby downsizing the motor 23 and the magnetic bearings 22, 43 and 44 and giving them a higher capacity. Since the cooling of the motor 23 and the magnetic bearings 22, 43 and 44 and the heating of the exhaust pipe 93 can be controlled and performed individually, it is less likely that the foregoing cooling effect and heating effect to the respective portions are affected mutually, thereby improving the thermal efficiency.

As shown in FIG. 14, the vacuum pump of the present embodiment is provided with an upper purge gas port 73 and a purge gas flow passage 74 in the upper housing 24 housing the upper radial magnetic bearing 22 and the motor 23. Lower purge gas ports 84 and 85 are provided in the lower housing 41 housing the lower radial magnetic bearing 44 and the axial magnetic bearing 43. The upper purge gas port 73 and the lower purge gas ports 84 and 85 are connected to an unillustrated purge gas supply source.

A purge gas is used to prevent products contained in the gas to be exhausted, from being deposited around the upper and lower radial magnetic bearings 22 and 44, the axial magnetic bearing 43, and the motor 23. In addition, introduction of a purge gas prevents the gas from entering the upper housing unit 20 and the lower housing unit 40.

A purge gas introduced from the upper purge gas port 73 passes through the purge gas flow passage 74 to the inside of the upper housing unit 20 from the upstream side of the upper radial magnetic bearing 22 and the downstream side of the motor 23. This leaves the upper radial magnetic bearing 22 and the motor 23 with a purge gas atmosphere, which prevents the gas to be exhausted, from entering. The communication portion between the upper housing unit 20 and the vortex flow pump element (second exhaust section) 60 is provided with a labyrinth seal mechanism 75. The labyrinth seal mechanism 75 can reliably prevent the gas to be exhausted, from entering the upper housing unit 20, and can prevent products from being deposited in the upper housing unit 20. Providing an unillustrated non-contact seal mechanism such as labyrinth seal mechanism near the upper touchdown bearing 26 could more effectively prevent the gas from entering the upper housing unit 20.

On the other hand, a purge gas introduced from the lower purge gas ports 84 and 85 passes through the lower touchdown bearing 47, the lower radial magnetic bearing 44, and the axial magnetic bearing 43 to be discharged from the exhaust port 31. This leaves the lower radial magnetic bearing 44 and the axial magnetic bearing 43 with a purge gas atmosphere, which prevents the gas to be exhausted, from entering the lower housing unit 40. The communication portion between the vortex flow pump element 60 and the lower housing unit 40 may be provided with an unillustrated labyrinth seal mechanism, which could protect the axial magnetic bearing 43 and the lower radial magnetic bearing 44 from the gas to be exhausted.

Figure 16:
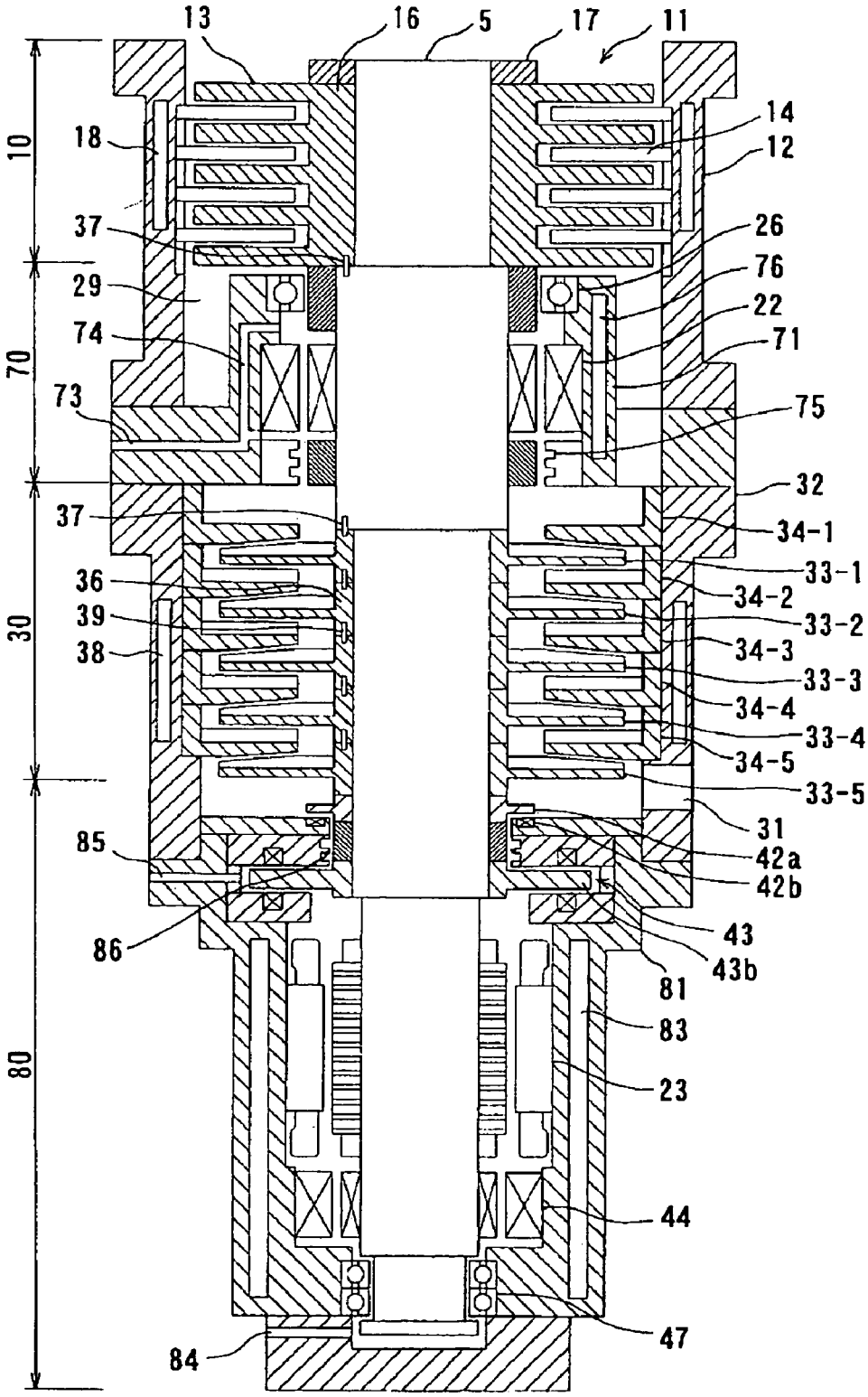
FIG. 16 is a sectional view of a vacuum pump according to a fifth embodiment of the present invention.

FIG. 16 is a sectional view of a vacuum pump according to a fifth embodiment of the present invention. The major differences of the present embodiment from the first embodiment are that the motor 23 for rotating the main shaft 5 is located in the vicinity of the lower radial magnetic bearing 44 disposed downstream of the centrifugal drag pump element (second exhaust section) 30, and that a purge gas supply mechanism is provided. The vacuum pump according to the present embodiment is described in detail below.

The vacuum pump shown in FIG. 16 comprises a turbo molecular pump element (first exhaust section) 10, an upper housing unit 70, a centrifugal drag pump element (second exhaust section) 30, and a lower housing unit 80. The main shaft 5 extends through the entire vacuum pump, and the turbo molecular pump element (first exhaust section) 10, the upper housing unit 70, the centrifugal drag pump element (second exhaust section) 30 and the lower housing unit 80 are serially arranged in this order from the upper end to the lower end of the main shaft 5. The turbo molecular pump element (first exhaust section) 10 and the centrifugal drag pump element (second exhaust section) 30, which have generally the same configuration as those of the first embodiment, are given the same reference numerals and symbols, and the description is not repeated.

The upper housing unit 70 includes an upper housing 71. The upper housing 71 has a cylindrical shape and is formed with a flange portion at the lower end. The upper housing 71 is located in the upper casing 12, and the flange portion of the upper housing 71 abuts on the lower end of the upper casing 12. The upper housing 71 houses an upper touchdown bearing 26 and an upper radial magnetic bearing 22, which are cooled by a cooling jacket 76 formed in the peripheral wall of the upper housing 71. A labyrinth seal mechanism 75 is provided below the upper radial magnetic bearing 22.

The lower housing unit 80 includes a lower housing 81, in which an axial magnetic bearing 43, a motor 23, a lower radial magnetic bearing 44, and a lower touchdown bearing 47 are provided. In the peripheral wall of the lower housing 81 is formed a cooling jacket 83 for cooling the axial magnetic bearing 43, the motor 23, the lower radial magnetic bearing 44, and the lower touchdown bearing 47. A sensor target 42*a* and an axial displacement sensor 42*b* are provided at the upper end of the lower housing 81.

With the above configuration, since the axial distance between the turbo molecular pump element 10 and the centrifugal drag pump element 30 can be shortened, the conductance of the flow passage 29 formed between the turbo molecular pump element 10 and the centrifugal drag pump element 30 is increased and the effective exhaust rate of the vacuum pump can be increased. When the volume of the gas to be exhausted increases, the load on the motor 23 increases, with a larger electric current passing through the coils of the motor 23, and thus it is particularly important to cool the motor 23. In the present embodiment, the cooling jacket 83 formed in the outer periphery of the motor 23 cools the motor 23 easily.

In the meantime, in the case of exhausting a gas containing products, it is necessary to heat the flow passage to not less than a predetermined temperature for the prevention of deposition of the products. In the present embodiment, the motor 23 is located in the lower housing unit 80 where no flow passage is provided, and thus can be cooled in a position away from the flow passage 29. In the case that the motor 23 is located in the upper housing 70, the motor rotor and the motor stator of the motor 23 are located under a vacuum environment and thus have a low heat transfer coefficient between each other. This hinders heat generated on the motor rotor side from being transferred to the motor stator side. On the other hand, in the case that the motor 23 is located in the lower housing unit 80 as in the present embodiment, the motor rotor is under an atmospheric pressure environment, facilitating heat emission of the motor 23.

The vacuum pump of the present embodiment is provided with an upper purge gas port 73 in the upper housing 71, and lower purge gas ports 84 and 85 in the lower housing 81. A purge gas is introduced from the upper purge gas port 73 into the upper housing unit 70 housing the upper radial magnetic bearing 22. In the same manner, a purge gas is introduced from the lower purge gas ports 84 and 85 into the lower housing unit 80 housing the axial magnetic bearing 43, the lower radial magnetic bearing 44, and the motor 23. The purge gas is used to protect the upper and lower radial magnetic bearings 22 and 44, the axial magnetic bearing 43, and the motor 23, which include a component of little corrosion-resistant material such as silicon steel sheet or copper wire coil, in the case that the vacuum pump of the present embodiment is used to exhaust a corrosive process gas. Thus, introduction of a purge gas into the vacuum pump allows the vacuum pump to operate stably for an extended period of time even when a corrosive process gas is exhausted.

A purge gas introduced from the upper purge gas port 73 passes through the purge gas flow passage 74 formed in the upper housing 71, and through the upstream and downstream sides of the upper radial magnetic bearing 22, to the inside of the upper housing 71. This leaves the upper radial magnetic bearing 22 with a purge gas atmosphere, preventing the corrosive process gas to be exhausted, from entering the upper housing 71. The communication portion between the upper housing 71 and the centrifugal drag pump element 30 is provided with a labyrinth seal mechanism 75, which prevents the process gas from entering the upper housing 71. Owing to this, components of the upper radial magnetic bearing 22 and the upper touchdown bearing 26 can be prevented from being corroded, and products deposited can be prevented from accumulating on the above components. Providing an unillustrated non-contact seal mechanism such as labyrinth seal mechanism in the vicinity of the upper touchdown bearing 26 could more effectively prevent the process gas from entering the upper housing 71.

On the other hand, a purge gas introduced from the lower purge gas ports 84 and 85 passes through the lower radial magnetic bearing 44, the motor 23, and the axial magnetic bearing 43 to be discharged from the exhaust port 31. This leaves the lower radial magnetic bearing 44 and the axial magnetic bearing 43 with a purge gas atmosphere, preventing a gas such as corrosive process gas from entering the lower housing 81. The communication portion between the centrifugal drag pump element 30 and the lower housing 81 is provided with a labyrinth seal mechanism 86, which effectively prevents the gas from entering the lower housing 81.

It should be understood that the foregoing purge gas supply mechanism may be provided in a vacuum pump of another embodiment, such as vacuum pump of the first embodiment in which the motor 23 is located in the vicinity of the upper radial magnetic bearing 22. An example of a vacuum pump of the first embodiment to which a purge gas supply mechanism is applied is shown next in FIG. 17.

Figure 17:
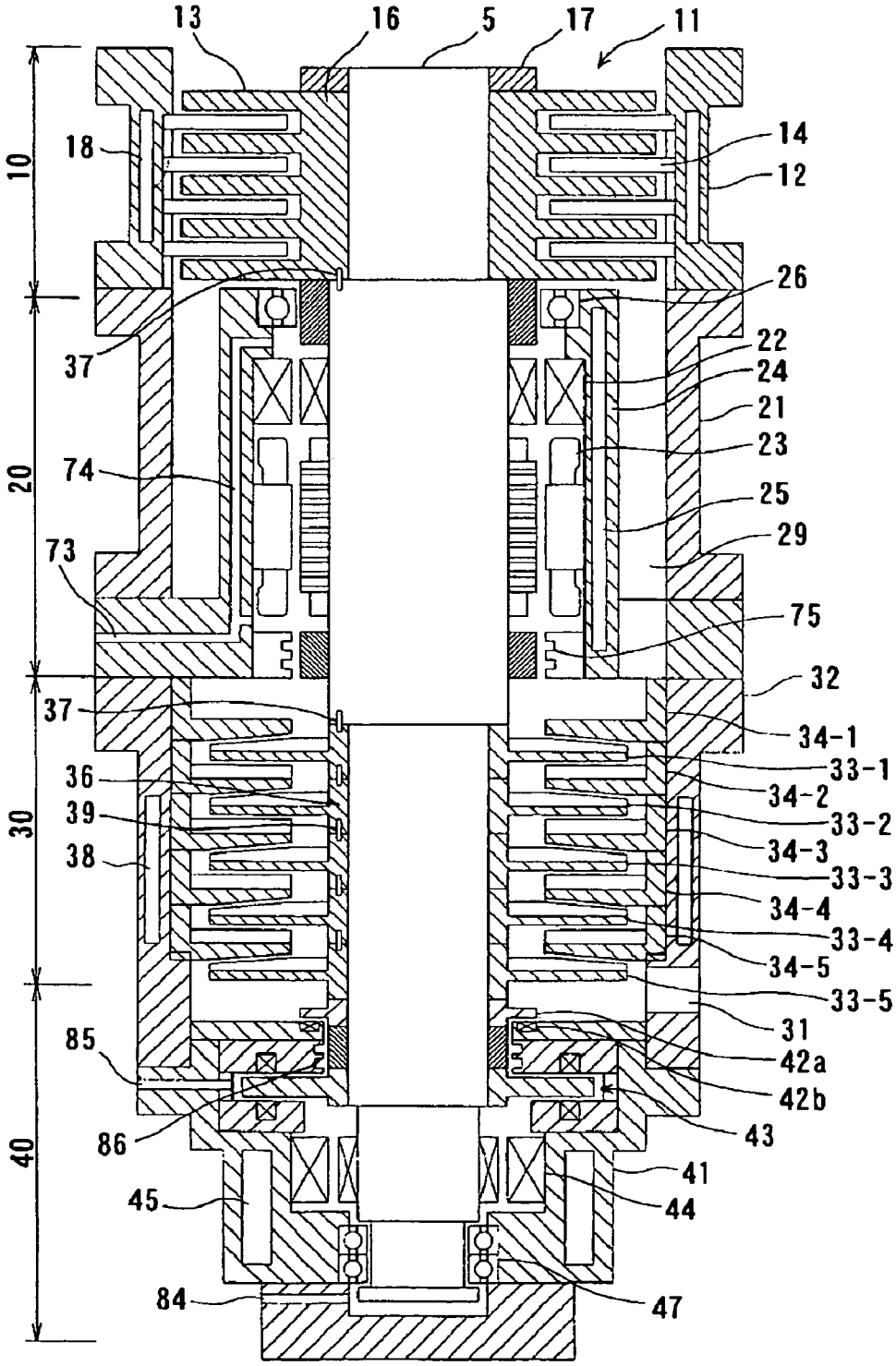
FIG. 17 is a sectional view of a vacuum pump according to a sixth embodiment of the present invention.

FIG. 17 is a sectional view of a vacuum pump according to a sixth embodiment of the present invention. As shown in FIG. 17, a purge gas introduced from the upper purge gas port 73 passes through the purge gas flow passage 74 formed in the upper housing 24, and through the upstream side of the upper radial magnetic bearing 22 and the downstream side of the motor 23 to the inside of the upper housing 24. This leaves the upper radial magnetic bearing 22 and the motor 23 with a purge gas atmosphere, preventing a corrosive process gas to be exhausted from entering the upper housing 24. The communication portion between the upper housing 24 and the centrifugal drag pump element 30 is provided with a labyrinth seal mechanism 75, which can protect the inside of the upper housing 71 from the gas to be exhausted. Therefore, components of the upper radial magnetic bearing 22 and the motor 23 can be prevented from being corroded, and deposits can be prevented from accumulating on the above components.

Since the upper housing 24 is located upstream of the centrifugal drag pump element 30 as the second exhaust section, the inside of the upper housing 24 is evacuated. In this case, the amount of heat transfer between the rotor side and the stator side of the upper radial magnetic bearing 22 and the motor 23 is extremely small, and thus the rotor side of the upper radial magnetic bearing 22 and the motor 23 is high in temperature. In the present embodiment, introduction of a purge gas into the upper housing 24 can increase the pressure of a gas existing between the rotor side and the stator side of the upper radial magnetic bearing 22 and the motor 23. Owing to this, the amount of heat transfer between the rotor side and the stator side of the upper radial magnetic bearing 22 and the motor 23 increases, and thus both the rotor side and the stator side of the upper radial magnetic bearing 22 and the motor 23 can be cooled by the cooling jacket 25 effectively.

Figure 18:
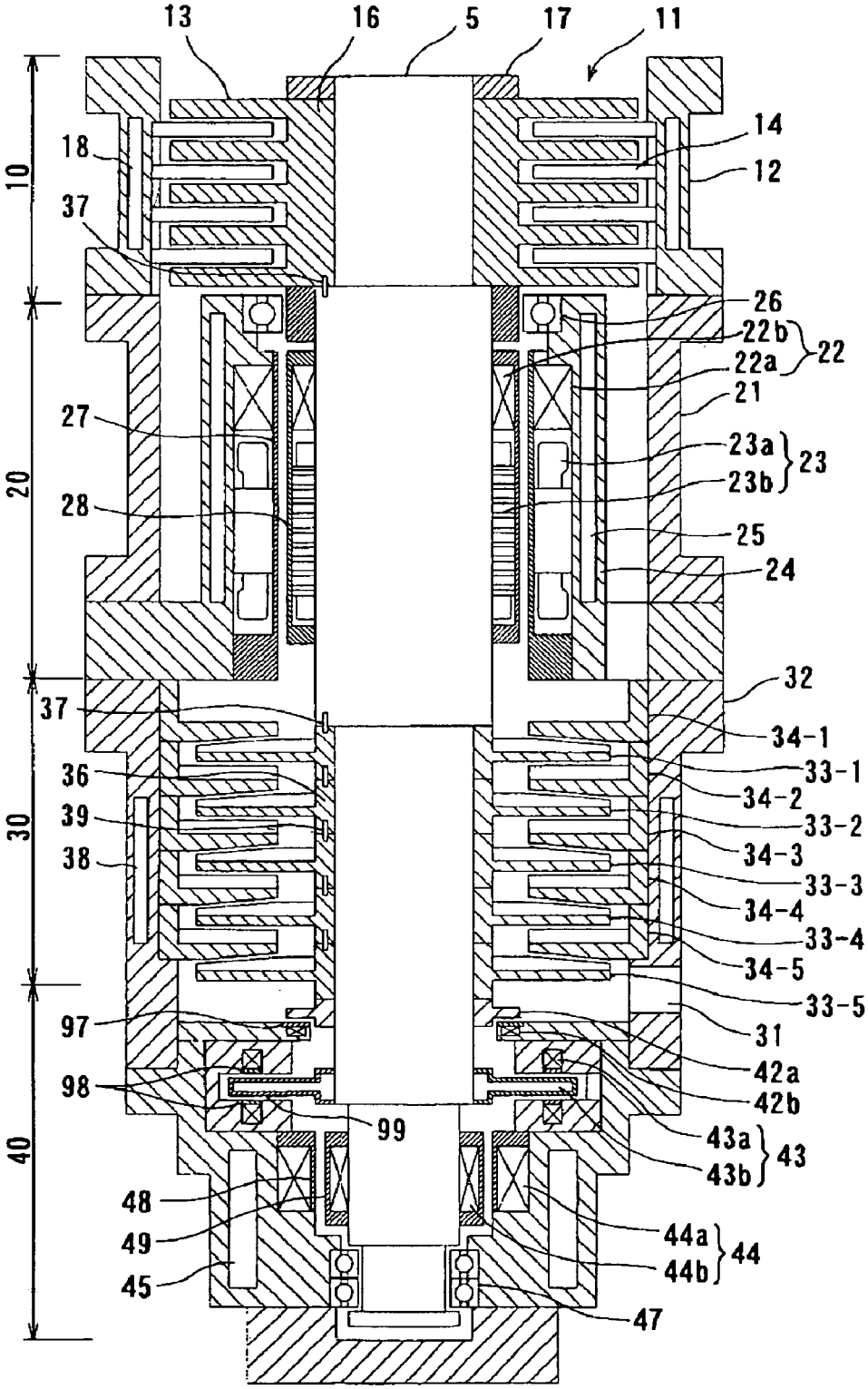
FIG. 18 is a sectional view of a vacuum pump according to a seventh embodiment of the present invention.

FIG. 18 is a sectional view of a vacuum pump according to a seventh embodiment of the present invention. The vacuum pump according to the present embodiment is suitably used to exhaust a corrosive process gas. As shown in FIG. 18, in the vacuum pump of the present embodiment, the inner surface of a stator 22*a* of the upper radial magnetic bearing 22 and the inner surface of a motor stator 23*a* of the motor 23 are covered with a protective member 27, while the outer surface of a rotor 22*b* of the upper radial magnetic bearing 22 and the outer surface of a motor rotor 23*b* of the motor 23 are coated with a protective member 28. In the same manner, both a stator 44*a* and a rotor 44*b* of the lower radial magnetic bearing 44 are provided with protective members 48 and 49, respectively.

In an axial magnetic bearing, in general, the magnetic field in the magnetic circuit of the electromagnet is not affected by rotation of the rotor. Therefore, it is not necessary to make an effort to reduce an eddy-current loss in the magnetic circuit or to use laminated silicon steel sheets as a core (iron core). Thus, the core on the rotor side of the axial magnetic bearing can be integrally made of a single material. This allows the use of an anti-corrosion material (such as electromagnetic stainless steel and permalloy), or allows the surface of the core to be applied with an anti-corrosion treatment (such as Ni plating and PTFE coating) easily. That is, in the present embodiment, the axial magnetic bearing 43 includes an axial disk 43*b* integrally made of a single material, and the surface of the axial magnetic bearing 43*b* is coated with an anti-corrosion coating 99. An electromagnet 43*a* on the stator side of the axial magnetic bearing 43 is provided with a protective member 98 only on the surface of the coil, which prevents exposure of the coil to the gas to be exhausted. The core of the electromagnet 43*a* is made of an anti-corrosion material (such as electromagnetic stainless steel and permalloy). The surface of the axial displacement sensor 42*b* for detecting the axial displacement of the pump rotor is provided with a protective member 97.

The configuration with no laminated silicon steel sheets as a core can also be applied to a radial magnetic bearing by modifying the core. For example, in the case that a core on the rotor side is integrally made of a single material, a multiplicity of slit-like circumferential grooves may be formed axially in the outer periphery of the core, thereby reducing the eddy-current loss. In this manner, it is preferable that the above configuration is adopted for a radial magnetic bearing after consideration of the frequency characteristics of the magnetic bearing, which depend on the rotation speed of the rotor, the eddy-current loss, and the like.

Preferably, the foregoing protective members 27, 28, 48, 97 and 98 are made of non-magnetic material with no influence on the magnetic fields produced by the motor 23 and the magnetic bearings 22, 43 and 44, which also has corrosion resistance to the process gas. Preferably, the above material is austenitic stainless steel, PTFE (polytetrafluoroethylene), or ceramics, for example. A part of or the entire of the protective member may be covered with an anti-corrosion coating.

With the above configuration, it is possible to prevent components of the motor 23, the upper and lower radial magnetic bearings 22 and 44, and the axial magnetic bearing 43 with little corrosion resistance, such as silicon steel sheet, copper wire coil and coil insulator, from being exposed to a corrosive gas. Thus, deterioration of the motor 23 and the magnetic bearings 22, 43 and 44 due to corrosion can be prevented, thereby providing a vacuum pump capable of operating stably for an extended period of time.

Figure 19:
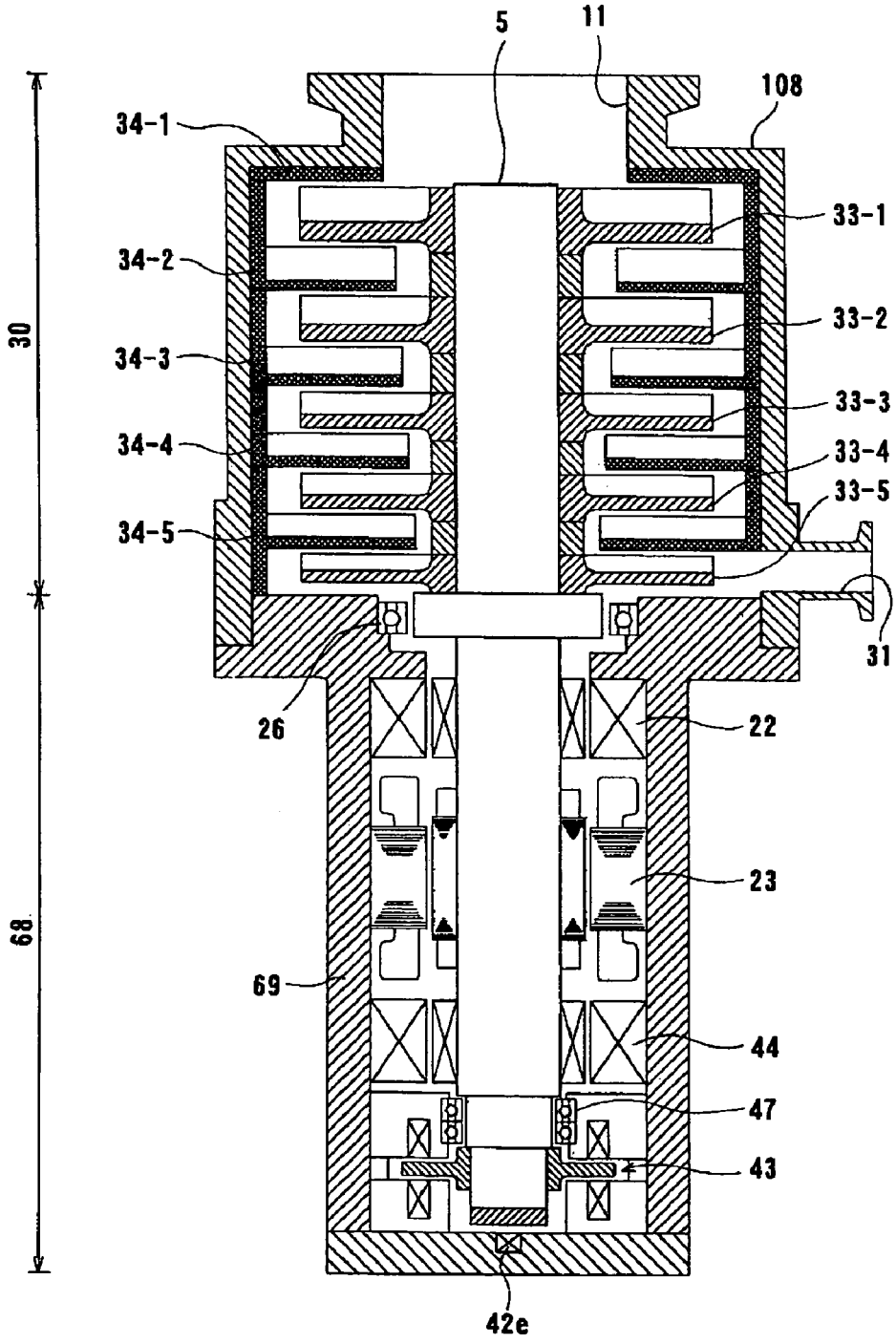
FIG. 19 is a sectional view of a vacuum pump according to an eighth embodiment of the present invention.

FIG. 19 is a sectional view of a vacuum pump according to an eighth embodiment of the present invention. The configuration of the present embodiment is not particularly described as they are similar to those of the foregoing first embodiment, and the overlapped description is omitted.

As shown in FIG. 19, the vacuum pump comprises a centrifugal drag pump element (exhaust section) 30 having centrifugal drag vanes 33-1 to -5 constituting five stages and fixed vanes 34-1 to -5 constituting five stages, a main shaft 5 to which the centrifugal drag vanes 33-1 to -5 are fixed, and a drive section 68 having a motor 23 for driving the centrifugal drag pump element 30 through the main shaft 5. The centrifugal drag pump element 30 includes a casing 108 having an intake port 11 and an exhaust port 31, and the centrifugal drag vanes 33-1 to -5 and the fixed vanes 34-1 to -5 are housed in the casing 108.

The main shaft 5 is rotatably supported by an upper radial magnetic bearing 22, a lower radial magnetic bearing 44, and an axial magnetic bearing 43. An axial displacement sensor 42*e* is disposed at a position facing the lower end of the main shaft 5, to detect the axial displacement of the main shaft 5. The motor 23 is located between the upper radial magnetic bearing 22 and the lower radial magnetic bearing 44, and the axial magnetic bearing 43 is located below the lower radial magnetic bearing 44. An upper touchdown bearing 26 is disposed immediately above the upper radial magnetic bearing 22, while a lower touchdown bearing 47 is disposed between the lower radial magnetic bearing 44 and the axial magnetic bearing 43. The upper radial magnetic bearing 22, the lower radial magnetic bearing 44, the axial magnetic bearing 43, the upper touchdown bearing 26, the lower touchdown bearing 47, and the axial displacement sensor 42*e* are all housed in a housing 69.

Figure 20:
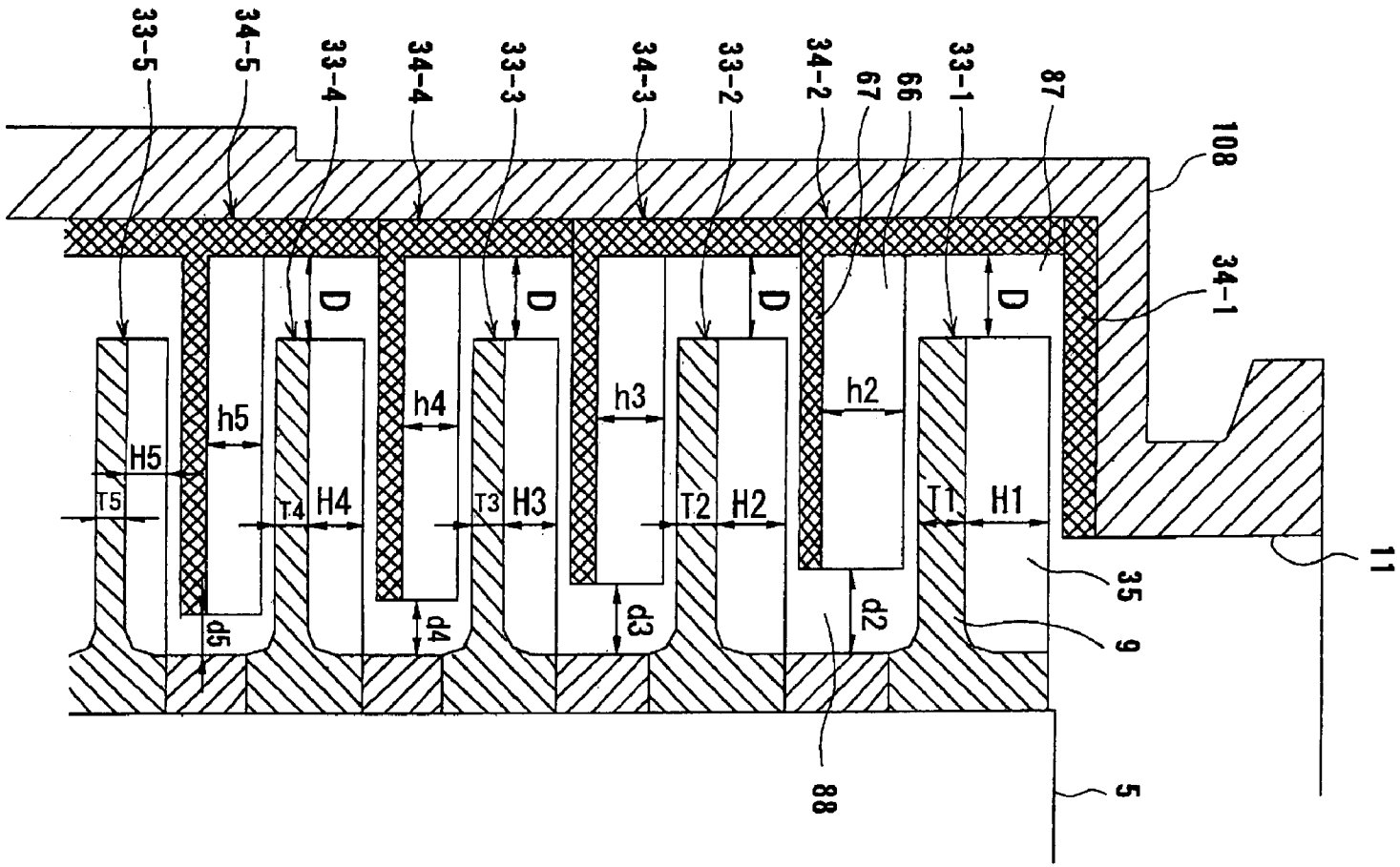
FIG. 20 is an enlarged sectional view of a drag pump element of FIG. 19.
Figure 34A:
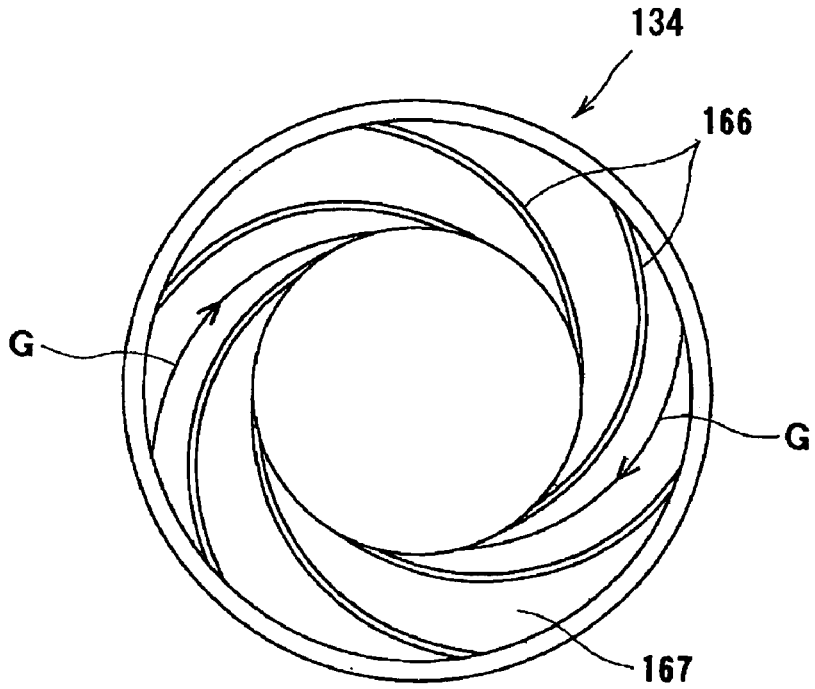
FIG. 34(*a*) is a plan view of a fixed vane shown in FIG. 32.
Figure 34B:
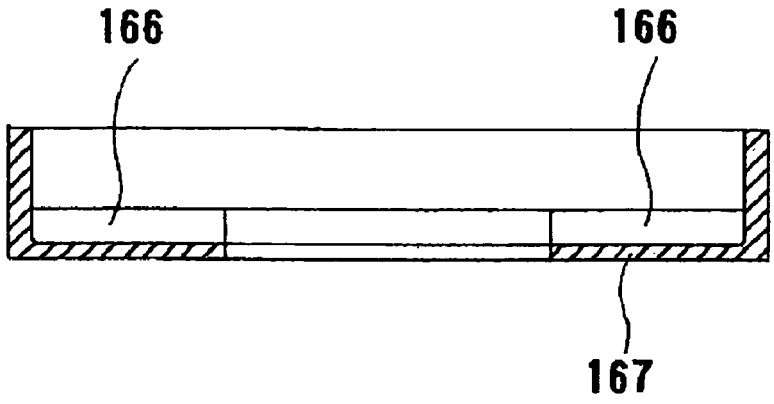

FIG. 20 is an enlarged sectional view of the drag pump element of FIG. 19. As shown in FIG. 20, the stages of the centrifugal drag vanes 33-1 to -5 and those of the fixed vanes 34-1 to -5 are arranged alternately with minute gaps along the main shaft 5. Each of the centrifugal drag vanes 33-1 to -5 has a plurality of spiral blades 35, and a disk-shaped base 9 to which the spiral blades 35 are fixed. The basic configuration of the fixed vanes 34-2 to -5 is similar to that of a fixed vane shown in FIG. 34(*a*) and FIG. 34(*b*). That is, each of the fixed vanes 34-2 to -5 has a plurality of spiral guides 66 extending rearward with respect to the rotation direction of the centrifugal drag vanes 33-1 to -5, and an annular plane portion 67 to which the spiral guides 66 are fixed.

When the centrifugal drag vanes 33-1 to -5 are rotated, a gas is drawn into the casing 108 from the intake port 11, and is compressed as it is transferred toward the radially outer side along flow passages between the spiral blades 35 through action of a centrifugal force. The gas having been transferred to the radially outer side then flows into a space defined by the spiral guides 66, the plane portion 67, and the backside of the base 9, and the gas is compressed as it is transferred toward the radially inner side through drag action due to viscosity of the gas. In this manner, the gas is transferred and compressed at each stage to a desired pressure, and discharged from the exhaust port 31 (see FIG. 19).

The gas flow passages of the centrifugal drag pump element 30 are formed to fulfill the following conditions.

(1) The height (depth of the flow passages) Hn of the spiral blades 35 of a centrifugal drag vane 33-*n* as the n-th stage is equal to or larger than the height H(n+1) of the spiral blades 35 of a centrifugal drag vane 33-(n+1) as the next stage. In other words, in FIG. 20, the heights H1 to H5 of the spiral blades 35 satisfy the formula $H1 \geqq H2 \geqq H \geqq H4 \geqq H5$.

(2) The height (depth of the flow passages) hn of the spiral guides 66 of a fixed vane 34-*n* as the n-th stage is equal to or larger than the height h(n+1) of the spiral guides 66 of a fixed vane 34-(n+1) as the next stage. In other words, in FIG. 20, the heights h2 to h5 of the spiral guides 66 satisfy the formula $h2 \geqq h3 \geqq h4 \geqq h5$.

(3) The radial dimension D of an outer turning flow passage 87 formed on the outer peripheral side of each of the centrifugal drag vanes 33-1 to -5 is equal to or larger than the height H1 of the spiral blades 35 of the centrifugal drag vane 33-1 as the first stage ($D \geqq H1$).

(4) The radial dimension dn of an inner turning flow passage 88 formed on the inner peripheral side of a fixed vane 34-*n* as the n-th stage is equal to or larger than the height hn of the spiral guides 66 of the fixed vane 34-*n* ($d2 \geqq h2$, $d3 \geqq h3$, $d4 \geqq h4$, $d5 \geqq h5$).

The above configurations can produce the following effects.

According to the condition (1), the exhaust rate can be increased since the centrifugal drag vane 33-1 as the first stage located closest to the intake port 11 has a gas flow passage with the largest section.

According to the conditions (1) and (2), the gas can be compressed efficiently. That is, when the height of the spiral blades 35 (depth of the flow passages) and the height of the spiral guides 66 (depth of the flow passages) are excessively large, drag action due to viscosity of the gas cannot be utilized effectively. On the other hand, when the height of the spiral blades 35 and the height of the spiral guides 66 are excessively small, the pressure loss in the gas flow passages increases, which unfavorably increases the resistance in the flow passages.

According to the condition (3), the pressure loss at the outer turning flow passage 87 can be reduced when the gas flows out of the outer periphery of the centrifugal drag vanes 33-1 to -5 toward the fixed vanes 34-2 to -5 as the next stage.

According to the condition (4), the pressure loss at the inner turning flow passage 88 can be reduced when the gas flows out of the inner periphery of the fixed vanes 34-2 to -5 toward the centrifugal drag vanes 33-2 to -5 as the next stage, as well as the length of the flow passages around the centrifugal drag vanes 33-2 to -5 and the fixed vanes 34-2 to -5 can be increased.

Also, with the above configurations, the axial length of the centrifugal drag pump element 30 can be reduced while keeping a high exhaust efficiency. Thus, the entire length of the vacuum pump can be shortened and high-speed rotation is facilitated, to enhance the exhaust efficiency.

Figure 21:
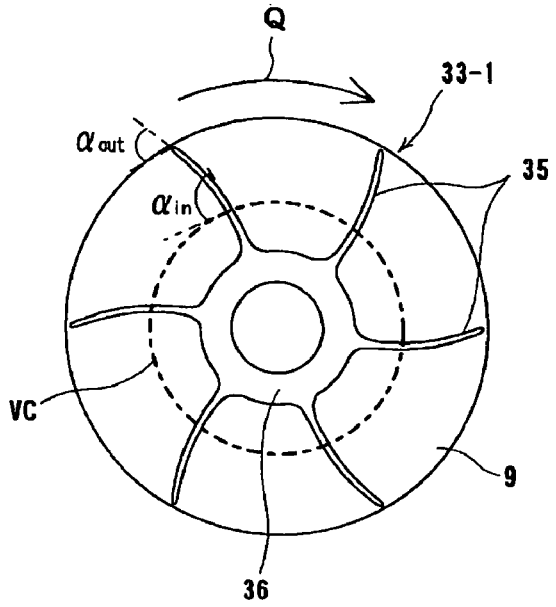
FIG. 21 is a plan view of a centrifugal drag vane as the first stage shown in FIG. 19.
Figure 22:
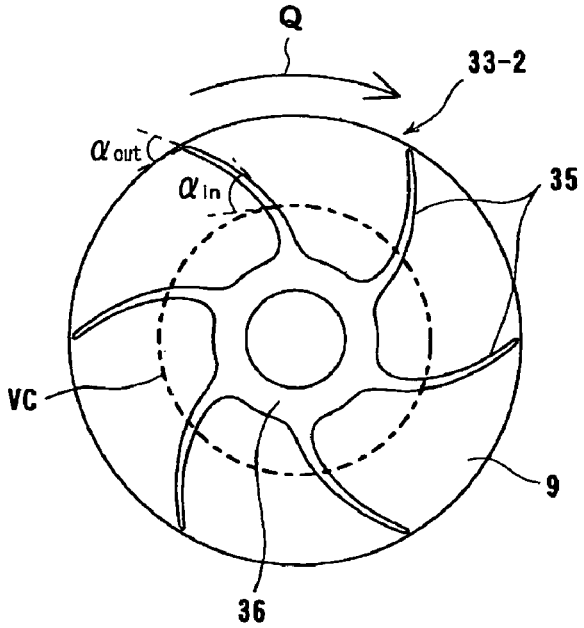
FIG. 22 is a plan view of a centrifugal drag vane as the second stage shown in FIG. 19.
Figure 23:
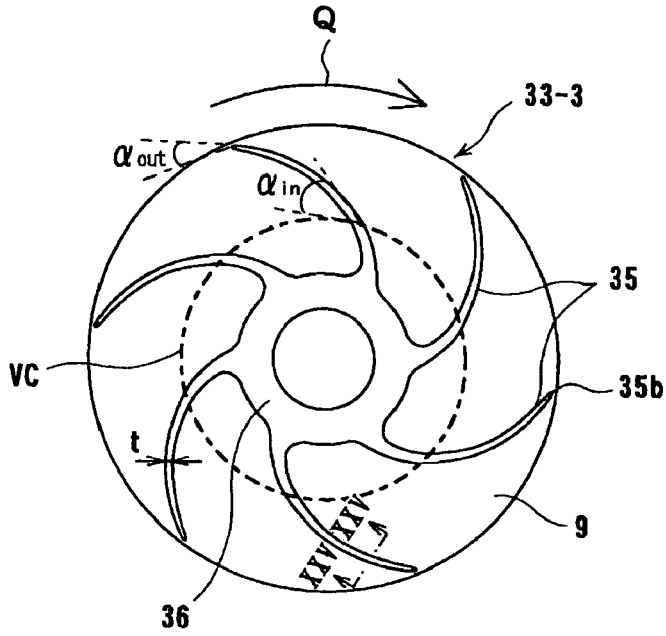
FIG. 23 is a plan view of a centrifugal drag vane as the third stage shown in FIG. 19.
Figure 24:
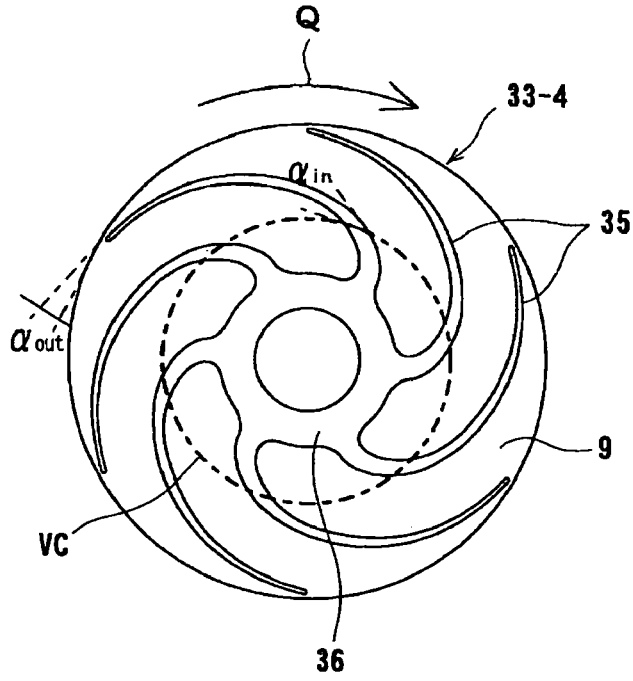
FIG. 24 is a plan view of a centrifugal drag vane as the fourth stage shown in FIG. 19.

FIG. 21 through FIG. 24 are plan views of the centrifugal drag vanes shown in FIG. 19. FIG. 21 shows the centrifugal drag vane as the first stage, FIG. 22 shows the centrifugal drag vane as the second stage, FIG. 23 shows the centrifugal drag vane as the third stage, and FIG. 24 shows the centrifugal drag vane as the fourth stage. In FIG. 21 through FIG. 24, a virtual circle VC shown by the dotted line indicates the inner periphery of a fixed vane facing the centrifugal drag vane.

As shown in FIG. 21 through FIG. 24, the centrifugal drag vane 33-*n* includes a plurality of spiral blades 35 extending rearward with respect to the rotation direction Q, and a disk-shaped base 9 to which the spiral blades 35 are fixed. The inner periphery of the centrifugal drag vane 33-*n* is formed with a cylindrical portion (boss) 36 having a small diameter and fitted with the main shaft 5. An angle $\alpha$ between the spiral blade 35 and a circle tangent becomes sequentially smaller from the first stage toward the last stage. Alternatively, the angle $\alpha$ between the spiral blade 35 and a circle tangent may be equal for the centrifugal drag vanes 33-1 to -5 as the first to last stages. With this configuration, the exhaust efficiency can be enhanced. A circle tangent herein refers to a tangent to a virtual circle VC arranged coaxially with the centrifugal drag vane 33-*n*.

In general, centrifugal drag vanes exhaust a gas through a centrifugal force acting on the gas and drag action due to viscosity of the gas. However, in moderate and high vacuum ranges where the centrifugal drag vanes operate under a pressure in the order of $10^1$ Pa or less, drag action due to viscosity of the gas is not significantly effective. Thus, the angle $\alpha$ is set larger, to increase the area of the flow passages around the centrifugal drag vanes as well as to shorten the length of the flow passages. This allows the resistance in the flow passages around the centrifugal drag vanes to be reduced, causing a centrifugal force to effectively act on the gas therein.

On the contrary, in a low vacuum range where the centrifugal drag vanes operate under a pressure in the order of $10^2$ Pa or more, drag action due to viscosity of the gas is effective. Thus, an angle (entrance angle) $\alpha$ in at an entrance of the flow passage and an angle (exit angle) $\alpha$ out at an exit of the flow passage are made as small as possible, causing the flow passage to become longer so that drag action can be effective. In this case, the resistance in the flow passages does not increase significantly owing to a high pressure of the gas passing through the flow passages, although the section of the flow passages around the centrifugal drag vanes is reduced and the length of the flow passages is increased.

While the number of the spiral blades 35 is six for each of the centrifugal drag vanes 33-1 to -5 in FIG. 21 through FIG. 24, preferably an optimum number of the blades are used in consideration of the stress due to the rotation and of the section of the flow passages around the centrifugal drag vanes 33-1 to -5. The number of the spiral blades 35 may be changed for each of the stages.

Preferably the thickness T of the base 9 for each of the centrifugal drag vanes 33-1 to -5 is as small as possible, in view of weight reduction and downsizing of the centrifugal drag pump element 30. However, the base 9 needs to support the spiral blades 35, and therefore the thickness T of the base 9 must be decided in consideration of the following points.

Angle α between the spiral blade 35 and a circle tangent (The thickness T of the base 9 is smaller as the angle α is larger.)

Height of the spiral blades 35 (The thickness T of the base 9 is smaller as the height of the spiral blades 35 is lower.)

Number of the spiral blades 35 (The thickness T of the base 9 is smaller as the number of the spiral blades 35 is smaller.)

Normally, it is preferable that the formula T1≧T2≧T3≧T4≧T5 holds true, as shown in FIG. 19.

Figure 25A:
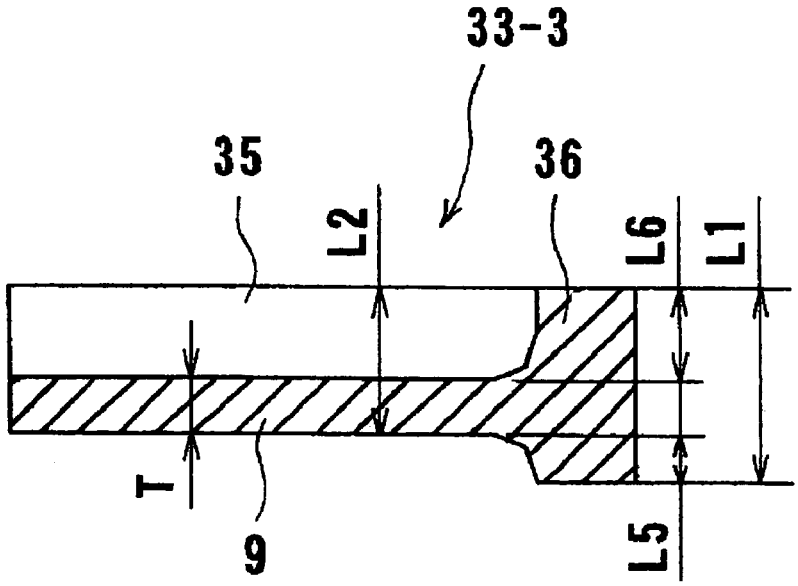
FIG. 25(*a*) is a partial sectional view of the centrifugal drag vane shown in FIG. 23.
Figure 25B:
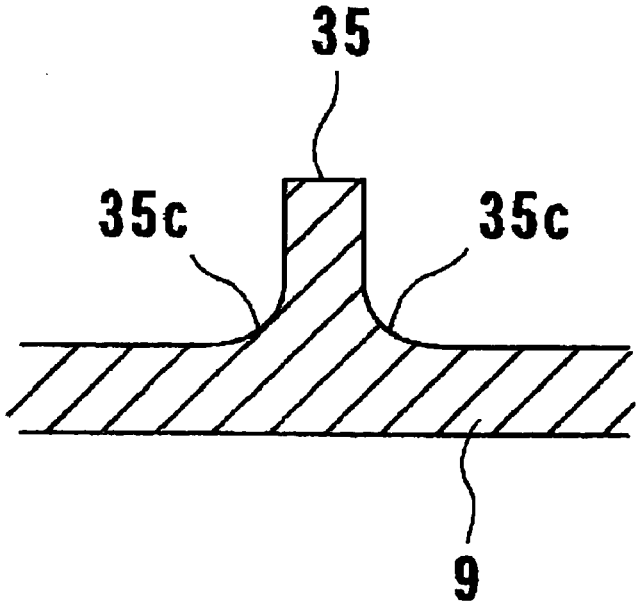

In view of reducing the stress arising from the rotation to avoid stress concentration and of improving the exhaust performance, the centrifugal drag vanes shown in FIG. 21 through FIG. 24 have a shape as follows. Description is made in this respect with reference to FIG. 23, FIG. 25(*a*), and FIG. 25(*b*). FIG. 25(*a*) is a partial sectional view of the centrifugal drag vane shown in FIG. 23, and FIG. 25(*b*) is a sectional view taken along the line XXV-XXV of FIG. 23.

(i) The inner periphery of the centrifugal drag vane 33-*n* is formed with a cylindrical portion (boss) 36 having a small diameter and fitted with the main shaft 5. The axial length L1 of the cylindrical portion 36 is set larger than the axial length L2 of the blade portion (the spiral blades 35 and the base 9).

(ii) The spiral blades 35 are integrally connected to the outer surface of the cylindrical portion 36. The connection portions of the cylindrical portion 36 and the spiral blades 35 are formed with a fillet 35*a*. On the outer surface of the cylindrical portion 36, the length L5 from the lower surface of the base 9 to the lower end of the cylindrical portion 36 and the length L6 from the upper surface of the base 9 to the upper end of the cylindrical portion 36 are each set not less than 0.5 times the thickness (axial length) T of the base 9.

(iii) The thickness t of the spiral blade 35 is configured to become successively smaller toward the radially outer side. It is desirable that the thickness t is as small as possible, preferably 0.5 to 2 mm at the tip of the spiral blade 35.

(iv) A curved surface portion 35*b* is formed at the tip of the spiral blade 35. The tip of the spiral blade 35 is located slightly on the radially inner side of the peripheral edge of the base 9. This allows the curved surface portion 35*b* to be formed throughout the entire tip of the spiral blade 35.

(v) The connection portions of the spiral blades 35 and the base 9 are formed with a fillet 35*c* having an arcuate section. The size of the arc of the fillet 35*c* need not be uniform in the longitudinal direction of the spiral blade 35, and may be changed depending on the locations.

(vi) The angle α between the spiral blade 35 and a circle tangent is set smaller toward the radially outer side (α in>α out).

(vii) A curve formed by the spiral blade 35 is defined by a spiral curve (such as an Archimedean spiral represented with polar coordinates as r=aθ, or a logarithmic spiral represented as $r=a^{\theta}$), an involute curve, or a variation of these curves.

The above features (i), (ii), (iii), (iv) and (v) allow stress reduction and avoiding stress concentration in the centrifugal drag vane 33-*n*. The above features (iii), (v), (vi) and (vii) contribute to improving the exhaust performance.

Figure 26:
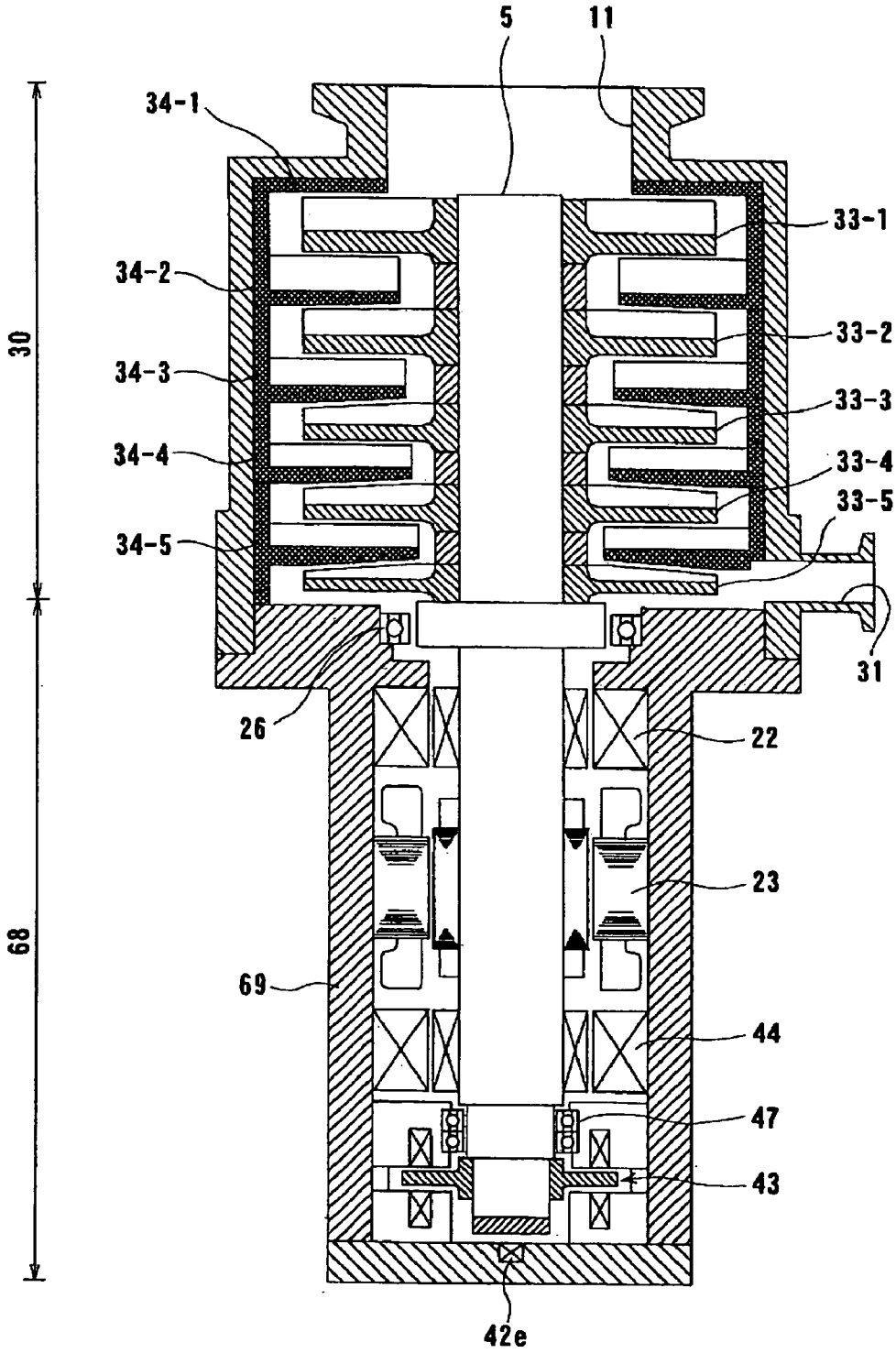
FIG. 26 is a sectional view of a vacuum pump according to a ninth embodiment of the present invention.
Figure 27:
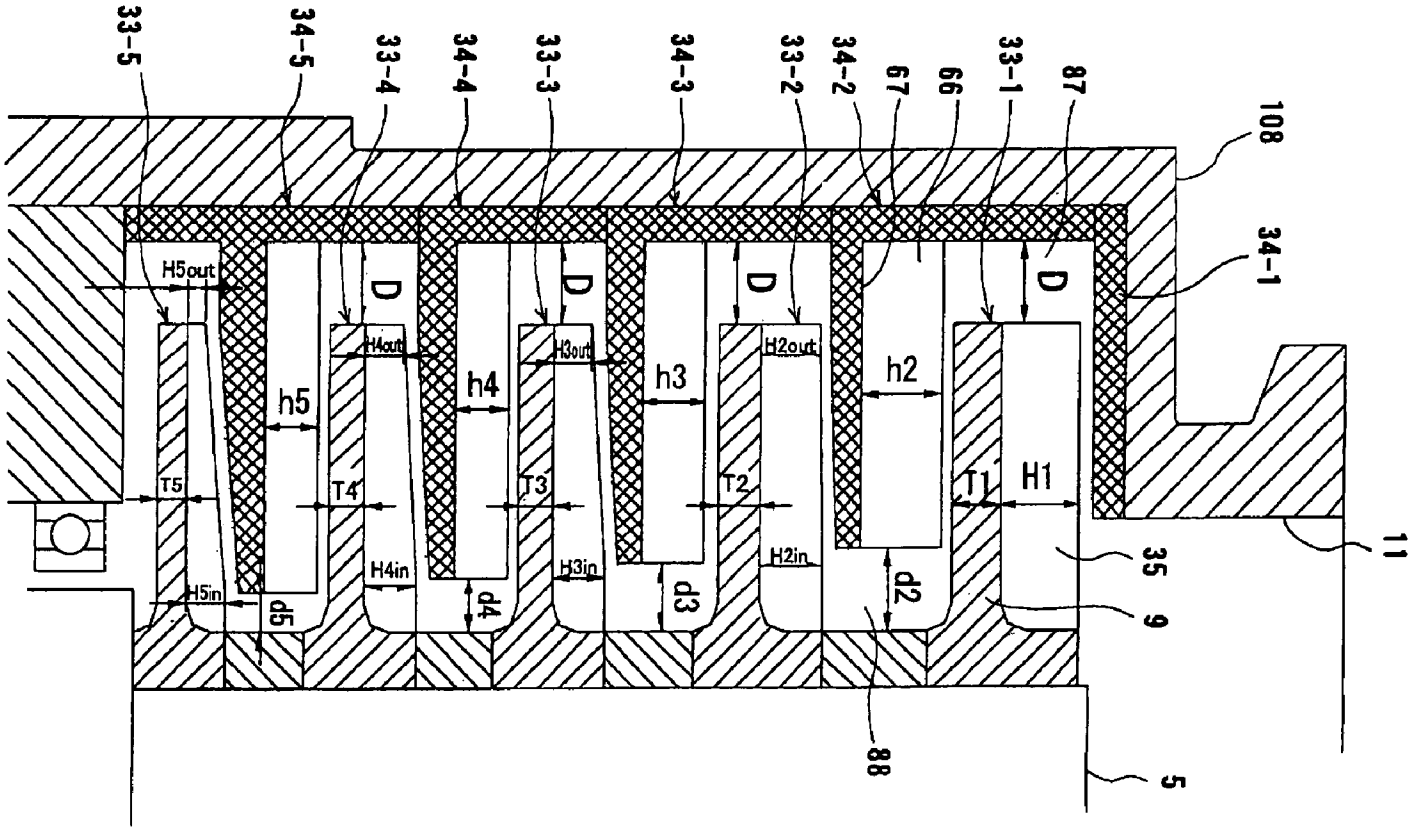
FIG. 27 is an enlarged sectional view of a drag pump element shown in FIG. 26.

A vacuum pump according to a ninth embodiment of the present invention is next described with reference to FIG. 26 and FIG. 27. FIG. 26 is a sectional view of the vacuum pump according to the ninth embodiment of the present invention, and FIG. 27 is an enlarged sectional view of a drag pump element shown in FIG. 26. The configuration of the present embodiment is not particularly described as they are similar to those of the foregoing eighth embodiment, and the overlapped description is omitted.

The difference between the present embodiment and the foregoing eighth embodiment lies in the shape of the centrifugal drag vanes 33-2 to -5 as the second to fifth stages and in the shape of the fixed vanes 34-2 to -5 facing the centrifugal drag vanes 33-2 to -5. That is, as shown in FIG. 26 and FIG. 27, the heights of the spiral blades 35 of the centrifugal drag vanes 33-2 to -5 as the second to fifth stages each become gradually smaller toward the radially outer side. An inclined portion corresponding to the inclined shape of the spiral blade 35 is formed on the backside (underside) of the plane portion 67 of the fixed vanes 34-2 to -5 facing the centrifugal drag vanes 33-2 to -5.

When the height of the spiral blade 35 on the radially inner side (entrance height) is named as H in and the height of the spiral blade 35 on the radially outer side (exit height) is named as H out, the reduction ratio of the heights of each spiral blades 35 is set so as to satisfy the following formula.

$$H2\ \text{in}/H2\ \text{out} \leqq H3\ \text{in}/H3\ \text{out} \leqq H4\ \text{in}/H4\ \text{out} \leqq H5\ \text{in}/H5\ \text{out}$$

As described above, the reduction ratio in the height of the spiral blades 35 of a centrifugal drag vanes 33-*n* on the upstream side is equal to or smaller than that of the spiral blades 35 of a centrifugal drag vanes 33-(n+1) on the downstream side.

Figure 28:
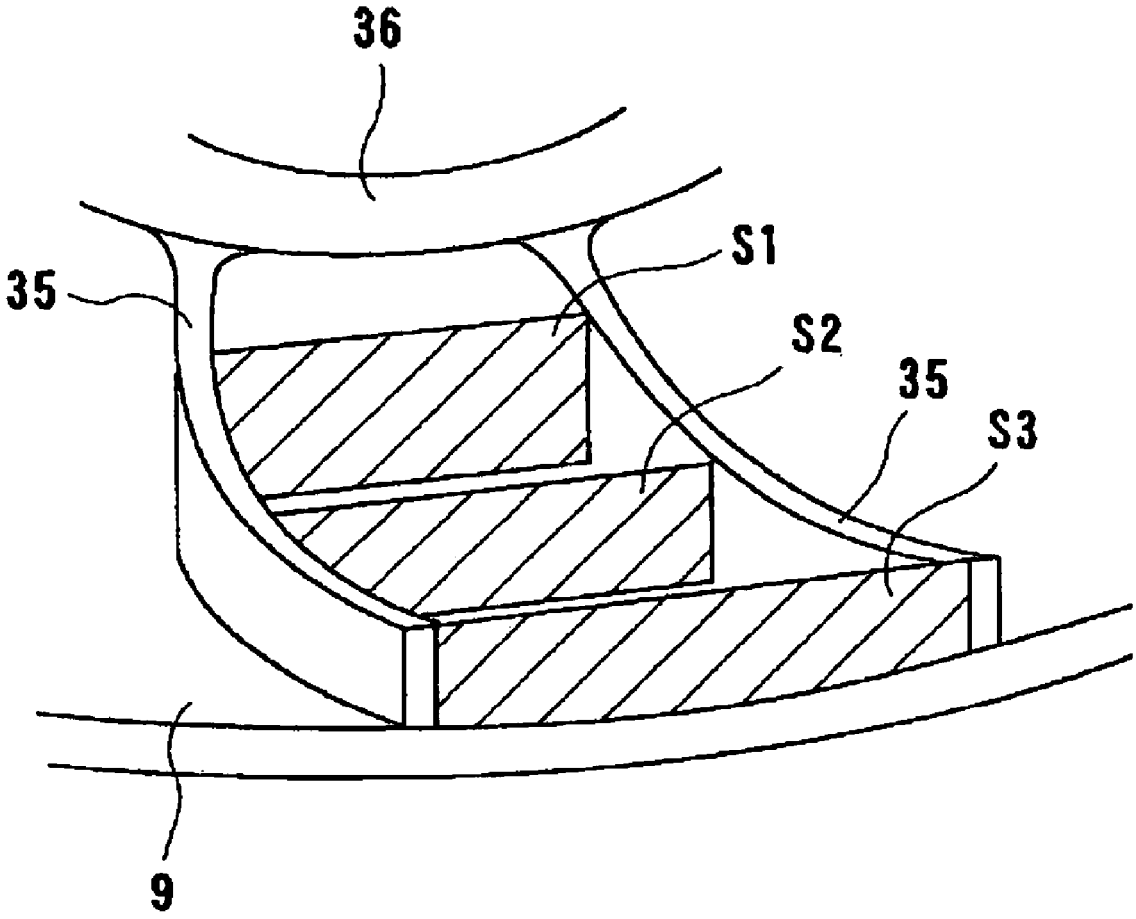
FIG. 28 is a perspective view of a part of a centrifugal drag vane shown in FIG. 26.

In general, a centrifugal drag vane close to an exhaust port operates in a high pressure, and therefore demonstrates effective drag action. Thus, by gradually reducing the height of the spiral blades 35 toward the radially outer side, gaps between the bases 9 of the centrifugal drag vanes 33-1 to -5 and the fixed vanes 34-1 to -5 also become smaller, making the drag action more effective. Preferably the height of the spiral blades 35 is reduced in such a manner that the cross sections of the flow passages formed between the spiral blades 35 will not reduce from the radially inner side toward the radially outer side. That is, as shown in FIG. 28, the cross sections S1, S2 and S3 of the flow passage formed between the spiral blades 35 satisfy the formula S1≦S2≦S3. Reducing the height of a centrifugal drag vane reduces a stress due to a centrifugal force, thereby constituting a centrifugal drag vane adapted for high-speed rotation.

In the meantime, in the case of a centrifugal drag vane located close to an intake port, a centrifugal force needs to act on a gas having flown from the intake port, and the resistance in the flow passages around the centrifugal drag vanes need to be reduced. Therefore, preferably the height of spiral blades is not reduced. Thus, by setting the height of the spiral blades 35 as appropriate according to the operating pressure for each stage of the centrifugal drag vanes 33-1 to -5, a vacuum pump with a high exhaust efficiency can be materialized.

The following characteristics of the vacuum pomp according to the present invention may contribute to solve the foregoing problems.

When the vacuum pump for exhausting a gas is provided, which comprises a main shaft rotatably supported by a first bearing, a motor for rotating the main shaft, a first exhaust section having a first rotary vane attached to the main shaft, a first fixed vane fixed in a first casing, and an intake port, and a second exhaust section having a second rotary vane attached to the main shaft, a second fixed vane fixed in a second casing, and an exhaust port, in which the intake port is located in the vicinity of an end of the main shaft, and in which the first exhaust section, the first bearing and the second exhaust section are axially arranged in this order along the main shaft, preferably the vacuum pump further comprises a second bearing for radially supporting the main shaft and a third bearing for axially supporting the main shaft, in which the second bearing and the third bearing are disposed downstream of the second exhaust section.

In one preferred aspect of the present invention, the motor is disposed in the vicinity of the first bearing.

When the motor is located in the vicinity of the first bearing which is disposed between the first exhaust section and the second exhaust section, for example, the position of the motor is generally at the middle of the pump rotor in the axial direction. Then, the diameter of the motor can be increased without lowering the vibration characteristics and the rotation characteristics of the pump rotor. Thus, the output of the motor can be increased. Since the increase in diameter of the motor allows the area of the polar face of the motor to be secured, the motor is reduced in length. As a result, the entire length of the main shaft is shortened and the natural frequency in bending of the pump rotor increases, thereby obtaining a pump rotor suitable for high-speed rotation. The motor generates a radial unbalanced force as it produces a rotation torque. Thus, the motor possibly acts as a vibration source of the pump rotor. In the present invention, however, since the first bearing is located in the vicinity of the motor, the vibration of the pump rotor can be suppressed effectively.

When the motor is located in the vicinity of the second bearing which is disposed at the downstream of the second exhaust section, the motor can be spaced from the flow passage of the gas. In the case of exhausting a process gas containing products, in general, a flow passage in a vacuum pump need be kept at a high temperature for the prevention of deposition of the products in the flow passage. According to the present invention, the vacuum pump can be equipped with a downsized and high-output motor that can be spaced from the flow passage and thus can be cooled highly efficiently. In the case of exhausting a corrosive process gas, the motor can be protected from the corrosive environment easily.

In one preferred aspect of the present invention, the vacuum pump further comprises a displacement sensor for detecting an axial displacement of at least one of the main shaft and a part attached to the main shaft, in which the third bearing holds the main shaft in a predetermined target axial position, based on a value detected by the displacement sensor, and the displacement sensor is disposed in the vicinity of the second exhaust section.

In the operation of the vacuum pump, the temperature of the main shaft and members attached to the main shaft such as rotary vanes (the first rotary vane and the second rotary vane) rises, which causes the main shaft to extend axially. In the present invention, a displacement sensor is provided in the vicinity of the second exhaust section, and the axial position of the main shaft is kept to be constant based on a value detected by the displacement sensor. This allows the starting point of the elongation of the main shaft and the rotary vanes to be as the measurement point of the displacement sensor. Therefore, changes in an axial gap between the second rotary vane and the second fixed vane in the second exhaust section can be minimized. Hence, the improved exhaust performance and stabilized operation of the vacuum pump is expected. In the second exhaust section, which exhausts a gas in a relatively high pressure range, in particular, the exhaust performance can be improved significantly by minimizing the gap.

In one preferred aspect of the present invention, the first through third bearings are a non-contact bearing.

This allows the pump rotor to rotate at a high speed, thereby improving the pumping performance.

In one preferred aspect of the present invention, the vacuum pump further comprises a purge gas supply mechanism provided to at least one of the first through third bearings and the motor for feeding a purge gas.

In one preferred aspect of the present invention, at least one of the first through third bearings and the motor has a protective member for preventing the one having the protective member from being exposed to a gas introduced from the intake port.

According to the present invention, it is possible to prevent the bearings and the motor from being corroded in the case of exhausting a corrosive process gas. It is also possible to prevent the rotation of the pump rotor from being obstructed by disposition of a variety of products contained in the process gas. In addition, the motor and the bearings can be cooled by the purge gas. In more detail, the purge gas not only cools the motor and the bearings directly, but also can maintain the pressure of a gas existing locally around the motor and the bearings to be high. Thus, the heat transfer coefficient from the rotor side to the stator side of the motor and the bearings increases, thereby enhancing the cooling effect of the motor and the bearings.

In addition, in one preferred aspect of the present invention, the vacuum pomp further comprises a flow passage axially extending along the main shaft from a downstream side of the first exhaust section, where the flow passage is provided between the first and second exhaust sections.

The flow passage may be a tubular flow passage laid axially, or may be a cylindrical flow passage formed between two circular tubes arranged coaxially with each other. This allows the conductance of the flow passage between the first exhaust section and the second exhaust section to be increased (reduced in the resistance to exhaust gas), thereby further improving the exhaust performance of the vacuum pump.

In one preferred aspect of the present invention, the vacuum pump further comprises a plurality of displacement sensors for detecting an axial displacement of at least one of the main shaft and a part attached to the main shaft disposed in at least two positions in the first exhaust section, in the second exhaust section, and in the vicinity of an end of the main shaft, in which the third bearing holds the main shaft in a predetermined target axial position, based on a value detected by at least one of the plurality of displacement sensors.

In this case, preferably a temperatures of at least one of the main shaft and a part attached to the main shaft is detected based on values detected by at least two of the plurality of displacement sensors.

Figure 29:
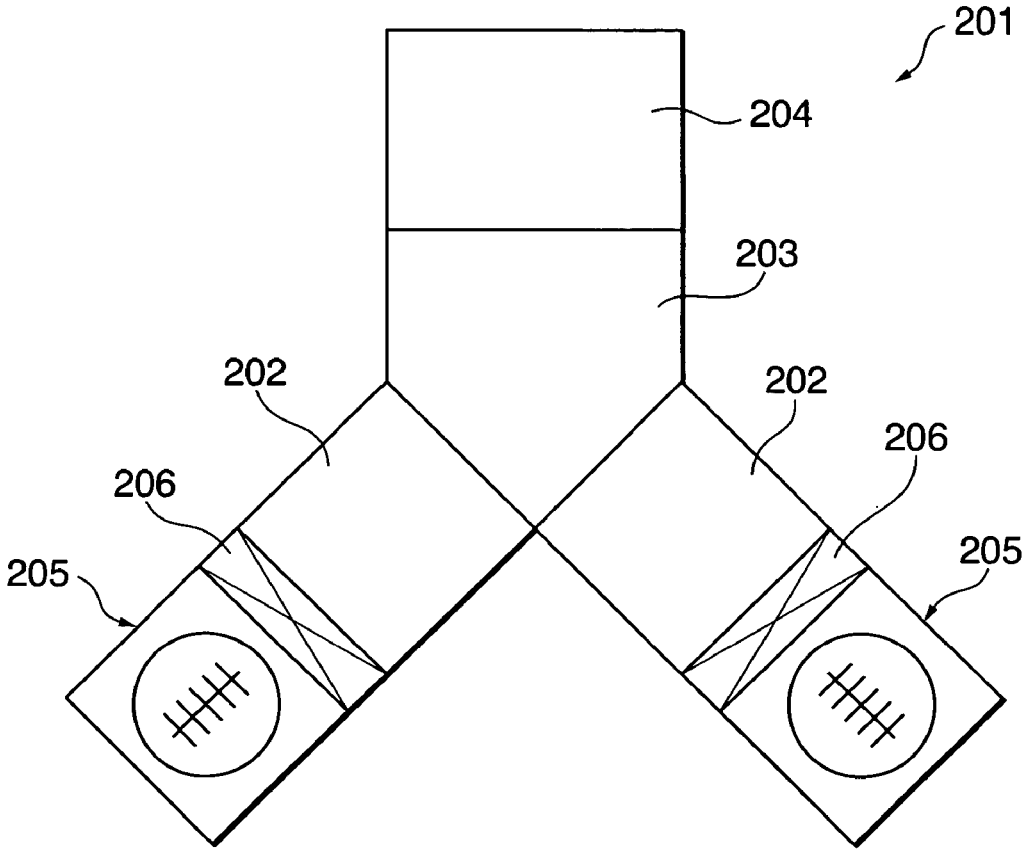
FIG. 29 is a schematic diagram of a semiconductor manufacturing apparatus with a vacuum pump according to the present invention, where a vacuum pump and a process chamber are connected directly.

Next, referring to FIG. 29, the semiconductor manufacturing apparatus 201 utilizing the vacuum pump according to the present invention is described.

As shown in FIG. 29, the semiconductor manufacturing apparatus 201 comprises a plurality of process chambers 202, a transfer chamber 203 and a cassette chamber 204. A substrate (wafer) to be processed is placed in the cassette chamber 204, and transferred by way of the transfer chamber 203 to the process chamber 202. At the process chamber 202 the substrate is subject to a process like Physical Vapor Deposition(PVD) or Chemical Vapor Deposition (CVD) to form a thin film on the substrate, or is subject to a process like etching to print a circuit on the substrate. A plurality of process chambers 202 are commonly provided to the single semiconductor manufacturing apparatus 201 in order to perform a plurality of processes or to increase the number of substrates to be processed.

In the process chamber 202, a high vacuum state is made up before processing, and a process gas is to be continuously exhausted during processing. Therefore, a vacuum pump according to the present invention such as those shown in. FIGS. 1, 3, 5, 9, 14, 16, 17, 18 and 19 is provided with the semiconductor manufacturing apparatus 201 to evacuate the process chamber 202. Having the vacuum pump according to the present invention enables to evacuate the process chamber 202 up to a high vacuum suitable for the above process, for example, at a pressure of 10−7 Pa, starting from atmosphere by a single vacuum pump. In addition, because a completely oil-free vacuum is created by the vacuum pump according to the present invention, which operates without lubricant, contamination of a substrate by evaporated lubricant is prevented.

Furthermore, since a backing pump is eliminated, a number of equipment of the semiconductor manufacturing apparatus 201 decreases and a space for the semiconductor manufacturing apparatus 201 is reduced.

In the semiconductor manufacturing apparatus 201 shown in FIG. 29, the vacuum pump 205 is directly connected to the process chamber 202 with valve 206, and one vacuum pump 205 is provided with one process chamber 202. In the semiconductor manufacturing apparatus 211 shown in FIG. 30, the vacuum pump 215 is indirectly connected to the process chamber 202 installing the piping 212 and valves 213 between the process chamber 202 and the vacuum pump 215.

As described above, the vacuum pump 205 and the process chamber 202 are directly connected when they are connected with or without a valve but without a piping, a duct, or the like. On the contrary, the vacuum pump 215 and the process chamber 202 are indirectly connected when they are connected through the piping 212, a duct or the like.

Figure 30:
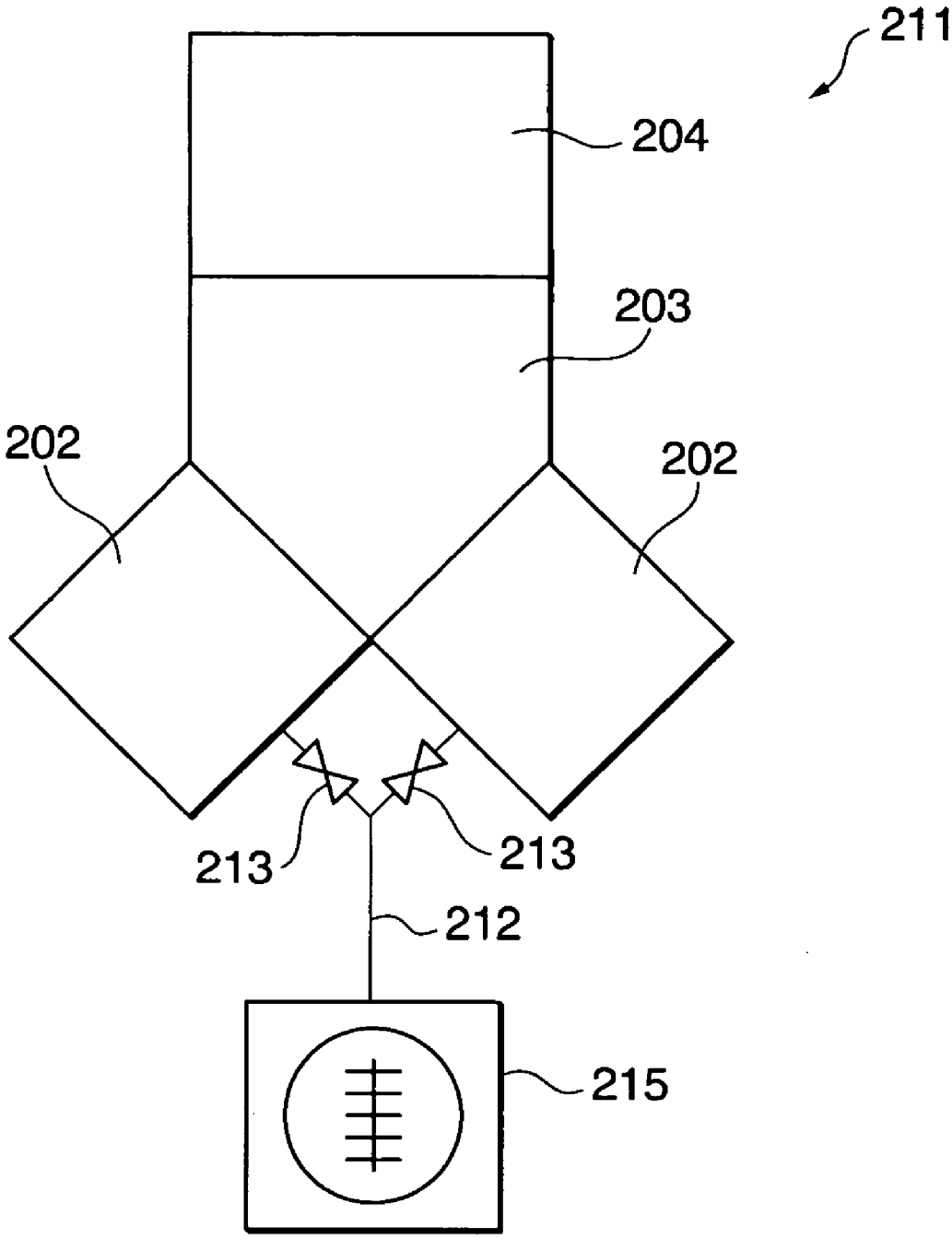
FIG. 30 is a schematic diagram of a semiconductor manufacturing apparatus with a vacuum pump according to the present invention, where a vacuum pump and a process chamber are connected indirectly.
Figure 31:
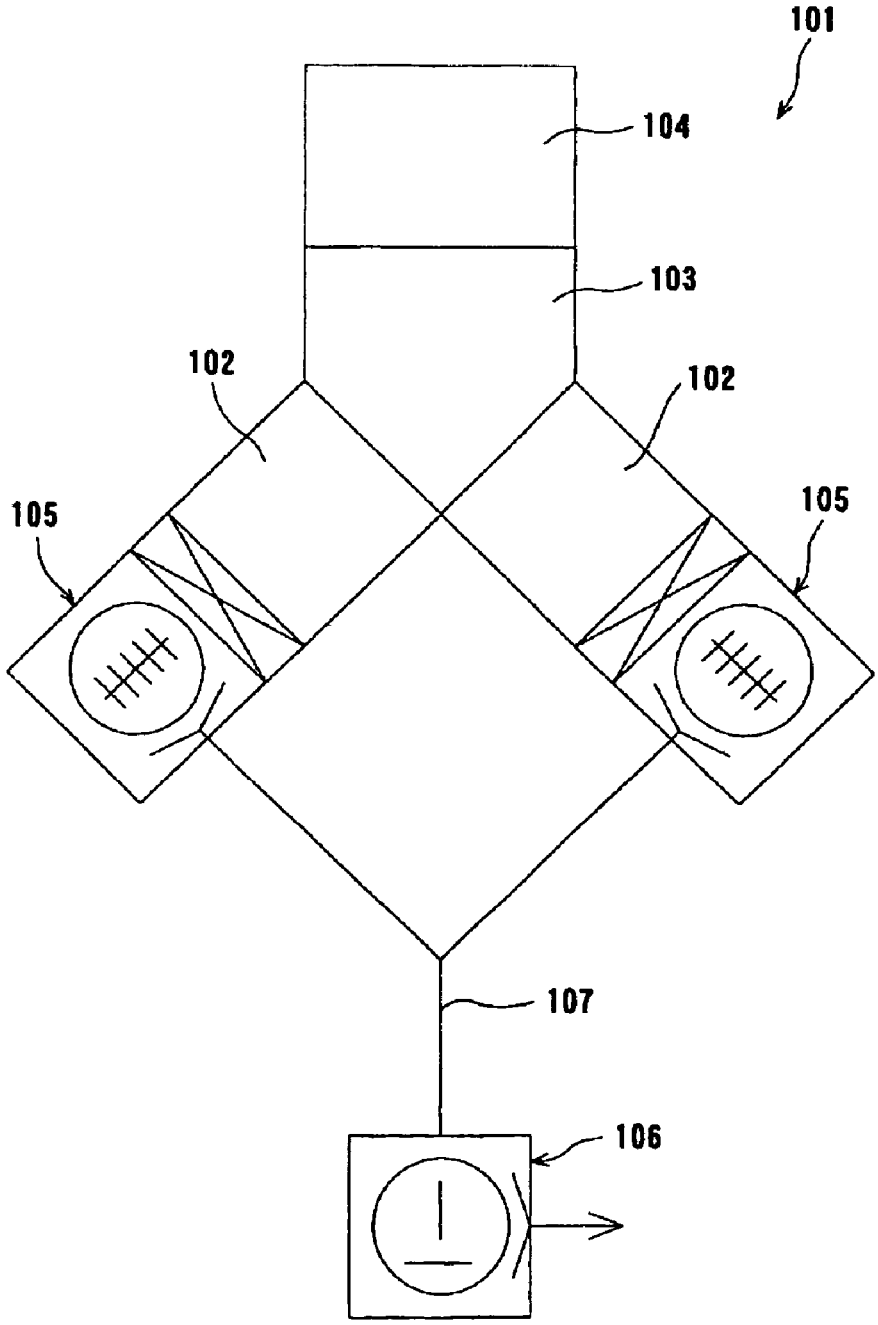
FIG. 31 is a schematic diagram of a semiconductor manufacturing apparatus with a conventional vacuum pump.
Figure 32:
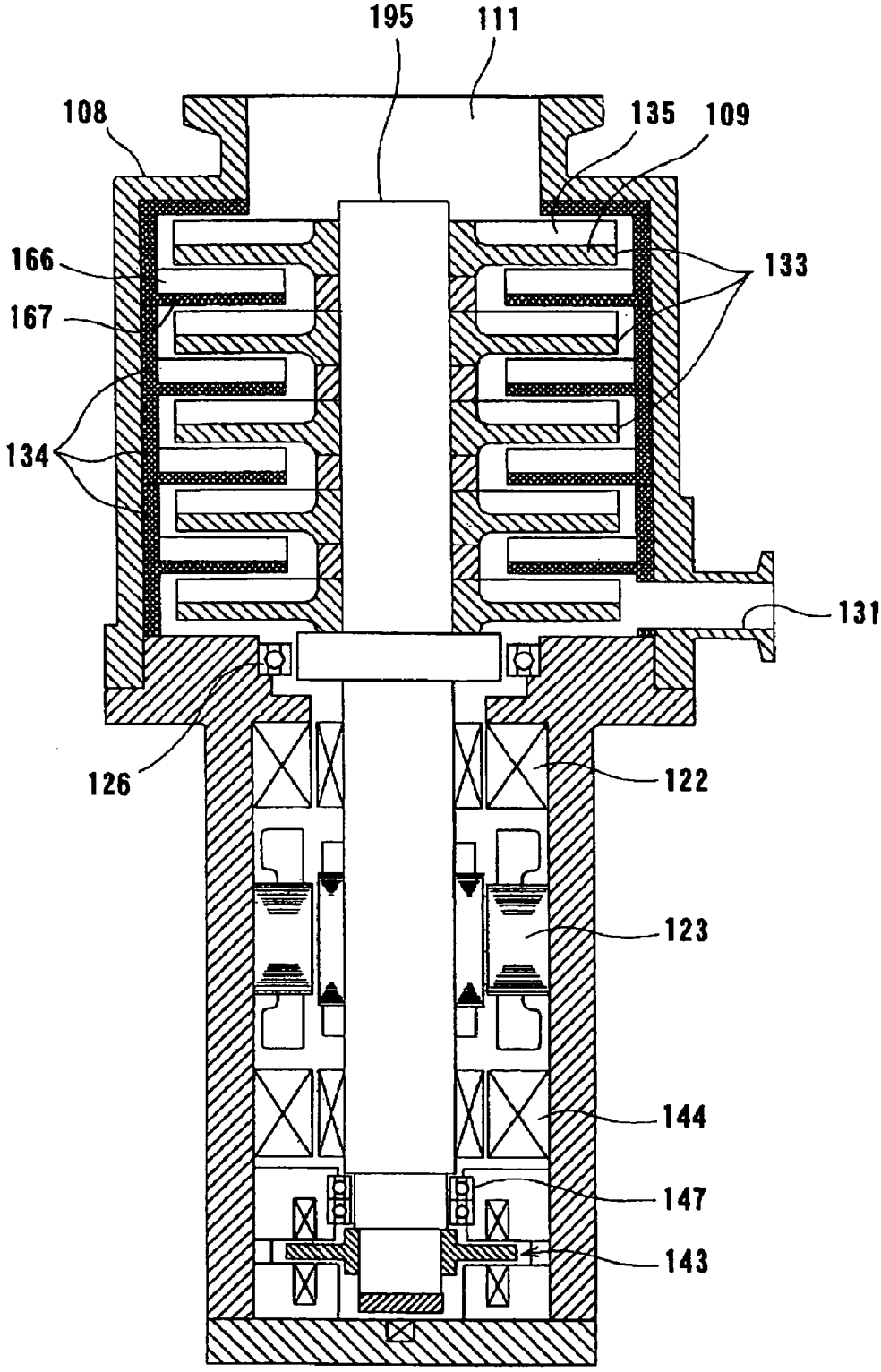
FIG. 32 is a sectional view of a conventional turbo vacuum pump.
Figure 33A:
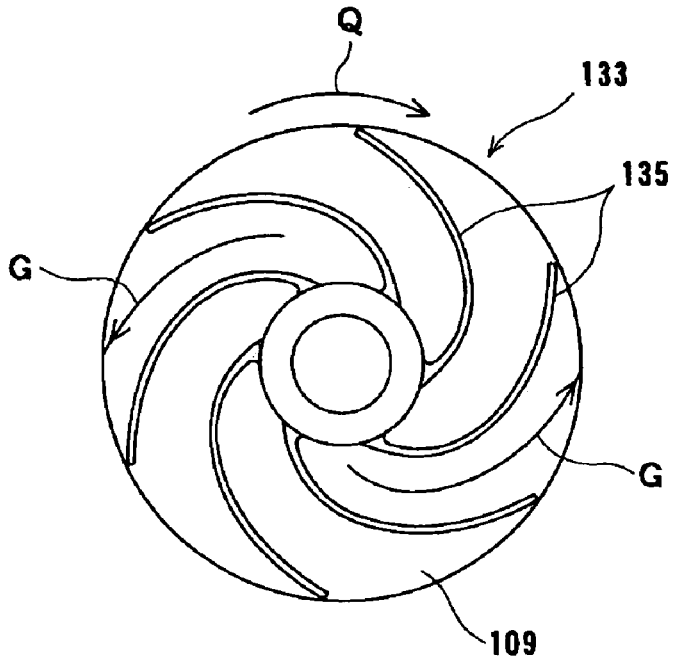
FIG. 33(*a*) is a plan view of a centrifugal drag vane shown in FIG. 32.
Figure 33B:
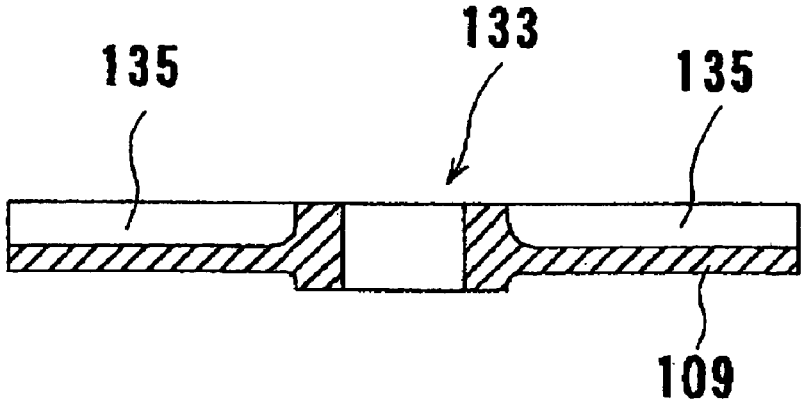

Directly connecting the vacuum pump 205 to the process chamber 202 allows to leave a piping out, and to diminish the possibility of leakage of a gas through the joint of a piping. On the other side, indirectly connecting the vacuum pump 215 to the process chamber 202 allows to place the vacuum pump 215 apart from the process chamber 202, to eliminate the affection of the vibration caused by the vacuum pump 215 to the process chamber 202. In addition, as shown in FIG. 30, two process chambers 202 are evacuated by one vacuum pump 212. In this case, installing the valves 213 on the branched piping to the process chambers 202, allows the sole operation of one process chamber 202.

Though the semiconductor manufacturing apparatus 201 in FIG. 29 and the semiconductor manufacturing apparatus 211 in FIG. 30 comprise two process chambers, a number of process chambers is not limited to two, and a semiconductor manufacturing apparatus may comprise single process chamber or, three or more process chambers. Though two process chambers 202 are evacuated by one vacuum pump 212 in the semiconductor manufacturing apparatus 211 in FIG. 30, two vacuum pumps 212 may be provided. In this case, connecting each vacuum pumps 212 to both of two process chambers 202 through each piping, enables to evacuate two process chambers 202 even when one vacuum pump 202 is out of operation due to maintenance, etc.

Embodiments of a vacuum pump of the present invention are described above. However, it should be understood that the present invention is not limited to the foregoing embodiments, but that a variety of changes can be made without departing from the scope of the present invention.

The use of the terms "a" and "an" and "the" an similar references in the context of describing the invention (especially in the context of the following claims) are to be construed to cover both the singular and the plural, unless otherwise indicated herein or clearly contradicted by context. The use of any and all examples, or exemplary language (e.g., "such as") provided herein, is intended merely to better illuminate the invention and does not pose a limitation on the scope of the invention unless otherwise claimed.

What is claimed is:

1. A vacuum pump for exhausting a gas, comprising:

a main shaft rotatably supported by a bearing;

a motor for rotating said main shaft; and centrifugal drag vanes attached to said main shaft, wherein each of said centrifugal drag vanes has a cylindrical portion fitted with said main shaft and has a blade portion fixed to an outer surface of said cylindrical portion;

said blade portion has a spiral blade integrally connected to said outer surface of said cylindrical portion and a disk-shaped base, said disk-shaped base having a low pressure side to which said spiral blade is fixed and a high pressure side of which no blade is fixed;

an axial length of said cylindrical portion is larger than that of said blade portion;

an axial length of said spiral blade is continuously reduced in a radially outward direction.

2. The vacuum pump according to claim 1, wherein said spiral blade extends rearward with respect to a rotation direction, and on said outer surface of said cylindrical portion, a length from an upper surface of said base to an upper end of said cylindrical portion and a length from a lower surface of said base to a lower end of said cylindrical portion are each not less than 0.5 times of a thickness of said base.

3. The vacuum pump according to claim 1, wherein said spiral blade extends rearward with respect to a rotation direction, and an axial length of said base is continuously reduced in a radially outward direction.

4. The vacuum pump according to claim 1, wherein said spiral blade extends rearward with respect to a rotation direction, and a connection portion of said spiral blade and said base is formed with a fillet.

5. A semiconductor manufacturing apparatus comprising:

a vacuum pump according to claim 1; and a process chamber for processing a substrate, wherein said vacuum pump and said process chamber are connected directly or indirectly.

6. A vacuum pump for exhausting a gas, comprising:

a main shaft rotatably supported by a bearing;

a motor for rotating said main shaft and;

centrifugal drag vanes attached to said main shaft, wherein each of said centrifugal drag vanes has a cylindrical portion fitted with said main shaft and has a blade portion fixed to an outer surface of said cylindrical portion; said blade portion has a plurality of radial blades integrally connected to said outer surface of said cylindrical portion and a disk-shaped base, said disk-shaped having a low pressure side to which each of said radial blades is fixed and a high pressure side to which no blade is fixed;

an axial length of said cylindrical portion is larger than that of said blade portion;

an axial length of each of said radial blades is continuously reduced in a radially outward direction; and on said outer surface of said cylindrical portion, a length from an upper surface of said base to an upper end of said cylindrical portion and a length from a lower surface of said base to a lower end of said cylindrical portion are each not less than 0.5 times of a thickness of said base.

7. A vacuum pump for exhausting a gas, comprising:

a main shaft rotatably supported by a bearing;

a motor for rotating said main shaft; and a centrifugal drag vane attached to said main shaft, wherein said centrifugal drag vane has a cylindrical portion fitted with said main shaft and has a blade portion fixed to an outer surface of said cylindrical portion;

said blade portion has a spiral blade integrally connected to said outer surface of said cylindrical portion, and a disk-shaped base to which said spiral blade is fixed;

an axial length of said cylindrical portion is larger than that of said blade portion;

an axial length of said spiral blade is continuously reduced in a radially outward direction, wherein said spiral blade extends rearward with respect to a rotation direction and a connection portion of said spiral blade and said disk-shaped base is formed with a fillet, and wherein a cross section of said fillet is formed to be larger on a rearward side of a tip of said spiral blade with respect to a rotation direction.

8. A vacuum pup for exhausting a gas, comprising:

a main shaft rotatably supported by a bearing;

a motor for rotating said main shaft; and centrifugal drag vanes attached to said main shaft, wherein each of said centrifugal drag vanes has a cylindrical portion fitted with said main shaft and has a blade portion fixed to an outer surface of said cylindrical portion; said blade portion has a spiral blade integrally connected to a disk-shaped base and to said outer surface of said cylindrical portion; a connection portion of said cylindrical portion and said spiral blade being formed with a fillet; said disk-shaped base having a low pressure side to which said spiral blade is fixed and a high pressure side to which no blade is fixed; an axial length of said cylindrical portion is larger than that of said blade portion; a curved surface portion is formed at a tip of said spiral balding; and the tip is located slightly on a radially inner side of a peripheral edge of said base.

9. A vacuum pump for exhausting a gas, comprising;

a main shaft rotatably supported by a bearing;

a motor for rotating said main shaft; and a centrifugal drag vane attached to said main shaft, wherein said centrifugal drag vane has a cylindrical portion fitted with said main shaft and has a blade portion fixed to an outer surface of said cylindrical portion;

said blade portion has a spiral blade integrally connected to said outer surface of said cylindrical portion, and a disk-shaped base to which said spiral blade is fixed;

an axial length of said cylindrical portion is larger than that of said blade portion;

a curved surface portion is formed at a tip of said spiral blade; and said tip is located slightly on a radially inner side of a peripheral edge of said disk-shaped base, and wherein a connection portion of said spiral blade and said base is formed with a fillet having an arcuate section, and said arcuate section is larger on a rearward side of said tip with respect to a rotation direction of said main shaft.

* * * * *